US009152066B2

(12) United States Patent
Inoue et al.

(10) Patent No.: US 9,152,066 B2
(45) Date of Patent: Oct. 6, 2015

(54) TONER, DEVELOPER, PROCESS CARTRIDGE, AND IMAGE FORMING APPARATUS

(71) Applicants: Ryota Inoue, Shizuoka (JP); Hiroaki Katoh, Kyoto (JP); Masahiro Seki, Nara (JP); Shun Saito, Shizuoka (JP); Yoshitaka Sekiguchi, Shizuoka (JP); Yoshihiro Mikuriya, Hyogo (JP); Kazuoki Fuwa, Kyogo (JP); Satoshi Ogawa, Nara (JP); Tomohiro Fukao, Osaka (JP); Takayuki Nakamura, Osaka (JP)

(72) Inventors: Ryota Inoue, Shizuoka (JP); Hiroaki Katoh, Kyoto (JP); Masahiro Seki, Nara (JP); Shun Saito, Shizuoka (JP); Yoshitaka Sekiguchi, Shizuoka (JP); Yoshihiro Mikuriya, Hyogo (JP); Kazuoki Fuwa, Kyogo (JP); Satoshi Ogawa, Nara (JP); Tomohiro Fukao, Osaka (JP); Takayuki Nakamura, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/792,763

(22) Filed: Mar. 11, 2013

(65) Prior Publication Data

US 2013/0244157 A1 Sep. 19, 2013

(30) Foreign Application Priority Data

Mar. 15, 2012 (JP) ..... 2012-058783
Jan. 28, 2013 (JP) ..... 2013-013622

(51) Int. Cl.
*G03G 9/087* (2006.01)
*G03G 9/08* (2006.01)
*G03G 21/18* (2006.01)

(52) U.S. Cl.
CPC ..... *G03G 9/08755* (2013.01); *G03G 9/0812* (2013.01); *G03G 9/08764* (2013.01); *G03G 9/08782* (2013.01); *G03G 21/18* (2013.01)

(58) Field of Classification Search
USPC ..... 430/108.8, 109.1, 109.4, 110.1
See application file for complete search history.

(56) References Cited

U.S. PATENT DOCUMENTS 5,965,316 A * 10/1999 Kmiecik-Lawrynowicz et al. ..... 430/137.14
2003/0190540 A1* 10/2003 Shoshi et al. ..... 430/78
2006/0160011 A1 7/2006 Inoue et al.
2007/0134577 A1* 6/2007 Tong et al. ..... 430/108.1
2007/0141500 A1 6/2007 Sugimoto et al.
2007/0218382 A1 9/2007 Emoto et al.
2008/0102395 A1* 5/2008 Ohmura et al. ..... 430/109.4
2010/0330489 A1 12/2010 Inoue et al.

(Continued)

FOREIGN PATENT DOCUMENTS

JP 2001-337485 A 12/2001
JP 2001-337486 A 12/2001

(Continued)

OTHER PUBLICATIONS

Extended European Search Report issued Jun. 5, 2013 in Patent Application No. 13159262.8.

*Primary Examiner* — Peter Vajda
(74) *Attorney, Agent, or Firm* — Oblon, McClelland, Maier & Neustadt, L.L.P.

(57) ABSTRACT

A toner, including: a binder resin; releasing agent-encapsulating capsules; and a colorant, wherein the releasing agent-encapsulating capsules each include: a capsule formed of a resin (I) which is different from the binder resin; and a releasing agent (RA) which is encapsulated in the capsule, and the releasing agent-encapsulating capsules exist in the binder resin, and wherein 50% to 100% of the releasing agent-encapsulating capsules exist in a region from a surface of the toner to a depth of 0.10 times a volume-average particle diameter of the toner.

16 Claims, 5 Drawing Sheets

(56) References Cited

U.S. PATENT DOCUMENTS

| | | | | |
|---|---|---|---|---|
| 2011/0086308 | A1 | 4/2011 | Watanabe et al. | |
| 2011/0091800 | A1* | 4/2011 | Kuramashi | 430/105 |
| 2011/0129773 | A1 | 6/2011 | Shu et al. | |
| 2011/0177445 | A1* | 7/2011 | Murata et al. | 430/108.4 |
| 2011/0223530 | A1 | 9/2011 | Inoue et al. | |
| 2011/0223532 | A1 | 9/2011 | Sugimoto et al. | |
| 2011/0281213 | A1 | 11/2011 | Sakashita et al. | |

FOREIGN PATENT DOCUMENTS

| | | |
|---|---|---|
| JP | 2006-091564 | 4/2006 |
| JP | 2008-070755 | 3/2008 |
| JP | 2011-145587 | 7/2011 |

* cited by examiner

TONER, DEVELOPER, PROCESS CARTRIDGE, AND IMAGE FORMING APPARATUS

BACKGROUND OF THE INVENTION

1. Field of the Invention

The present invention relates to a toner, a developer, a process cartridge, and an image forming apparatus.

2. Description of the Related Art

In addition to a conventional kneading/grinding method, the so-called wet granulation method or chemical toner method (wet granulation method), such as a dissolution suspension method or an emulsification method using an organic solvent and an aqueous solvent, and a suspension polymerization method that conducts polymerization while regulating polymerizable monomer droplets to directly obtain toner particles, an agglomeration method that includes preparing emulsified fine particles and agglomerating the fine particles to obtain toner particles have become used for toner production. An agglomeration method that prepares emulsified fine particles and agglomerates the emulsified fine particles to obtain toner particles is one of the chemical toner methods.

Examples of toners proposed as produced by the agglomeration method include the so-called core/shell toners including an inner component of a resin that is advantageous in heat fixation and an outer component of a resin that covers the outside of the toner and is advantageous in blocking and the like (see Japanese Patent Application Laid-Open (JP-A) No. 2006-91564) and toners that contain a crystalline polyester resin and excel in low-temperature fixability (see JP-A No. 2011-145587).

These toners, however, excel in low-temperature fixability, but on the other hand, hot-offset resistance and heat-resistant storage stability are unsatisfactory.

To overcome this problem, a toner, 50% by mass or less of which is accounted for by a polyester resin, produced by mixing a resin dispersion, the resin dispersion being obtained by dissolving a polyester resin A and wax in a vinyl-based monomer, dispersing the solution in a surfactant-containing aqueous phase, and polymerizing the vinyl-based monomer through the action of a polymerization initiator, a dispersion including a polyester resin B dispersed in an aqueous phase, and a dispersion of colorant particles, agglomerating them, and then raising the temperature to allow the agglomerated particles to coalesce with each other has been proposed as a toner that simultaneously realizes low-temperature fixability and hot-offset resistance (see JP-A No. 2008-70755).

In this proposed toner, however, since the resin particles, after agglomerated, are heated at elevated temperatures, compatibilization occurs between resins that have a high affinity, such as between a polyester resin and a crystalline polyester resin, disadvantageously resulting in lowered heat-resistant storage stability of the toner.

Accordingly, the provision of a toner that simultaneously has all of excellent low-temperature fixability, hot offset resistance, and heat-resistant storage stability, a process for producing the same, and a process cartridge that conducts development with the toner has been desired.

SUMMARY OF THE INVENTION

The present invention aims to solve the various problems of the prior art and attain the following object. Specifically, an object of the present invention is to provide a toner that simultaneously has all of excellent low-temperature fixability, hot offset resistance, and heat-resistant storage stability.

The above object can be attained by the following. Specifically, a toner of the present invention includes: a binder resin; releasing agent-encapsulating capsules; and a colorant, wherein the releasing agent-encapsulating capsules each include a capsule formed of a resin (I) which is different from the binder resin and a release agent (RA) encapsulated in the capsule, and the releasing agent-encapsulating capsules exist in the binder resin, and wherein 50% to 100% of the releasing agent-encapsulating capsules exist in a region from a surface of the toner to a depth of 0.10 times a volume average particle diameter of the toner.

The present invention can solve the various problems of the prior art and can attain the object, that is, can provide a toner that simultaneously has all of excellent low-temperature fixability, hot offset resistance, and heat-resistant storage stability.

DETAILED DESCRIPTION OF THE INVENTION (Toner)

Figure 1A:
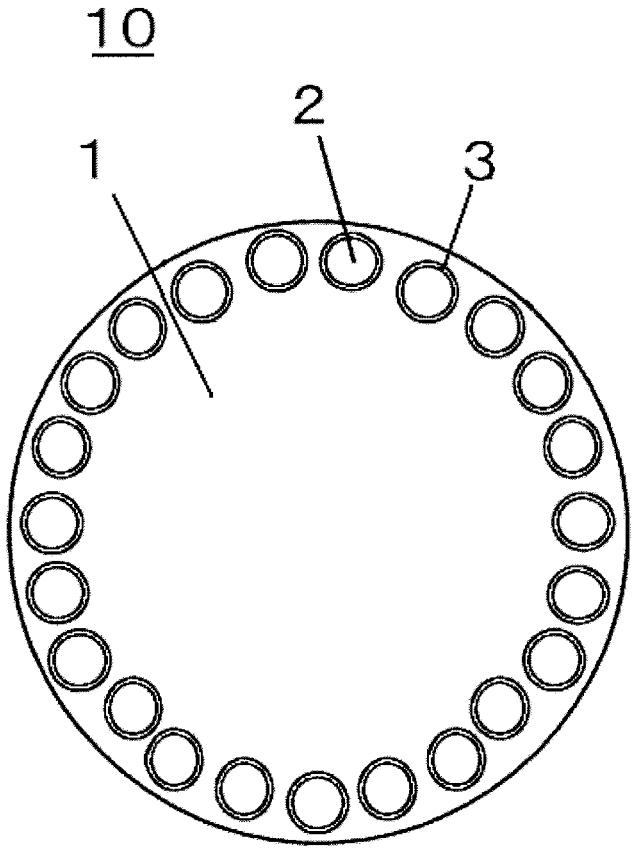
FIG. 1A is a schematic explanatory view showing one example of the structure of a toner according to the present invention.

A toner according to the present invention contains at least releasing agent-encapsulating capsules and a colorant, and optionally other components.

The releasing agent-encapsulating capsules each include: a capsule formed of a resin (I) which is different from a binder resin; and a release agent (RA) encapsulated in the capsule, and the releasing agent-encapsulating capsules exist in the binder resin.

50% to 100% of the releasing agent-encapsulating capsules exist in a region from the surface of the toner to a depth of 0.10 times the volume average particle diameter of the toner.

In the toner according to the present invention, the release agent (RA) is contained in the toner particles containing the binder resin. The release agent (RA) is encapsulated in the resin (I) different from the binder resin, and 50% to 100% of the releasing agent-encapsulating capsules are arranged in the vicinity of a surface layer of the toner. According to this construction, in a normal state, exposure of the release agent (RA) on the surface of the toner can be prevented.

Preferably, the releasing agent-encapsulating capsule includes: a capsule formed of a resin (D) that includes a resin (I) different from the binder resin and a vinyl polymer and has a high affinity for the release agent (RA); and the release agent (RA) encapsulated in the capsule, the capsule being present in the binder resin. More preferably, at least part of the release agent (RA) encapsulated in the capsule is encapsulated in the resin (D).

In the present invention, high affinity means that the resin (D) is likely to be bonded to the release agent (RA) or is likely to be adhered to the release agent (RA) by electrostatic interaction or the like. Accordingly, in the present invention, encapsulating means that the release agent (RA) is selectively bonded and/or adhered to the resin (D) in its site having a high affinity for the release agent.

The resin (D) has a high affinity for the release agent (RA), and the resin (D) is highly compatible with the release agent (RA). Accordingly, the resin (D) suitably encapsulates the release agent (RA).

Thus, in the toner according to the present invention, the release agent (RA) is encapsulated in the capsule formed of the resin (I), and, thus, the release agent (RA) is isolated from the binder resin. Therefore, even when 50% to 100% of the releasing agent-encapsulating capsules exist in the vicinity of the surface layer of the toner, in a normal state, exposure of the release agent (RA) on the surface of the toner can be prevented. The toner having this structure is advantageous in that the heat-resistant storage stability is improved and an adverse effect such as stress received from an electrophotographic process is reduced. Further, upon exposure to heat and pressure during fixation, the release agent (RA) is escaped to the outside of the capsule and exhibits hot-offset resistance, and, thus, the hot-offset resistance can be ensured during fixation.

<Releasing Agent-Encapsulating Capsule>

The releasing agent-encapsulating capsules each include: a capsule formed of a resin (I) which is different from the binder resin; and a release agent (RA) encapsulated in the capsule, and exist in the binder resin.

The capsule is not particularly limited and may be properly selected according to purposes as long as the capsule is formed of the resin (I). Preferably, however, the capsule is formed of the resin (I) and the resin (D).

The structure of the capsule (encapsulating the release agent (RA) in the capsule formed of the resin (I)) can be confirmed, for example, by embedding the toner in a resin, slicing the embedded toner with an ultramicrotome (ULTRACUT-S, manufactured by Leica Microsystems) to prepare a thin section of the toner, observing the thin section under a scanning transmission electron microscope (STEM).

The average circle-equivalent diameter of the releasing agent-encapsulating capsules is not particularly limited and may be properly selected according to purposes. The average circle-equivalent diameter is preferably 50 nm to 200 nm, more preferably 50 nm to 150 nm, still more preferably 50 nm to 100 nm. When the average circle-equivalent diameter is less than 50 nm, the hot-offset resistance is sometimes unsatisfactory. On the other hand, when the average circle-equivalent diameter is more than 200 nm, the heat-resistant storage stability is sometimes lowered.

The average circle-equivalent diameter of the releasing agent-encapsulating capsules encapsulated in the toner can be determined, for example, from a cross-sectional image of the toner obtained by embedding the toner in a resin, slicing the embedded toner with an ultramicrotome (ULTRACUT-S, manufactured by Leica Microsystems) to prepare a thin section of the toner, and observing the thin section under a scanning transmission electron microscope (STEM). For example, a software for image analysis-type particle size distribution measurement (Mac-View, manufactured by Mountech Co., Ltd.) may be used for the calculation.

The volume average particle diameter of the releasing agent-encapsulating capsules is not particularly limited and may be properly selected according to purposes. The volume average particle diameter of the releasing agent-encapsulating capsules, however, is preferably 50 nm to 200 nm, more preferably 50 nm to 100 nm. When the volume average particle diameter of the releasing agent-encapsulating capsules is less than 50 nm, the hot-offset resistance is sometimes unsatisfactory. On the other hand, when the volume average particle diameter of the releasing agent-encapsulating capsules is more than 200 nm, the heat-resistant storage stability is sometimes lowered.

The volume average particle diameter can be measured with a dynamic light scattering-type nanotrack particle size analyzer (for example, UPA-EX150, manufactured by Nikkiso Co., Ltd.).

The releasing agent-encapsulating capsule contained in the toner can be separated by adding N,N-dimethylformamide, chloroform or the like to the toner, stirring the mixture, filtering the liquid through a membrane filter, and drying the residue at room temperature.

The average thickness of the capsules is not particularly limited and may be properly selected according to purposes. The average thickness of the capsules, however, is preferably 10 nm to 60 nm, more preferably 10 nm to 30 nm. When the average thickness of the capsules is less than 10 nm, the heat-resistant storage stability is sometimes deteriorated. On the other hand, when the average thickness of the capsules is more than 60 nm, the hot-offset resistance is sometimes unsatisfactory.

The capsules may be analyzed for thickness measurement, for example, by embedding the capsule in a resin, slicing the embedded capsules with an ultramicrotome to prepare a thin section, and observing the thin section under a scanning transmission electron microscope. In the present invention, the average thickness means the average of the thicknesses of 100 capsules.

The ratio of the releasing agent-encapsulating capsules existing in a region from the surface of the toner to a depth of 0.10 times the volume average particle diameter of the toner is not particularly limited and may be properly selected according to purposes as long as the ratio is 50% to 100%. The ratio of the releasing agent-encapsulating capsules is 70% to 100%. When the ratio is less than 50%, the releasability is sometimes lowered. On the other hand, when the ratio is 70% to 100%, the release agent (RA) is disposed in the vicinity of the surface of the toner and, thus, the releasability can be effectively imparted.

The ratio (%) can be determined, for example, by slicing the toner with an ultramicrotome (ULTRACUT-S, manufactured by Leica Microsystems) to prepare a thin section, observing the thin section under a scanning transmission electron microscope (STEM) to obtain a cross-sectional image of the toner, and calculating, based on the cross-sectional image thus obtained, the percentage area (%) of the releasing agent-encapsulating capsule existing in a predetermined region (that is, a region from the surface of the toner to a depth of 0.10 times the volume average particle diameter of the toner) in the total area of the capsules present in the whole area of the cross section of the observed toner particle. For example, a software for image analysis-type particle size distribution measurement (Mac-View, manufactured by Mountech Co., Ltd.) may be used for the measurement of the depth from the toner surface.

The depth from the toner surface can be accurately measured by selecting, among cross-sectional images of the observed toner, a cross-sectional image of the toner having a diameter within ±10% of the volume average particle diameter of the toner as a cross-sectional image passing through around the center of gravity of the toner and determining the ratio (%). In the present invention, the average value of the ratio means the average of the ratio for 100 cross-sectional images of the toner.

For releasing agent-encapsulating capsules that straddle the internal and external portions in the predetermined region, the portion present, on the inner side of the predetermined region is counted as the area of the releasing agent-encapsulating capsules existing in the predetermined region.

In the toner according to the present invention, even when the release agent exists in the vicinity of the surface of toner particles, unlike conventional toner particles, various problems are less likely to occur, such as exposure of the release agent to the toner surface that is experienced in the prior art where the release agent exists on the toner surface. Accordingly, the diameter of the release agent dispersed can be increased. As a result, in heating and pressing during fixation, the wax can easily ooze out from the toner surface to enhance a release effect.

The mass ratio between the resin (I) and the resin (D) ((I)/(D)) is not particularly limited and may be properly selected according to purposes. The mass ratio, however, is preferably 0.5 to 35, more preferably 0.5 to 3.0. When the mass ratio is less than 0.5, the hot-offset resistance is sometimes deteriorated. On the other hand, when the mass ratio is more than 35, the heat-resistant storage stability is sometimes deteriorated. A mass ratio in the above more preferred range is preferred from the viewpoint of simultaneously realizing hot-offset resistance and heat-resistant storage stability.

The mass ratio between the release agent (RA) and the resin (D) encapsulated in the capsule ((D)/(RA)) is not particularly limited and may be properly selected according to purposes. The mass ratio, however, is preferably 0.01 to 2.5, more preferably 0.1 to 2.5. When the mass ratio is less than 0.01, the heat-resistant storage stability is sometimes deteriorated. On the other hand, when the mass ratio is more than 2.5, the hot-offset resistance is sometimes deteriorated. A mass ratio in the above more preferred range is preferred from the viewpoint of realizing excellent heat-resistant storage stability, low-temperature fixability, and hot-offset resistance.

—Resin (I)—

The resin (I) is a resin different from the binder resin and forms a capsule encapsulating the release agent (RA). When the toner contains the resin (I), advantageously, the hot-offset resistance and the heat-resistant storage stability can be simultaneously realized.

In the present invention, the expression "different from the binder resin" means that there is a difference in the type of monomer for binder resin formation, that is, there is a difference in the ratio of monomers and the molecular weight for binder resin formation.

Any resin that is different from the binder resin may be used as the resin (I) without particular limitation and may be properly selected according to purposes. An example of the resin (I) is a modification product of the binder resin. Vinyl resins are preferred from the viewpoints of availability and easiness on synthesis.

The vinyl resins may be synthesized by any method without particular limitation, and the method may be properly selected according to purposes. Examples thereof include a method in which the vinyl resin is obtained by polymerizing a monomer having a polymerizable double bond. A conventional polymerization initiator may also be used.

Any monomer having a polymerizable double bond is not particularly limited and may be properly selected according to purposes. Examples thereof include styrene, α-methylstyrene, 4-methylstyrene, 4-ethylstyrene, 4-tert-butylstyrene, 4-methoxystyrene, 4-ethoxystyrene, 4-carboxystyrene or metal salts thereof, 4-styrenesulfonic acid or metal salts thereof, 1-vinylnaphthalene, 2-vinylnaphthalene, allylbenzene, phenoxyalkylene glycol acrylate, phenoxyalkylene glycol methacrylate, phenoxy polyalkylene glycol acrylate, phenoxy polyalkylene glycol methacrylate or the like, (meth) acrylic acid, maleic acid (anhydride), monoalkyl maleate, fumaric acid, monoalkyl fumarate, crotonic acid, itaconic acid, itaconic acidmonoalkyl, itaconic acid glycol monoether, citraconic acid, citraconic acidmonoalkyl, cinnamic acid or the like, sulfonic acid group-containing vinyl monomers, vinyl-based sulfuric acid monoesters, and salts thereof, and phosphoric acid group-containing vinyl monomers and salts thereof.

The resin (I) for the formation of the capsule in the toner may be analyzed by any method without particular limitation, and the method may be properly selected according to purposes. Examples of such methods include a method in which the resin (I) in the toner is analyzed using a gas chromatograph-mass spectrometer (GC-MS) or a nuclear magnetic resonance apparatus (NMR) and a method in which other materials in the toner are removed by dissolution in an organic solvent to separate the resin (I) which is then analyzed.

Specifically, the composition and ratio of components of the resin can be determined by $^{13}$C-NMR spectrum and GC-MS measurement conducted according to the following methods.

$^{13}$C-NMR measurement may be carried out, by placing 50 mg of a sample in a cap-type glass test tube, heating the test tube with a radio-frequency heating apparatus (QUICKER1010, manufactured by DIC) for one min, adding 30.5 mL of deutrochloroform ($CDCl_3$) and a shiftless relaxation reagent tris(2,4-pentanedionato)chromium(III)($Cr(acac)_3$) to this decomposition product, and measuring a $^{13}$C-NMR spectrum with a nuclear magnetic resonance apparatus JNM-LA300 (manufactured by Japan Electric Optical Laboratory).

For the GC-MS measurement, a method may be adopted in which pyrolysis GC-MS measurement is carried out with a mass spectrometer (JMS-K9, manufactured by Japan Electric Optical Laboratory) using a column of INERT CAP 5MS/Sil (30 m×0.25 mm, I.D. 0.25 μm) (manufactured by GL Science) at a temperature rise rate of 40° C. (3 min), then 10° C./min, and then 300° C. (5 min).

The weight average molecular weight (Mw) of the resin (I) is not particularly limited and may be properly selected according to purposes. The weight average molecular weight (Mw) is preferably 3,000 to 300,000, more preferably 4,000 to 100,000.

The weight average molecular weight (Mw) may be measured, for example, by gel permeation chromatography (GPC).

The glass transition temperature (Tg) of the resin (I) is not particularly limited and may be properly selected according to purposes. The glass transition temperature (Tg) is preferably 45° C. to 100° C., more preferably 55° C. to 90° C. When the glass transition temperature of the resin (I) is below 45° C., the heat-resistant storage stability is sometimes deteriorated. On the other hand, when the glass transition temperature of the resin (I) is above 100° C., the low-temperature fixability is sometimes deteriorated.

The glass transition temperature may be measured, for example, with a differential scanning calorimetry (DSC) apparatus (for example, TG-DSC system TAS-100, manufactured by Rigaku Corporation).

The content of the resin (I) is not particularly limited and may be properly selected according to purposes. The content of the resin (I) in the toner, however, is preferably 5% by mass to 25% by mass, more preferably 8% by mass to 20% by mass. When the content of the resin (I) is less than 5% by mass, the heat-resistant storage stability is sometimes deteriorated. On the other hand, when the content of the resin (I) is more than 25% by mass, the low-temperature fixability is sometimes deteriorated.

—Resin (D)—

The resin (D) is a resin that includes a vinyl polymer and has a high affinity for the release agent (RA). Here the expression "resin having a high affinity for the release agent (RA)" means that the release agent (RA) and the resin (D), when mixed, are miscible on a molecule level, more specifically means that the absolute value of a difference between the solubility parameter of the resin (D) (hereinafter sometimes referred to as "SP(D)") and the solubility parameter of the release agent (RA) (hereinafter sometimes referred to as "SP (RA)"), that is, |SP(RA)−SP(D)|, is less than 3. Preferably, |SP(RA)−SP(D)|<2.

An example of the resin (D) is a resin obtained by introducing a vinyl polymer into a component that has an oil-soluble structure in at least part thereof.

Specific examples thereof include: graft copolymerized resins that include a backbone of a component having an oil-soluble structure in at least part thereof and a side chain (graft chain) of a vinyl polymer; and graft copolymerized resins that include a backbone of a vinyl polymer and a side chain of a component having an oil-soluble structure in at least part thereof. Among them, graft copolymerized resins are preferred that include a backbone of a component having an oil-soluble structure in at least part thereof and a side chain (graft chain) of a vinyl polymer.

The value of the solubility parameter of the resin (D) (hereinafter sometimes referred to as "SP(D)") is not particularly limited and may be properly selected according to purposes. SP(D), however, is preferably 8≤SP(D)≤11, more preferably 9≤SP(D)≤10.

When SP(D) is less than 8, the releasability of the toner is lowered and the hot-offset resistance is sometimes deteriorated. On the other hand, when SP(D) is more than 11, the capsules are less likely to be present in the binder resin of the toner, sometimes leading to the difficulty of producing the toner and deteriorated heat-resistant storage stability.

The solubility parameter SP value (δ) in the present invention is defined as a function of a cohesive energy density by equation A.

$$\text{SP value } (\delta)=(\Delta E/V)^{1/2} \qquad \text{equation A}$$

wherein "ΔE" represents an intermolecular cohesive energy (vaporization heat); "V" represents the whole mass of the mixed liquid; and "ΔE/V" represents a cohesive energy density. A heating value change by mixing, ΔHm, is calculated by equation B using the SP value.

$$\Delta Hm=V(\delta 1-\delta 2)\cdot\Phi 1\cdot\Phi 2 \qquad \text{equation B}$$

wherein "δ1" represents SP value of the solvent; "δ2" represents SP value of the solute; "Φ1" represents the volume fraction of the solvent; and "Φ2" represents the volume fraction of the solute.

As is apparent from equation B, when the δ1 value is closer to the δ2 value, the ΔHm value is smaller and the Gibbs free energy is smaller. Accordingly it is considered that materials that are close to each other in SP value have a high affinity for each other.

A method by which the SP value is actually determined includes comparing the solubility of various solvents and resins having known SP values to set a SP value of an unknown resin from the SP value of the solvent having the highest compatibility. Another method for determining SP value is that, when the monomer composition of the resin is known, the SP value is calculated by the method of Fedor et al. represented by equation C.

$$\text{SP value } (\delta)=(\Sigma\Delta ei/\Sigma\Delta vi)^{1/2} \qquad \text{equation C}$$

wherein "Δei" represents an evaporation energy of an atom or an atom group; and "Δvi" represents a mole volume of an atom or an atom group. They are determined by calculation from the monomer composition of the resin (D).

The resin (D) may be synthesized by any method without particular limitation, and the method may be properly selected according to purposes. Examples of such methods include a method that includes graft-copolymerizing the component having an oil-soluble structure in at least part thereof (oil-soluble component) with a publicly known vinyl polymer and a method that includes graft-copolymerizing a vinyl polymer with the component having an oil-soluble structure in at least part thereof after and/or while synthesizing a vinyl polymer by polymerizing a properly selected vinyl monomer.

—Component Having Oil-Soluble Structure in at Least Part Thereof—

The component having an oil-soluble structure in at least part thereof used as a starting material for the resin (D) is not particularly limited as long as the component is graft-copolymerizable with the vinyl polymer. The component may be properly selected according to purposes. Examples thereof include polyalkyl methacrylates and polyolefinic resins. Among them, polyolefinic resins are particularly preferred because of good compatibility with the release agent (RA). Further, release agents that will be described later may also be used as the component having an oil-soluble structure in at least part thereof used as a starting material for the resin (D).

The olefins for the formation of the polyolefinic resins are not particularly limited and may be properly selected according to purposes. Examples thereof include ethylene, propylene, 1-butene, isobutylene, 1-hexene, 1-dodecene, and 1-octadecene.

The polyolefinic resin is not particularly limited and may be properly selected according to purposes. Examples thereof include polymers of the olefines, oxides of the polymers, modification products of the polymers, copolymers of the olefins with copolymerizable other monomers.

The polymers of the olefins are not particularly limited and may be properly selected according to purposes. Examples thereof include polyethylene, polypropylene, ethylene/propylene copolymers, ethylene/1-butene copolymers, and propylene/1-hexene copolymers.

Examples of oxides of the polymers of the olefins include oxides of the polymers of the olefins.

Examples of modification products of the polymers of the olefins include maleic acid derivative adducts of polymers of the olefins such as maleic anhydride, monomethyl maleate, monobutyl maleate, and dimethyl maleate.

Examples of copolymers of the olefins with the copolymerizable other monomers include copolymers of olefins with monomers such as unsaturated carboxylic acids such as (meth)acrylic acid, itaconic acid, and maleic anhydride; and unsaturated carboxylic acid alkyl esters such as (meth)acrylic acid alkyl (number of carbon atoms: 1 to 18) esters and maleic acid alkyl (number of carbon atoms: 1 to 18) esters.

Among them, preferably the polymers of the olefins, the oxides of the polymers of the olefins, and the modification products of the polymers of the olefins, particularly preferably polyethylene and polypropylene, are used as the component having an oil-soluble structure in at least part thereof used as a starting material for the resin (D).

—Vinyl Polymer—

The vinyl polymer is not particularly limited and may be properly selected according to purposes. Preferably, however, the vinyl polymer contains a vinyl monomer having an ester group.

The vinyl monomer having an ester group is not particularly limited and may be properly selected according to purposes. Examples thereof include alkyl (number of carbon atoms: 1 to 8) esters of unsaturated carboxylic acids such as methyl (meth)acrylate, ethyl (meth)acrylate, butyl (meth) acrylate, and 2-ethylhexyl (meth)acrylate; and vinyl ester-based monomers such as vinyl acetate.

The average ester-group concentration of the vinyl monomer having an ester group is not particularly limited and may be properly selected according to purposes. The average ester-group concentration, however, is preferably 8% by mass to 30% by mass, more preferably 8% by mass to 25% by mass. When the average ester-group concentration is less than 8% by mass, the heat-resistant storage stability and the hot-offset resistance are sometimes deteriorated. On the other hand, when the average ester-group concentration is more than 30% by mass, the heat-resistant storage stability, the low-temperature fixability, the hot-offset resistance and the like are sometimes deteriorated.

The average ester-group concentration can be calculated by Formula (1).

$$\text{Average ester-group concentration}=\Sigma(44/Mwi\times Wi) \qquad \text{Formula (1)}$$

wherein "Mwi" represents a molecular weight of the vinyl monomer including an ester group; and "Wi" represents a charge ratio (% by mass) of the vinyl monomer including an ester group.

When the vinyl polymer is produced from two monomers including an ester group, i.e., monomer 1 (molecular weight M1, amount used W1) and monomer 2 (molecular weight M2, amount used W2), and one monomer having no ester group, i.e., monomer 3 (molecular weight M3, amount used W3), the average ester-group concentration C is calculated by equation (2).

$$\text{Average ester-group concentration } C=[\{(44/M1)\times W1/(W1+W2+W3)\}+\{(44/M2)\times W2/(W1+W2+W3)\}]\times 100 \qquad \text{equation (2)}$$

The average ester-group concentration may be regulated by any method without particular limitation, and the method may be properly selected according to purposes. Examples of such methods include a method in which, in addition to vinyl monomers having an ester group, various vinyl monomers that do not have an ester group and are copolymerizable are also used as the vinyl monomer for vinyl polymer formation.

The vinyl monomer having no ester group is not particularly limited and may be properly selected according to purposes. Examples thereof include aromatic vinyl monomers. Specific examples thereof include styrenic monomers such as styrene, α-methylstyrene, p-methylstyrene, m-methylstyrene, p-methoxystyrene, p-hydroxystyrene, p-acetoxystyrene, vinyltoluene, ethylstyrene, phenylstyrene, and benzylstyrene. Among them, styrene is preferred.

The introduction ratio of the vinyl polymer in the resin (D) is not particularly limited and may be properly selected according to purposes. The introduction ratio is preferably 70% to 95%, more preferably 75% to 90%. When the introduction ratio is less than 70%, the low-temperature fixability is sometimes deteriorated. On the other hand, when the introduction ratio is more than 95%, the heat-resistant storage stability is sometimes deteriorated.

The introduction ratio of the vinyl polymer may be determined, for example, by analyzing the resin (D) in the toner with a gas chromatograph-mass spectrometer and a nuclear magnetic resonance apparatus or by dissolving other materials in the toner in an organic solvent, removing the materials to separate the resin (D), and then analyzing the resin (D).

The resin (D) for the formation of capsules in the toner may be analyzed by any method without particular limitation, and the method may be properly selected according to purposes. The resin (D) may be analyzed, for example, by analyzing the resin (D) in the toner with a gas chromatograph-mass spectrometer and a nuclear magnetic resonance apparatus or by dissolving other materials in the toner in an organic solvent, removing the materials to separate the resin (D), and then analyzing the resin (D).

The softening point of the resin (D) is not particularly limited and may be properly selected according to purposes. The softening point of the resin (D) is preferably 80° C. to 150° C., more preferably 90° C. to 130° C.

The softening point may be measured, for example, with a flow tester (for example, CFP500D, manufactured by Shimadzu Seisakusho Ltd.).

The number average molecular weight (Mn) of the resin (D) is not particularly limited and may be properly selected according to purposes. The number average molecular weight (Mn) is preferably 1,500 to 100,000, more preferably 2,800 to 20,000. The weight average molecular weight (Mw) of the resin (D) is not particularly limited and may be properly selected according to purposes. The weight average molecular weight (Mw) is preferably 2,000 to 100,000, more preferably 5,000 to 50,000. The ratio between the number average molecular weight (Mn) and the weight average molecular weight (Mw) of the resin (D) (Mw/Mn) is not particularly limited and may be properly selected according to purposes. Mw/Mn is preferably 1.1 to 40, more preferably 3 to 30.

The number average molecular weight (Mn) and the weight average molecular weight (Mw) may be measured by gel permeation chromatography (GPC).

The glass transition temperature of the resin (D) is not particularly limited and may be properly selected according to purposes. The glass transition temperature is preferably 40° C. to 90° C., more preferably 50° C. to 70° C.

The glass transition temperature may be measured, for example, with a differential scanning calorimetry (DSC) apparatus (for example, TG-DSC System TAS-100, manufactured by Rigaku Corporation).

The content of the resin (D) is not particularly limited and may be properly selected according to purposes. The content of the resin (D) in the toner is preferably 0.2% by mass to 20% by mass, more preferably 2.0% by mass to 20% by mass. When the content of the resin (D) is less than 0.2% by mass, the heat-resistant storage stability is sometimes deteriorated. On the other hand, when the content of the resin (D) is more than 20% by mass, the hot-offset resistance is sometimes deteriorated.

<Release Agent (RA)>

The release agent (RA) is not particularly limited and may be properly selected according to purposes. Preferably, however, the release agent (RA) is a substance that, when the toner is heated in a fixation step in image formation, provides a satisfactorily low toner viscosity and is neither compatible with nor swells components other than the release agent (RA) in the toner and the surface of the fixation member of the image forming apparatus.

Examples of such release agents (RA) include waxes and silicone oils. They may be used solely or in a combination of two or more of them. Among them, waxes that are usually present as a solid in the toner during storage are particularly preferred from the viewpoint of storage stability of the toner per se.

The waxes are not particularly limited and may be properly selected according to purposes. At least one of hydrocarbon-based waxes and carbonyl group-containing waxes is preferred, and hydrocarbon-based waxes are particularly preferred.

Examples of hydrocarbon-based waxes include polyolefin-based waxes such as polyethylene waxes, polypropylene waxes, waxes formed of ethylene/propylene copolymer, ethylene/1-butene copolymer, and propylene/1-hexene copolymer; petroleum-based waxes such as paraffin waxes, SASOL waxes, and microcrystalline waxes; and Fischer-Tropsh waxes.

Examples of carbonyl group-containing waxes include polyalkanoic esters such as carnauba wax, montan wax, trimethylolpropane tribehenate, pentaerythritol tetrabehenate, pentaerythritol diacetate dibehenate, glycerin tribehenate, and 1,18-octadecanediol distearate; polyalkanol esters such as tristearyl trimellitic acid and distearyl maleate; polyalkanoic acid amides such as ethylenediamine dibehenylamide; polyalkylamides such as trimellitic acid tristearylamide; and dialkyl ketones such as distearyl ketone.

Among them, hydrocarbon-based waxes are preferred because of good hot-offset resistance.

Any method may be used for analyzing the release agent (RA) encapsulated in the capsule in the toner without particular limitation and the method may be properly selected according to purposes. The release agent (RA) may be analyzed, for example, by analyzing the release agent (RA) in the toner with a gas chromatograph-mass spectrometer and a nuclear magnetic resonance apparatus or by dissolving other materials in the toner in an organic solvent, removing the materials to separate the release agent (RA), and then analyzing the release agent (RA).

The melting point of the release agent (RA) is not particularly limited and may be properly selected according to purposes. The melting point of the release agent; (RA), however, is preferably below 80° C., more preferably 50° C. to 77° C. When the melting point of the release agent (RA) is 80° C. or above, the hot-offset resistance is sometimes deteriorated. On the other hand, when the melting point of the release agent (RA) is below 50° C., the heat-resistant storage stability is sometimes deteriorated.

The melting point of the release agent (RA) may be measured, for example, with a differential scanning calorimetry (DSC) apparatus (for example, TG-DSC system TAS-100, manufactured by Rigaku Corporation).

When the content of the release agent (RA) is not particularly limited and may be properly selected according to purposes. The content of the release agent (RA) in the toner is preferably 2% by mass to 25% by mass, more preferably 3% by mass to 20% by mass, particularly preferably 4% by mass to 15% by mass. When the content of the release agent (RA) is less than 2% by mass, the hot-offset resistance and the heat-resistant storage stability are sometimes deteriorated. On the other hand, when the content of the release agent (RA) is more than 25% by mass, in some times, the mechanical strength of the toner is lowered and the hot-offset resistance is deteriorated.

The value of the solubility parameter of the release agent (RA) (hereinafter sometimes referred to as "SP(RA)") is not particularly limited and may be properly selected according to purposes. SP(RA) is preferably $7 \leq SP(RA) \leq 10$, more preferably $8 \leq SP(RA) \leq 9$.

When SP(RA) is less than 7, the release agent (RA) is less likely to be encapsulated in the capsule and the heat-resistant storage stability is sometimes deteriorated. On the other hand, when SP(RA) is more than 10, the releasability of the toner is lowered and the hot-offset resistance is sometimes deteriorated.

<Binder Resin>

The binder resin is not particularly limited and may be properly selected according to purposes. The binder resin may contain a noncrystalline resin (R) and a substance (A) compatible with the noncrystalline resin (R), or alternatively may contain a crystalline resin (C) as a main component.

The value of the solubility parameter of the binder resin (hereinafter sometimes referred to as "SP(B)") is not particularly limited and may be properly selected according to purposes. SP(B) is preferably $9 \leq SP(B) \leq 13$, more preferably $9 \leq SP(B) \leq 12$.

When SP(B) is less than 9, capsules are less likely to be formed in the binder resin and the heat-resistant storage stability is sometimes deteriorated. On the other hand, when SP(B) is more than 13, the capsules are less likely to be present in the binder resin of the toner, sometimes leading to the difficulty of producing the toner or deteriorated heat-resistant storage stability.

The solubility parameter relationship among the binder resin, the resin (I)), and the release agent (RA) is not particularly limited and may be properly selected according to purposes. However, SP(B)>SP(D)>SP(RA) is preferred. When this relationship is not met, in some cases, the production of the toner having a structure that the releasing agent-encapsulating capsules are present in the binder resin is difficult.

<<Noncrystalline Resin (R)>>

The noncrystalline resin (R) is not particularly limited and may be properly selected according to purposes. Preferably, the noncrystalline resin (R) is at least partially soluble in an organic solvent. When the toner is used for electrostatic latent image development, resins having a polyester skeleton are more preferred as the noncrystalline resin (R) because of good fixability.

Examples of resins having a polyester skeleton include polyester resins, block polymers of polyesters with resins having other skeleton. They may be used solely or in a combination of two or more of them. Among them, polyester resins are preferred from the viewpoint of the excellent uniformity of the toner.

The polyester resin is not particularly limited and may be properly selected according to purposes. Examples thereof include ring-opened polymers of lactones, polycondensates of hydroxycarboxylic acids, and polycondensates of polyols with polycarboxylic acids. Among them, polycondensates of polyols with polycarboxylic acids are preferred from the viewpoint of a high degree of freedom in design.

—Polyol—

The polyol is not particularly limited and may be properly selected according to purposes. Examples thereof include diols and trihydric or higher polyols. They may be used solely or in a combination of two or more of them. Among them, diols that are used solely or mixtures of diols with a small amount of trihydric or higher polyols are preferred.

Examples of diols include alkylene glycols such as ethylene glycol, 1,2-propylene glycol, 1,3-propylene glycol, 1,4-butanediol, and 1,6-hexanediol; alkylene ether glycols such as diethylene glycol, triethylene glycol, dipropylene glycol, polyethylene glycol, polypropylene glycol, and polytetramethylene ether glycol; alicylic diols such as 1,4-cyclohexane dimethanol and hydrogenated bisphenol A; bisphenols such as bisphenol A, bisphenol F, and bisphenol S; alkylene oxide (for example, ethylene oxide, propylene oxide, or butylene oxide) adducts of the above alicyclic diols; 4,4'-dihydroxybiphenyls such as 3,3'-difluoro-4,4'-dihydroxybiphenyl; bis(hydroxyphenyl)alkanes such as bis(3-fluoro-4-hydroxyphenyl)methane, 1-phenyl-1,1-bis(3-fluoro-4-hydroxyphenyl)ethane, 2,2-bis(3-fluoro-4-hydroxyphenyl)propane, 2,2-bis(3,5-difluoro-4-hydroxyphenyl)propane (also referred to as tetrafluorobisphenol A), and 2,2-bis(3-hydroxyphenyl)-1,1,1,3,3,3-hexafluoropropane; bis(4-hydroxyphenyl)ethers such as bis(3-fluoro-4-hydroxyphenyl); and alkylene oxide (for example, ethylene oxide, propylene oxide, and butylene oxide) adducts of the bisphenols.

Among them, alkylene glycols having 2 to 12 carbon atoms and alkylene oxide adducts of bisphenols are preferred as the diols. Alkylene oxide adducts of bisphenols and mixtures of alkylene oxide adducts of bisphenols with alkylene glycols having 2 to 12 carbon atoms are particularly preferred.

The trihydric or higher polyols are not particularly limited and may be properly selected according to purposes. Examples thereof include trihydric or higher, preferably tri- to octahydric polyaliphatic alcohols, trihydric or higher phenols, and alkylene oxide adducts of trihydric or higher polyphenols. They may be used solely or in a combination of two or more of them.

Examples of polyaliphatic alcohols include glycerin, trimethylolethane, trimethylolpropane, pentaerythritol, and sorbitol.

Examples of trihydric or higher phenols include trisphenol PA, phenol novolak, and cresol novolak.

—Polycarboxylic Acid—

The polycarboxylic acid is not particularly limited and may be properly selected according to purposes. Examples thereof include dicarboxylic acids and tricarboxylic or higher polycarboxylic acids. They may be used solely or in a combination of two or more of them. Among them, dicarboxylic acids that are used solely, or mixtures of dicarboxylic acids with a small amount of tricarboxylic or higher polycarboxylic acids are preferred.

Examples of dicarboxylic acids include alkylene dicarboxylic acids such as succinic acid, adipic acid, and sebacic acid; alkenylene dicarboxylic acids such as maleic acid and fumaric acid; and aromatic dicarboxylic acids such as phthalic acid, isophthalic acid, terephthalic acid, naphthalene dicarboxylic acid, 3-fluoroisophthalic acid, 2-fluoroisophthalic acid, 2-fluoroterephthalic acid, 2,4,5,6-tetratluoroisophthalic acid, 2,3,5,6-tetrafluoroterephthalic acid, 5-trifluoromethylisophthalic acid, 2,2-bis(4-carboxyphenyl)hexafluoropropane, 2,2-bis(3-carboxyphenyl)hexafluoropropane, 2,2'-bis(trifluoromethyl)-4,4'-biphenyldicarboxylic acid, 3,3'-bis(trifluoromethyl)-4,4'-biphenyldicarboxylic acid, 2,2'-bis(trifluoromethyl)-3,3'-biphenyldicarboxylic acid, and hexafluoroisopropylidene diphthalic anhydride.

Among them, alkenylene dicarboxylic acids having 4 to 20 carbon atoms and aromatic dicarboxylic acids having 8 to 20 carbon atoms are preferred as the dicarboxylic acid.

The trihydric or higher polycarboxylic acid is not particularly limited and may be properly selected according to purposes. Examples thereof include aromatic polycarboxylic acids having 9 to 20 carbon atoms such as trimellitic acid and pyromellitic acid.

For example, acid anhydrides or lower alkyl esters such as methyl esters, ethyl esters or isopropyl esters of the above polycarboxylic acids may also be reacted with the polyol.

The ratio of the polyol to the polycarboxylic acid is not particularly limited and may be properly selected according to purposes. The ratio of the polyol to the polycarboxylic acid, however, is preferably 2/1 to 1/2, more preferably 1.5/1 to 1/1.5, particularly preferably 1.3/1 to 1/1.3, in terms of equivalent ratio between the hydroxyl group (OH) and the carboxyl group (COOH) ((OH)/(COOH)).

The noncrystalline resin (R) in the toner may be analyzed by any method without particular limitation, and the method may be properly selected according to purposes. The noncrystalline resin (R) in the toner may be analyzed, for example, by a method using a gas chromatograph-mass spectrometer and a nuclear magnetic resonance apparatus or by a method that includes dissolving other materials in the toner in an organic solvent, removing the materials to separate the noncrystalline resin (R), and then analyzing the noncrystalline resin (R).

The weight average molecular weight of the noncrystalline resin (R) is not particularly limited and may be properly selected according to purposes. The weight average molecular weight, however, is preferably 1,000 to 30,000, more preferably 1,500 to 10,000, particularly preferably 2,000 to 8,000. When the weight average molecular weight of the noncrystalline resin (R) is less than 1,000, the heat-resistant storage stability is sometimes deteriorated. On the other hand, when the weight average molecular weight of the noncrystalline resin (R) is more than 30,000, the low-temperature fixability is sometimes deteriorated.

The weight average molecular weight of the noncrystalline resin (R) may be measured, for example, by gel permeation chromatography (GPC).

The glass transition temperature of the noncrystalline resin (R) is not particularly limited and may be properly selected according to purposes. The glass transition temperature of the noncrystalline resin (R), however, is preferably 40° C. or above, more preferably 50° C. or above, particularly preferably 65° C. or above. When the glass transition temperature is below 40° C., the resultant toner, when placed under a high-temperature, for example, in midsummer (for example, 40° C. or above), is deformed and toner particles are stuck to one another. As a result, in some cases, behavior inherent in toner particles does not occur. The upper limit of the glass transition temperature is not particularly limited and may be properly selected according to purposes. The upper limit of the glass transition temperature is preferably 80° C., more preferably 70° C. The glass transition temperature is above 80° C., the fixability is sometimes deteriorated.

The glass transition temperature may be measured, for example, with a differential scanning calorimetry (DSC) apparatus (for example, TG-DSC system TAS-100, manufactured by Rigaku Corporation).

The acid value of the noncrystalline resin (R) is not particularly limited and may be properly selected according to purposes. The acid value, however, is preferably 2 mgKOH/g to 24 mgKOH/g, more preferably 10 mgKOH/g to 24 mgKOH/g. When the acid value is less than 2 mgKOH/g, the polarity of the noncrystalline resin (R) is so low that homogeneous dispersion of a colorant, having a certain level of polarity in oil droplets is sometimes difficult. When the acid value is more than 24 mgKOH/g, the transfer to the aqueous phase is likely to occur, posing problems such as loss of mass balance in a production process and deteriorated dispersion stability of oil droplets.

The acid value may be measured, for example, by a method according to JIS (Japanese Industrial Standards) K 0070.

The content of the noncrystalline resin (R) is not particularly limited and may be properly selected according to purposes. The content of the noncrystalline resin (R), however, preferably 20% by mass to 80% by mass, more preferably 30% by mass to 70% by mass. When the content of the noncrystalline resin (R) is less than 20% by mass, the heat-resistant storage stability is sometimes deteriorated. On the other hand, when the content of the noncrystalline resin (R) is more than 80% by mass, the low-temperature fixability is sometimes deteriorated.

<<Substance (A)>>

Any substance compatible with the noncrystalline resin (R) may be used as the substance (A) without particular limitation and may be properly selected according to purposes. The substance (A), however, is preferably a crystalline substance from the viewpoint of improving the low-temperature fixability.

The crystalline substance is compatibilized with the noncrystalline resin (R) during fixation of the toner to instantaneously lower the melt viscosity of the whole toner, whereby low-temperature fixation is realized. To this end, the crystalline substance is preferably compatible in a temperature range in which the noncrystalline resin (R) is melted. The crystalline substance may be used solely or in a combination of two or more of them.

Preferably, the crystalline substance has a certain level of polarity. In order that the crystalline substance is polar, preferably, the crystalline substance has a polar functional group or binding site. The crystalline substance may have a plurality of polar functional groups or binding sites. When the substance (A) is a polar crystalline substance, the crystalline substance when melted exhibits high molecular mobility and thus is rapidly compatibilized with the noncrystalline resin (R) and, consequently, the melt viscosity of the whole toner can be rapidly lowered.

The functional group is not particularly limited and may be properly selected according to purposes. Examples of such functional groups include acid groups such as carboxyl, sulfonyl, and phosphonyl groups; bases such as amino and hydroxyl groups; and a mercapto group.

The binding site is not particularly limited and may be properly selected according to purposes. Examples thereof include ester, ether, thioester, thioether, sulfone, amide, imide, urea, urethane, and isocyanurate bonds.

Among them, for example, straight-chain hydrocarbon carboxylic acids or acid amides having 8 to 20 carbon atoms, straight-chain hydrocarbon esters, straight-chain hydrocarbon amides or straight-chain hydrocarbon ester amides having 8 to 20 carbon atoms in total per divalent linking group formed of ester and amide are preferred as the crystalline substance because they can be stably present within the toner, have no significant influence on environmental stability of the toner, and can easily be compatibilized when the noncrystalline resin (R) has been melted.

The substance (A) in the toner may be analyzed by any method without particular limitation, and the method may be properly selected according to purposes. The substance (A) in the toner may be analyzed, for example, by analyzing the substance (A) with a gas chromatograph-mass spectrometer and a nuclear magnetic resonance apparatus or by dissolving other materials in the toner in an organic solvent, removing the materials to separate the substance (A), and then analyzing the substance (A).

The melting point of the substance (A) is not particularly limited and may be properly selected according to purposes. The melting point of the substance (A), however, is preferably low from the viewpoint of realizing the low-temperature fixability, more preferably 100° C. or below, still more preferably below 80° C., particularly preferably below 70° C. When the melting point is above 100° C., the effect on the fixability is sometimes less likely to be attained.

The lower limit of the melting point, of the substance (A) is also not particularly limited and may be properly selected according to purposes. The lower limit of the melting point of the substance (A) is preferably 40° C., more preferably 45° C., particularly preferably 50° C. When the melting point is below 40° C., the heat-resistant storage stability of the toner is sometimes deteriorated.

The combination of the upper limit and the lower limit of the melting point is not particularly limited and may be properly selected according to purposes. The melting point, however, is preferably 40° C. to 100° C., more preferably 45° C. to 80° C., particularly preferably 50° C. to 70° C.

The melting point of the substance (A) may be measured, for example, by a differential scanning calorimetry (DSC) apparatus (for example, TG-DSC system TAS-100, manufactured by Rigaku Corporation).

The weight average molecular weight (Mw) of the substance (A) is not particularly limited and may be properly selected according to purposes. The weight average molecular weight (Mw) of the substance (A), however, is preferably 2,000 to 100,000, more preferably 5,000 to 60,000.

The weight average molecular weight (Mw) of the substance (A) may be measured, for example, by gel permeation chromatography (GPC).

When the noncrystalline resin (R) is a resin having the polyester skeleton, the substance (A) is preferably a crystalline polyester resin. When a noncrystalline polyester resin is used as the noncrystalline resin (R) (binder resin), the use of the crystalline polyester resin as the substance (A) is advantageous in that the noncrystalline resin (R) when melted is likely to be compatibilized with the substance (A) due to the closeness of the structure of the substance (A) to the structure of the noncrystalline resin (R) and, further, before exposure to heat, the storage stability is excellent because of high mechanical strength derived from the polymer nature.

The crystalline polyester resin is not particularly limited and may be properly selected according to purposes. Preferred crystalline polyester resins are those that 60% by mole or more of all the ester bonds in the whole crystalline polyester resin is accounted by a structure represented by general formula (1) that includes a polyol and a polycarboxylic acid as constitutional units.

$$—OCOC—R—COO—(CH)_n— \qquad \text{general formula (1)}$$

wherein R represents a straight-chain unsaturated aliphatic group having 2 to 20 carbon atoms, preferably 2 to 4 carbon atoms; and n is an integer of 2 to 20, preferably 2 to 6.

Specific examples of straight-chain unsaturated aliphatic groups include straight-chain unsaturated aliphatic groups derived from straight-chain unsaturated dicarboxylic acids such as maleic acid, fumaric acid, 1,3-n-propendicarboxylic acid, and 1,4-n-butendicarboxylic acid.

In general formula (1), $(CH_2)_n$ represents a straight-chain aliphatic diol residue. Specific examples of straight-chain aliphatic diol residues include those derived from straight-chain aliphatic diols such as ethylene glycol, 1,3-propylene glycol, 1,4-butanediol, and 1,6-hexanediol.

By virtue of the use of a straight-chain unsaturated aliphatic dicarboxylic acid as the polycarboxylic acid in the crystalline polyester resin, the crystal structure can be more easily formed than the formation of the crystal structure when the aromatic dicarboxylic acid is used.

The crystalline polyester resin may be produced by any method without particular limitation, and the method may be properly selected according to purposes. An example of the method is to polycondense (1) a polycarboxylic acid unit of a straight-chain unsaturated aliphatic dicarboxylic acid or a reactive derivative thereof (for example, an acid anhydride or a lower alkyl (number of carbon atoms: 1 to 4) ester acid halide) with (2) a polyol unit of a straight-chain aliphatic diol by a conventional method.

In the production method of the crystalline polyester resin, the polycarboxylic acid may contain the polycarboxylic acid formed of the straight-chain unsaturated aliphatic dicarboxylic acid or the reactive derivative thereof and, if necessary, small amounts of other polycarboxylic acids.

The polycarboxylic acid is not particularly limited and may be properly selected according to purposes. Examples of polycarboxylic acids include (1) branched-chain unsaturated aliphatic dicarboxylic acids and (2) saturated aliphatic polycarboxylic acids such as saturated aliphatic dicarboxylic acids and saturated aliphatic tricarboxylic carboxylic acids, and (3) aromatic polycarboxylic acids such as aromatic dicarboxylic acids and aromatic tricarboxylic carboxylic acids. They may be used solely or in a combination of two or more of them.

The content of the other polycarboxylic acids is not particularly limited and may be properly selected according to purposes. The content of the other polycarboxylic acids, however, is generally preferably 30% by mole or less, more preferably 10% by mole or less, based on the total amount of the polycarboxylic acids. The other polycarboxylic acids are added in such an amount range that the resultant polyester is crystalline.

Specific examples of other polycarboxylic acids include dicarboxylic acids such as malonic acid, succinic acid, glutaric acid, adipic acid, suberic acid, sebacic acid, citraconic acid, phthalic acid, isophthalic acid, and terephthalic acid; and tricarboxylic or higher polycarboxylic acids such as trimellitic anhydride, 1,2,4-benzenetricarboxylic acid, 1,2,5-benzenetricarboxylic acid, 1,2,4-cyclohexanetricarboxylic acid, 1,2,4-naphthalenetricarboxylic acid, 1,2,5-hexanetricarboxylic acid, 1,3-dicarboxyl-2-methylenecarboxypropane, and 1,2,7,8-octanetetracarboxylic acid.

In the production method of the crystalline polyester resin, the polyol may contain the polyol of the straight-chain aliphatic diol and, if necessary, small amounts of other polyols.

The other polyols are not particularly limited and may be properly selected according to purposes. Examples thereof include small amounts of aliphatic branched-chain diols, cyclic diols, and trihydric or higher polyols. They may be used solely or in a combination of two or more of them.

The content of the other polyols is not particularly limited and may be properly selected according to purposes. The content of the other polyols, however, is generally preferably 30% by mole or less, more preferably 10% by mole or less, based on the total amount of the polyols. The other polyols are added in such an amount range that the resultant polyester is crystalline.

Specific examples of other polyols include 1,4-bis(hydroxymethyl)cyclohexane, polyethylene glycol, ethylene oxide adduct of bisphenol A, propylene oxide adduct of bisphenol A, and glycerin.

The content of the substance (A) is not particularly limited and may be properly selected according to purposes. The content of the substance (A) in the toner, however, is preferably 1% by mass to 20% by mass, more preferably 3% by mass to 15% by mass. When the content of the substance (A) is less than 1% by mass, the low-temperature fixability is sometimes deteriorated. On the other hand, when the content of the substance (A) is more than 20% by mass, the heat-resistant storage stability is sometimes deteriorated.

<<Crystalline Resin (C)>>

The toner of the present invention may contain a crystalline resin (C) as a main component of the binder resin from the viewpoint of further improving the low-temperature fixability.

Any resins that are crystalline may be used as the crystalline resin (C) without particular limitation, and the crystalline resin may be properly selected according to purposes. Examples thereof include crystalline polyester resins, modified crystalline resins having at least any one of urethane and urea bonds in a backbone thereof (for example, urethane-modified polyester resin and urea-modified polyester resin), crystalline polyurethane resins, and crystalline polyurea resins. Among them, urethane-modified polyester resins and urea-modified polyester resins are preferred because they exhibit a high hardness while holding crystallinity as the resin.

—Crystalline Polyester Resin—

The crystalline polyester resin is not particularly limited and may be properly selected according to purposes. Examples thereof include crystalline polyester resins as described above as the substance (A). Among them, polycondensates of polyols with polycarboxylic acids are preferred.

The polyol is not particularly limited and may be properly selected according to purposes. However, aliphatic diols are preferred as the polyol.

Examples of aliphatic diols include ethylene glycol, 1,2-propylene glycol, 1,3-propylene glycol, 1,4-butanediol, 1,5-pentanediol, 1,6-hexanediol, 1,7-heptanediol, 1,8-octanediol, neopentyl glycol, 1,4-butenediol, 1,10-decanediol, and 1,9-nonanediol. Among them, 1,4-butanediol, 1,6-hexanediol, and 1,8-octanediol are preferred, and 1,6-hexanediol, ethylene glycol, 1,10-decanediol, and 1,9-nonanediol are more preferred.

The polycarboxylic acid is not particularly limited and may be properly selected according to purposes. However, aromatic dicarboxylic acids such as phthalic acid, isophthalic acid, and terephthalic acid; and aliphatic carboxylic acids having 2 to 12 carbon atoms such as adipic acid and 1,10-dodecane diacid are preferred as the polycarboxylic acid. Aliphatic carboxylic acids are more preferred from the viewpoint of increasing the crystallinity.

—Crystalline Polyurethane Resin—

Examples of polyurethane units include polyurethane resins synthesized from polyols such as diols or trihydric or higher polyols and polyisocyanates such as diisocyanates or trihydric or higher polyisocyanates. Among them, polyurethane resins synthesized from diols and diisocyanates are preferred.

Examples of diols and trihydric or higher polyols include diols and trihydric or higher polyols described above in connection with the polyester resin.

The diisocyanates and the tri- or higher polyisocyanates are not particularly limited and may be properly selected according to purposes. Examples thereof include aromatic diisocyanates, aliphatic diisocyanates, alicyclic diisocyanates, and araliphatic diisocyanates. They may be used solely or in a combination of two or more of them.

The aromatic diisocyanates are not particularly limited and may be properly selected according to purposes. Examples thereof include 1,3- and/or 1,4-phenylene diisocyanate, 2,4- and/or 2,6-tolylene diisocyanate (TDI), crude TDI, 2,4'- and/or 4,4'-diphenylmethane diisocyanate (MDI), crude MDI [phosgenation products of crude diaminophenylmethane (condensates of formaldehyde with aromatic amines (aniline) or mixtures thereof; and mixtures of diaminodiphenylmethane and a small amount (for example, 5% by mass to 20% by mass) of trifunctional or higher polyamines): polyallyl polyisocyanate (PAPI)], 1,5-naphthylene diisocyanate, 4,4',4"-triphenylmethane triisocyanate, and m- and p-isocyanatophenylsulfonyl isocyanate.

The aliphatic diisocyanates are not particularly limited and may be properly selected according to purposes. Examples thereof include ethylene diisocyanate, tetramethylene diisocyanate, hexamethylene diisocyanate (HDI), dodecamethylene diisocyanate, 1,6,11-undecane triisocyanate, 2,2,4-trimethylhexamethylene diisocyanate, lysine diisocyanate, 2,6-diisocyanatomethyl caproate, bis(2-isocyanatoethyl) fumarate, bis(2-isocyanatoethyl) carbonate, and 2-isocyanatoethyl-2,6-diisocyanatohexanoate.

The alicyclic diisocyanates are not particularly limited and may be properly selected according to purposes. Examples thereof include isophorone diisocyanate (IPDI), dicyclohexylmethane-4,4'-diisocyanate (hydrogenated MDI), cyclohexylene diisocyanate, methylcyclohexylene diisocyanate (hydrogenated TDI), bis(2-isocyanatoethyl)-4-cyclohexene-1,2-dicarboxylate, and 2,5- and 2,6-norbornane diisocyanate.

The araliphatic diisocyanates are not particularly limited and may be properly selected according to purposes. Examples thereof include m- and p-xylylene diisocyanate (XDI), and α,α,α',α'-tetramethylxylylene diisocyanate (TMXDI).

The modification products of diisocyanates are not particularly limited and may be properly selected according to purposes. Examples thereof include urethane group-, carbodiimide group-, allophanate group-, urea group-, biuret group-, ureidodione group-, ureidoimine group-, isocyanurate group-, or oxazolidone group-containing modification products. Specific examples thereof include modification products of diisocyanates, for example, modified MVDI such as urethane-modified MDI, carbodiinmide-modified MDI, and trihydrocarbyl phosphate-modified MDI, and urethane-modified TDI such as isocyanate-containing prepolymers; and a mixture of two or more of modification products of diisocyanates (for example, combined use of modified MIDI and urethane-modified TDI).

—Crystalline Polyurea Resin—

The crystalline polyurea resin is not particularly limited and may be properly selected according to purposes. Examples thereof include polyurea resins synthesized from polyamines such as diamines or tri- or higher polyamines and polyisocyanates such as diisocyanates or tri- or higher polyisocyanates. Among them, polyurea resins synthesized from diamines and diisocyanates are preferred.

The diamines are not particularly limited and may be properly selected according to purposes. Examples thereof include aliphatic diamines and aromatic diamines. Among them, aliphatic diamines having 2 to 18 carbon atoms and aromatic diamines having 6 to 20 carbon atoms are preferred. If necessary, tri- or higher polyamines may be used.

The aliphatic diamines having 2 to 18 carbon atoms are not particularly limited and may be properly selected according to purposes. Examples thereof include alkylene diamines having 2 to 6 carbon atoms (ethylene diamine, propylene diamine, trimethylene diamine, tetramethylene diamine, or hexamethylene diamine); polyalkylene diamines having 4 to 18 carbon atoms [diethylenetriamine, iminobispropyl amine, bis(hexamethylene)triamine, triethylenetetramine, tetraethylenepentanine, and pentaethylenehexamine]; alkyl(number of carbon atoms: 1 to 4)-substituted or hydroxyalkyl(number of carbon atoms: 2 to 4)-substituted products of the above compounds (for example, dialkylaminopropyl amine, trimethylhexamethylene diamine, aminoethyl ethanol amine, 2,5-dimethyl-2,5-hexamethylene diamine, and methyliminobispropyl amine); alicyclic or heterocyclic aliphatic diamine {alicyclic diamines having 4 to 15 carbon atoms [for example, 1,3-diaminocyclohexane, isophorone diamine, menthene diamine, 4,4'-methylene dicyclohexane diamine (hydrogenated methylene dianiline)], heterocyclic diamines having 4 to 15 carbon atoms [for example, piperazine, N-aminoethylpiperazine, 1,4-diaminoethylpiperazine, 1,4-bis(2-amino-2-methylpropyl)piperazine, 3,9-bis(3-aminopropyl)-2,4,8,10-tetraoxaspiro[5,5]undecane]}; and aromatic ring-containing aliphatic amines having 8 to 15 carbon atoms (for example, xylylene diamine and tetrachloro-p-xylylene diamine).

The aromatic diamines having 6 to 20 carbon atoms are not particularly limited and may be properly selected according to purposes. Examples thereof include unsubstituted aromatic diamines [for example, 1,2-, 1,3- and 1,4-phenylene diamines, 2,4'- and 4,4'-diphenylmethane diamine, crude diphenylmethane diamine (polyphenylpolymethylene polyamine), diaminodiphenylsulfone, benzidine, thiodianiline, bis(3,4-diaminophenyl)sulfone, 2,6-diaminopyridine, m-aminobenzylamine, triphenylmethane-4,4',4"-triamine, naphthylene diamine]; aromatic diamines having a nuclear substituted alkyl group having 1 to 4 carbon atoms [for example, 2,4- and 2,6-tolylene diamine, crude tolylene diamine, diethyltolylene diamine, 4,4'-diamino-3,3'-dimethyldiphenylrnethane, 4,4'-bis(o-toluidine), dianisidine, diaminoditolylsulfone, 1,3-dimethyl-2,4-diaminobenzene, 1,3-dimethyl-2,6-diaminobenzene, 1,4-diisopropyl-2,5-diaminobenzene, 2,4-diaminomesitylene, 1-methyl-3,5-diethyl-2,4-diaminobenzene, 2,3-dimethyl-1,4-diaminonaphthalene, 2,6-dimethyl-1,5-diaminonaphthalene, 3,3',5,5-tetramethylbenzidine, 3,3',5,5'-tetramethyl-4,4'-diaminodiphenylmethane, 3,5-diethyl-3'-methyl-2',4-diaminodiphenylmethane, 3,3'-diethyl-2,2'-diaminodiphenylmethane, 4,4'-diamino-3,3'-dimethyldiphenylmethane, 3,3',5,5'-tetra ethyl-4,4'-diaminobenzophenone, 3,3',5,5'-tetraethyl-4,4'-diaminodiphenyl ether, 3,3',5,5'-tetraisopropyl-4,4'-diaminodiphenylsulfone, and mixtures of these isomers at various mixing ratios; aromatic diamines having nuclear substituted electron-withdrawing groups (for example, halogens such as Cl, Br, I, and F; alkoxy groups such as methoxy and ethoxy; and a nitro group) [for example, methylenebis-o-chloroaniline, 4-chloro-o-phenylene diamine, 2-chloro-1,4-phenylene diamine, 3-amino-4-chloroaniline, 4-bromo-1,3-phenylene diamine, 2,5-dichloro-1,4-phenylene diamine, 5-nitro-1,3-phenylene diamine, 3-dimethoxy-4-aminoaniline; 4,4'-diamino-3,3'-dimethyl-5,5'-dibromo-diphenylmethane, 3,3'-dichlorobenzidine, 3,3'-dimethoxybenzidine, bis(4-amino-3-chlorophenyl)oxide, bis(4-amino-2-chlorophenyl)propane, bis(4-amino-2-chlorophenyl)sulfone, bis(4-amino-3-methoxyphenyl) decane, bis(4-aminophenyl)sulfide, bis(4-aminophenyl) telluride, bis(4-aminophenyl)selenide, bis(4-amino-3-methoxyphenyl)disulfide, 4,4'-methylenebis(2-iodoaniline), 4,4'-methylenebis(2-bromoaniline), 4,4'-methylenebis(2-fluoroaniline), and 4-aminophenyl-2-chloroaniline]; and aromatic diamines having a secondary amino group [for example, the unsubstituted aromatic diamines, the nuclear substituted alkyl group (number of carbon atoms: 1 to 4 carbon atoms)-containing aromatic diamines, and mixers of these isomers at various ratios, and compounds in which part or the whole of primary amino groups in the aromatic diamines having a nuclear substituted electron-withdrawing group has been converted to a secondary amino group by a lower alkyl group such as methyl or ethyl {for example, 4,4'-di(methylamino)diphenylmethane, and 1-methyl-2-methylamino-4-aminobenzene}].

Examples of tri- or higher amines include polyamide polyamines [for example, low-molecular weight polyamide polyamines obtained by condensing dicarboxylic acids (for example, dimer acids) with an excessive amount (2 moles or more per mole of the acid) of polyamines (for example, the alkylene diamines and polyalkylene polyamines); and polyether polyamines [for example, hydrides of cyanoethylation products of polyether polyols (for example, polyalkylene glycol)].

—Modified Crystalline Resin—

The crystalline binder resin (C) may contain a modified crystalline resin having any one of or both a urethane bond and a urea bond in a backbone thereof (hereinafter sometimes referred to as "modified crystalline resin") for viscoelasticity regulation purposes. The modified crystalline resin may be mixed directly into the binder resin. From the viewpoint of producibility, the modified crystalline resin is preferably a modified crystalline resin having any one of or both a urethane bond and a urea bond that is produced by mixing a relatively low-molecular weight modified crystalline resin having an isocyanate group at the end (hereinafter sometimes referred to as prepolymer) and amines reactive with the relatively low-molecular weight modified crystalline resin into the binder resin, granulating the mixture, and subjecting the mixture to one of or both chain extension and a crosslinking reaction during or after the granulation. According to this production method, the relatively high-molecular weight modified crystalline resin can easily be incorporated for viscoelasticity regulation purposes.

—Prepolymer—

Examples of isocyanate group-containing prepolymers include those produced by further reacting the polyester that is the polycondensate of the polyol (1) with the polycarboxylic acid (2) and has an active hydrogen group, with a polyisocyanate (3). Examples of active hydrogen groups contained in the polyesters include hydroxyl (alcoholic hydroxyl and phenolic hydroxyl), amino, carboxyl, and mercapto groups. Among them, alcoholic hydroxyl groups are preferred.

—Polyisocyanate—

Examples of the polyisocyanate (3) include aliphatic polyisocyanates (for example, tetramethylene diisocyanate, hexamethylene diisocyanate, 2,6-diisocyanatomethyl caproate); alicyclic polyisocyanates (for example, isophorone diisocyanate, cyclohexylmethane diisocyanate); aromatic diisocyanates (for example, tolylene diisocyanate and diphenylmethane diisocyanate); araliphatic diisocyanates (for example, $\alpha,\alpha,\alpha',\alpha'$-tetramethylxylylene diisocyanate); isocyanurates; compounds obtained by blocking the polyisocyanates with phenol derivatives, oximes, caprolactams or the like; and combined use of two or more of them.

[Ratio Between Isocyanate Group and Hydroxyl Group]

The ratio of the polyisocyanate (3) is generally 5/1 to 1/1, preferably 4/1 to 1.2/1, still preferably 2.5/1 to 1.5/1, in terms of equivalent ratio between the isocyanate group [NCO] and the hydroxyl group [OH] in the hydroxyl group-containing polyester, i.e., [NCO]/[OH].

When [NCO]/[OH] is more than 5, the low-temperature fixability is deteriorated. When the molar ratio of [NCO] is less than 1, the content of the urea in the modified polyester is lowered and, consequently, the offset resistance is deteriorated. The content of the polyisocyanate (3) as a constituent in the prepolymer (A) having an isocyanate group at the end is generally 0.5% by mass to 40% by mass, preferably 1% by mass to 30% by mass, still preferably 2% by mass to 20% by mass. When the content of the polyisocyanate (3) is less than 0.5% by mass, the offset resistance is deteriorated. On the other hand, when the content of the polyisocyanate (3) is more than 40% by mass, the low-temperature fixability is deteriorated.

[Number of Isocyanate Groups in Prepolymer]

The number of isocyanate groups contained per molecule of the isocyanate group-containing prepolymer (A) is generally one or more, preferably 1.5 to 3 on average, still preferably 1.8 to 2.5 on average. When the number of isocyanate groups is less than 1 per molecule, the molecular weight of the modified polyester after any one of or both the chain extension and crosslinking is lowered and, consequently, the offset resistance is deteriorated.

—Chain Extension and/or Crosslinking Agent—

In the present invention, amine compounds may be used as the chain extension agent and/or the crosslinking agent.

Examples of the amine compound (B) include a diamine (B1), a tri- or higher polyamine (B2), an aminoalcohol (B3), an aminomercaptan (B4), an amino acid (B5), and a blocked product (B6) obtained by blocking the amino group in any one of B1 to B5. They may be used solely or in a combination of two or more of them.

The diamine (B1) is not particularly limited and may be properly selected according to purposes. Examples thereof include aromatic diamines such as phenylene diamine, diethyltoluene diamine, 4,4'-diaminodiphenylmethane, tetrafluoro-p-xylylene diamine, and tetrafluoro-p-phenylene diamine; alicyclic diamines such as 4,4'-diamino-3,3'-dimethyldicyclohexylmethane, diaminecyclohexane, and isophorone diamine; and aliphatic diamines such as ethylene diamine, tetramethylene diamine, hexamethylene diamine, dodecafluorohexylene diamine, and tetracosafluorododecylene diamine.

The tri- or higher polyamine (B2) is not particularly limited and may be properly selected according to purposes. Examples thereof include diethylenetriamine and triethylenetetramine.

The aminoalcohol (B3) is not particularly limited and may be properly selected according to purposes. Examples thereof include ethanolamine and hydroxyethylaniline.

The aminomercaptan (B4) is not particularly limited and may be properly selected according to purposes. Examples thereof include aminoethylmercaptan and aminopropylmercaptan.

The amino acid (B5) is not particularly limited and may be properly selected according to purposes. Examples thereof include aminopropionic acid and aminocaproic acid.

The blocked product (B6) obtained by blocking the amino group in the (B1) to (B5) is not particularly limited and may be properly selected according to purposes. Examples thereof include ketimine compounds obtained from the amines of (B1) to (B5) and ketones (for example, acetone, methyl ethyl ketone, and methyl isobutyl ketone); and oxazoline compounds.

Among these amine compounds (B), the diamine (B1) and a mixture of the diamine (B1) with a small amount of the tri- or higher polyamine (B2) are preferred.

[Ratio Between Amino Group and Isocyanate Group]

The ratio of the amine compound (B) is not particularly limited and may be properly selected according to purposes. The number of amino groups [NHx] in the amine compound (B) is preferably four times or less, more preferably twice or less, still more preferably 1.5 times or less, particularly preferably 1.2 times or less, relative to the number of isocyanate groups [NCO] in the modified resin having an isocyanate group at the end. When the ratio of the amine compound (B) ([NHx]/[NCO]), is more than four times, excess amino group disadvantageously blocks the isocyanate and the extension reaction of the modified resin does not occur. As a result, the molecular weight of the polyester is lowered, and the hot-offset resistance is sometimes deteriorated.

—Terminator—

Further, if necessary, the molecular weight of the modified polyester after the termination of the chain extension reaction and/or the crosslinking reaction with a terminator may be regulated. Examples of terminators include monoamines (for example, diethylamine, dibutylamine, butylamine, and laurylamine), and blocked products thereof (ketimine compounds).

The crystalline resin refers to a resin that, as measured by DSC, exhibits a maximum endotherm at the melting point. On the other hand, the noncrystalline resin refers to a resin that a gentle curve based on glass transition is observed.

The melting point Tm of the crystalline resin (C) is not particularly limited and may be properly selected according to purposes. The melting point, Tm of the crystalline resin (C) is preferably 50° C. to 70° C., more preferably 55° C. to 65° C. When the melting point is 50° C. or above, a disadvantageous phenomenon can be avoided that the resultant toner, when placed under a high-temperature, for example, in midsummer, is deformed and toner particles are stuck to one another making it impossible for toner particles to take inherent behavior. On the other hand, when the melting point is 70° C. or below, the fixability is improved.

Preferably, the crystalline resin (C) contains a crystalline resin having a weight average molecular weight of 10,000 to 40,000. When the crystalline resin (C) contains a crystalline resin having a weight average molecular weight of 10,000 or more, the heat-resistant storage property is improved. On the other hand, when the weight average molecular weight is 40,000 or less, the low-temperature fixability is improved.

The content of the crystalline resin (C) is 50% by mass or more, preferably 60% by mass or more, more preferably 65% by mass or more. When the content of the crystalline resin (C) is 50% by mass or more, the toner can simultaneously realize good low-temperature fixability and heat-resistant storage property.

Preferably, the toner contains as the crystalline resin (C) a first crystalline resin and a second crystalline resin that has a larger weight average molecular weight Mw than the first crystalline resin.

The incorporation of the first crystalline resin and, further, the second crystalline resin having a larger weight average molecular weight Mw than the first crystalline resin can simultaneously realize low-temperature fixation brought about by the first crystalline resin and the prevention of hot-offset property brought about by the second crystalline resin.

The first crystalline resin may be a crystalline polyester resin, or alternatively may be a modified crystalline resin having any one of or both a urethane bond and a urea bond in a backbone thereof.

When the first crystalline resin is a crystalline polyester resin, as with the first crystalline resin, any crystalline resin may be used as the second crystalline resin without particular limitation, and the second crystalline resin may be properly selected according to purposes. The second crystalline resin is preferably a modified crystalline resin having any one of or both a urethane bond and a urea bond in a backbone thereof. The modified crystalline resin having any one of or both a urethane bond and a urea bond in a backbone thereof is preferably a modified crystalline resin obtained by extending a modified crystalline resin having an isocyanate group at the end.

The weight average molecular weight (Mw1) of the first crystalline resin is not particularly limited and may be properly selected according to purposes. The weight average molecular weight (Mw1) of the first crystalline resin, however, is preferably 10,000 to 40,000, more preferably 15,000 to 35,000, particularly preferably 20,000 to 30,000, from the viewpoint, of simultaneously realizing the low-temperature fixability and the heat-resistant storage property. When Mw1 is less than 10,000, the heat-resistant storage property of the toner is likely to be deteriorated. On the other hand, when Mw1 is more than 40,000, the low-temperature fixability of the toner is disadvantageously likely to be deteriorated.

The weight average molecular weight (Mw2) of the second crystalline resin is not particularly limited and may be properly selected according to purposes. Mw2, however, is preferably 40,000 to 300,000, particularly preferably 50,000 to 150,000, from the viewpoint of the low-temperature fixability and the hot-offset resistance. When Mw2 is smaller than 40,000, the hot-offset resistance of the toner is likely to be deteriorated. On the other hand, a Mw2 of larger than 300,000 is unfavorable for the reason that the toner is not satisfactorily melted in the fixation particularly at low temperatures and an image is likely to be separated, disadvantageously leading to a tendency toward deteriorated low-temperature fixability of the toner.

The difference between the weight average molecular weight (Mw1) of the first crystalline resin and the weight average molecular weight (Mw2) of the second crystalline resin (Mw2−Mw1) is not particularly limited and may be properly selected according to purposes. The difference, however, is 5,000 or more, more preferably 10,000 or more. When the difference is less than 5,000, the fixation width of the toner is disadvantageously likely to be narrowed.

The mass ratio between the first crystalline resin (1) and the second crystalline resin (2) [(1)/(2)] is not particularly limited and may be properly selected according to purposes. The mass ratio, however, is preferably 95/5 to 70/30. When the mass ratio is more than 95/5, the hot-offset resistance of the toner is disadvantageously likely to be deteriorated. On the other hand, when the mass ratio is less than 70/30, the low-temperature fixability of the toner is disadvantageously likely to be deteriorated.

<Colorant>

The colorant is not particularly limited and may be properly selected from publicly known dyes and pigments according to purposes. Examples thereof include carbon black, nigrosine dyes, black iron oxide, Naphthol Yellow S, Hansa Yellow (10G, 5G, and G), Cadmium Yellow, yellow iron oxide, loess, chrome yellow, Titan Yellow, polyazo yellow, Oil Yellow, Hansa Yellow (GR, A, RN, and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, and lithopone. They may be used solely or in a combination of two or more of them.

—Master Batch—

The above colorants may also be used as a master batch obtained by compositing the colorants with resins (binder resin).

In the master batch, the resins for the master batch that is to be kneaded with the colorants are not particularly limited and may be properly selected according to purposes. Examples thereof include styrene polymers and substituted styrene polymers such as polystyrene, poly-p-chlorostyrene, and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; and other resins such as polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, polyacrylic resins, rosin, modified rosins, terpene resins, aliphatic or alicyclic hydrocarbon resins, aromatic petroleum resins, chlorinated paraffin, and paraffin waxes. Further, the same resins as the noncrystalline resin (R) and modified resins which will be described later may also be used. They may be used solely or in a combination of two or more of them.

The master batch may be produced by any method without particular limitation, and the method may be properly selected according to purposes. The master batch may be produced, for example, by mixing and/or kneading a resin for the master batch and a colorant under a high shear force. In this case, an organic solvent may be used to enhance the interaction between the colorant and the resin for the master batch.

The so-called flushing method in which an water-containing aqueous paste containing a colorant is mixed and/or kneaded with the resin for the master batch and the organic solvent to transfer the colorant to the resin for the master batch, and water and the organic solvent are removed is also preferred, because the wet cake of the colorant as such can be used and, thus, the necessity of drying can be eliminated.

The mixing and/or the kneading may be carried out by any method without particular limitation, and the method may be properly selected according to purposes. However, the methods using high-shear dispergators such as three-roll mills are preferred.

The content of the colorant is not particularly limited and may be properly selected according to purposes. The content of the colorant in the toner, however, is preferably 1% by mass to 30% by mass, more preferably 3% by mass to 20% by mass. When the content of the colorant is less than 1% by mass, in some cases, the density of printed characters or images is lowered, resulting in lowered image quality. On the other hand, when the content of the colorant is more than 30% by mass, the content of the resin component is relatively lowered and, consequently the toner is less likely to be fixed on paper.

<Other Components>

Any other components may be used in the toner without particular limitation and the other component may be properly selected according to purposes, as long as the effect of the present invention is not sacrificed. Examples thereof include charge control agents, dispersion stabilizers, magnetic materials, flowability improvers, and cleanability improvers. Modified resins and amine compounds which will be described later may also be contained.

The content of the other components is not particularly limited and may be properly selected according to purposes, as long as the effect of the present invention is not sacrificed.

—Charge Control Agent—

The charge control agent is not particularly limited, and all of publicly known charge control agents may be used. Examples thereof include nigrosin-based dyes, triphenylmethane-based dyes, chrome-containing metal complex dyes, molybdenum acid chelate pigments, rhodamine dyes, alkoxy-based amines, quaternary ammonium salts (including fluorine-modified quaternary ammonium salts), alkylamides, phosphorus as a simple substance or compounds of phosphorus, tungsten as a simple substance or compounds of tungsten, fluorine-based active agents, metal salicylates, and metal salts of salicylic acid derivatives.

Specific examples of charge control agents include BONTRON 03 (nigrosine dye), BONTRON P-51 (quaternary ammonium salt), BONTRON S-34 (metal-containing azo dye), E-82 (oxynaphthoic acid metal complex), E-84 (salicylic acid metal complex), and E-89 (phenolic condensates), which are manufactured by Orient Chemical Industries, Ltd.; TP-302 and TP415 (quaternary ammonium salt molybdenum complex), which are manufactured by Hodogaya Chemical Co., LTD.; COPY CHARGE PSY VP2038 (quaternary ammonium salt), COPY BLUE PR (triphenylmethane derivative), COPY CHARGE NEG VP2036 and NX VP434 (quaternary ammonium salt), which are manufactured by Hoechst AG; LRA-901 and LR-147 (boron complex), which are manufactured by Japan Carlit Co., Ltd.; copper phthalocyanine, perylene, quinacridone, and azo pigments; and polymeric compounds having a functional group such as a sulfonate group, a carboxyl group, or a quaternary ammonium salt group. They may be used solely or in a combination of two or more of them.

The content of the charge control agent is not particularly limited and may be properly selected according to purposes, as long as the effect of the present invention is not sacrificed and the fixability and the like are not adversely affected. The content of the charge control agent in the toner is preferably 0.5% by mass to 5% by mass, more preferably 0.8% by mass to 3% by mass.

—Dispersion Stabilizer—

The dispersion stabilizer is not particularly limited and may be properly selected according to purposes. Examples thereof include inorganic dispersants and protective colloids.

The inorganic dispersant is not particularly limited and may be properly selected according to purposes. Examples thereof include tricalcium phosphate, calcium carbonate, titanium oxide, colloidal silica, and hydroxyapatite.

The protective colloid is not particularly limited and may be properly selected according to purposes. Examples thereof include acids such as acrylic acid, methacrylic acid, α-cyanoacrylic acid, α-cyanomethacrylic acid, itaconic acid, crotonic acid, fumaric acid, maleic acid, and maleic anhydride; (meth)acrylic monomers containing a hydroxyl group such as β-hydroxyethyl acrylate, β-hydroxyethyl methacrylate, p-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylic esters, diethylene glycol monomethacrylic esters, glycerin monoacrylic esters, glycerin monomethacrylic esters, N-methylol acrylamide, and N-methylol methacrylamide; vinyl alcohols and ethers with vinyl alcohols such as vinyl methyl ether, vinyl ethyl ether, and vinyl propyl ether; vinyl carboxylates such as vinyl acetate, vinyl propionate, and vinyl butyrate; acrylic amides such as acrylamide, methacrylamide, and diacetoneacrylamide; esters of the vinyl alcohols with carboxyl group-containing compounds or their mthylol compounds; acid chlorides such as acrylic acid chloride and methacrylic acid chloride; homopolymers or copolymers of monomers having a nitrogen atom or a heterocyclic ring such as vinyl pyridine, vinyl pyrrolidone, vinyl imidazole, and ethylene imine; polyoxyethylene compounds such as polyoxyethylene, polyoxypropylene, polyoxyethylene alkyl amines, polyoxypropylene alkyl amines, polyoxyethylene alkyl amides, polyoxypropylene alkyl amides, polyoxyethylene nonylphenyl ethers, polyoxyethylene laurylphenyl ethers, polyoxyethylene stearylphenyl esters, and polyoxyethylene nonylphenyl esters; and celluloses such as methyl cellulose, hydroxyethyl cellulose and hydroxypropyl cellulose. They may be used solely or in a combination of two or more of them.

—Magnetic Material—

The magnetic material is not particularly limited and may be properly selected according to purposes. Examples thereof include iron oxides including magnetic iron oxides such as magnetites, maghemites, and ferrites, or other metal oxides; metals such as iron, cobalt, and nickel, and alloys of these metals with other metals such as aluminum, cobalt, copper, lead, magnesium, tin, zinc, antimony, beryllium, bismuth, cadmium, calcium, manganese, selenium, titanium, tungsten, and vanadium; or their mixtures.

Examples of magnetic materials include $Fe_3O_4$, $\gamma$-$Fe_2O_3$, $ZnFe_2O_4$, $Y_3Fe_5O_{12}$, $CdFe_2O_4$, $Gd_3Fe_5O_{12}$, $CuFe_2O_4$, $PbFe_{12}O$, $NiFe_2O_4$, $NdFe_2O_4$, $BaFe_{12}O_{19}$, $MgFe_2O_4$, $MnFe_2O_4$, $LaFeO_3$, iron powder, cobalt powder, and nickel powder. They may be used solely or in a combination of two or more of them. Among them, fine powders of triiron tetraoxide and γ-iron sesquioxide are particularly preferred.

—Flowability Improver—

Any flowability improver that can surface treat the toner to enhance hydrophobicity of the toner and can have the function of preventing a deterioration in flow properties and electrification characteristics even under high humidity may be used without particularly limitation, and the flowability improver may be properly selected according to purposes. Examples thereof include silane coupling agents, silylation agents, silane coupling agents having an alkyl fluoride group, organic titanate-based coupling agents, aluminum-based coupling agents, silicone oils, and modified silicone oils. They may be used solely or in a combination of two or more of them.

Preferably, silica and titanium oxide in the inorganic fine particles are surface-treated with the flowability improver and are used as hydrophobic silica and hydrophobic titanium oxide, respectively —Cleanability Improver—

The cleanability improver is not particularly limited and may be properly selected according to purposes. Examples thereof include fatty acid metal salts such as zinc stearate, calcium stearate and stearic acid; and fine particles of polymers produced by soap-free emulsion polymerization such as fine particles of polymethyl methacrylates and polystyrene. They may be used solely or in a combination of two or more of them.

Preferably, the fine particles of the polymers have a relatively narrow particle size distribution. Preferably, the fine particles of the polymers have a volume average particle diameter of 0.01 μm to 1 μm.

The volume average particle diameter (Dv) of the toner is not particularly limited and may be properly selected according to purposes. The volume average particle diameter (Dv), however, is preferably 2 μm to 8 μm, more preferably 4 μm to 6.5 μm. The number average particle diameter (Dn) of the toner is not particularly limited and may be properly selected according to purposes. The number average particle diameter (Dn), however, is preferably 1.6 μm to 8 μm, more preferably 3.2 μm to 5.2 μm. The ratio between the volume average particle diameter (Dv) and the number average particle diameter (Dn) (Dv/Dn) is not particularly limited and may be properly selected according to purposes. The Dv/Dn, however, is preferably 1.25 or less, more preferably 1.00 to 1.15. When the Dv/Dn is in the above-defined more preferred range, the toner excels in all of low-temperature fixability, hot-offset resistance, and heat-resistant storage stability properties and, when especially used in full-color copying machines, can advantageously yield images having excellent gloss. Further, in two-component developer, even when a toner balance is carried out for a long period of time, a variation in the particle diameter of the toner in the developer is reduced and good and stable development can be advantageously obtained even in long-term agitation in a developing apparatus.

In the toner of the present invention, the average circularity measured with a flow-type particle image analyzer is preferably 0.97 or more. When the average circularity measured with a flow-type particle image analyzer is 0.97 or more, good images free from transfer droplets in line images can be obtained. The average circularity is more preferably 0.98 or more, because the toner surface is satisfactorily smooth and, thus, the number of points of contact with an image support is reduced and toner dropout defects are reduced in transfer from an electrostatic charge holding body to a transfer material.

In the present invention, the average circularity may be measured with a flow-type particle image analyzer (FPIA-2100, manufactured by Sysmex Corp.). The apparatus and measurement for the analysis are briefly described in JP-A No. 08-136439. The measurement is carried out as follows. A 1% (by mass) aqueous sodium chloride solution is prepared using extra pure sodium chloride. The solution is passed through a 0.45-μm filter. A surfactant, preferably an alkylbenzenesulfonic acid salt, (0.1 mL to 5 mL) is added as a dispersant to 50 mL to 100 mL of the filtrate, and 1 mg to 10 mg of a sample is added thereto. The mixture is subjected to dispersion treatment with an ultrasonic dispergator for one min to prepare a dispersion that has been regulated to a concentration of 5,000 particles/μL to 15,000 particles/μL. The average circularity is measured using this dispersion.

In the measurement of the particle concentration, calculation is carried out on the assumption that the diameter of a circle having the same area as the area of a two-dimensional image photographed by a CCD camera is defined as an equivalent circle diameter. When the pixel accuracy of CCD is taken into consideration, particles having an equivalent circle diameter of 0.6 μm or above are regarded as effective particles and the number of particles is obtained. The average circularity X is obtained by the following equation.

$$\text{Average circularity } X=\Sigma(L0/L)/n$$

wherein "L0" represents the perimeter of a circle having the same project area as the particle image; "L" represents the perimeter of the project image of the particle; and "n" is the total number of particles.

The average circularity in the toner according to the present invention is a measure of the degree of irregularities of the toner shape. When the toner is completely spherical, the average circularity is 1.0. The larger the complexity of the surface shape, the smaller the average circularity.

The volume average particle diameter (Dv) and the number average particle diameter (Dn) of the toner may be measured by a Coulter counter method with COULTER COUNTER TA-II, COULETR MIULTISIZER II, or COULETR MULTISIZER III (all of these products being manufactured by Beckman Coulter, Inc.).

Specifically, 0.1 mL to 5 mL of a surfactant (preferably an alkylbenzenesulfonic acid salt) is added as a dispersant to 100 mL to 150 mL of an electrolysis solution. Here the electrolysis solution is obtained by preparing about 1% by mass aqueous sodium chloride solution from extra pure sodium chloride and is available, for example, as ISOTON-II (manufactured by Beckman Coulter, Inc.). Here, 2 mg to 20 mg of the measurement sample is further added. The electrolysis solution with the measurement sample suspended therein is subjected to dispersion treatment with an ultrasonic disperser for about 1 min to about 3 min. The volume and number of toner particles or toner are measured with the particle size distribution measuring apparatus using an aperture of 100 μm, and the volume distribution and the number distribution are calculated. The volume average particle diameter and the number average particle diameter of the toner can be determined from the volume distribution and the number distribution.

The following 13 channels are used: 2.00 μm to less than 2.52 μm; 2.52 μm to less than 3.17 μm; 3.17 μm to less than 4.00 μm; 4.00 μm to less than 5.04 μm; 5.04 μm to less than 6.35 μm; 6.35 μm to less than 8.00 μm; 8.00 μm to less than 10.08 μm; 10.08 μm to less than 12.70 μm; 12.70 μm to less than 16.00 μm; 16.00 μm to less than 20.20 μm; 20.20 μm to less than 25.40 μm; 25.40 μm to less than 32.00 μm; and 32.00 μm to less than 40.30 μm. That is, particles having particle diameters of 2.00 μm to less than 40.30 μm are used.

Figure 1B:
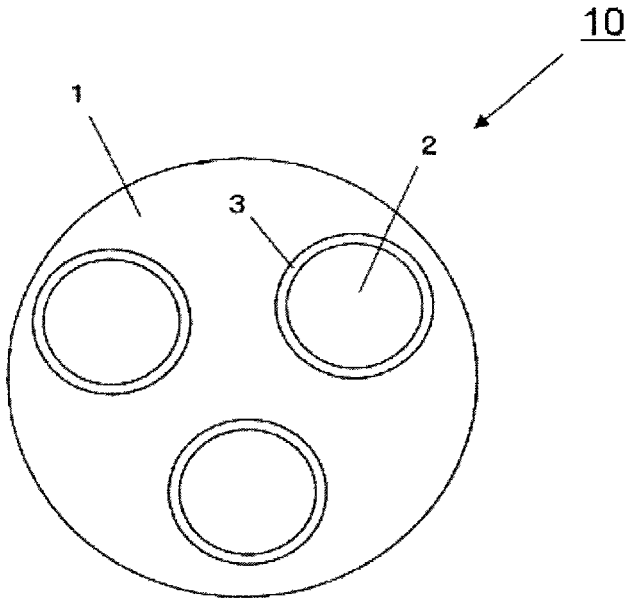
FIG. 1B is a view showing the results of STEM observation that is one example of the structure of a toner according to the present invention.

The toner according to the present invention will be described in more detail with reference to the accompanying drawings. FIG. 1A is a schematic explanatory view showing one example of the structure of a toner according to the present invention, FIG. 1B is a view showing the results of STEM observation that is one example of the structure of a toner according to the present invention (Example 15), and FIG. 1C is a schematic explanatory view showing one example of the structure of a conventional toner.

As shown in FIG. 1A, a toner 10 according to the present invention includes particles formed of a release agent (RA) 2 encapsulated in a particle formed of a binder resin 1. The release agent (RA) 2 exists within a capsule 3, and the capsule 3 includes a resin (I) different from the binder resin 1.

The toner according to the present invention having this structure can prevent the release agent (RA) 2 from being exposed on the surface of the toner 10 in a normal state (23° C., atmospheric pressure 0.1 MPa, relative humidity 50%).

Figure 1C:
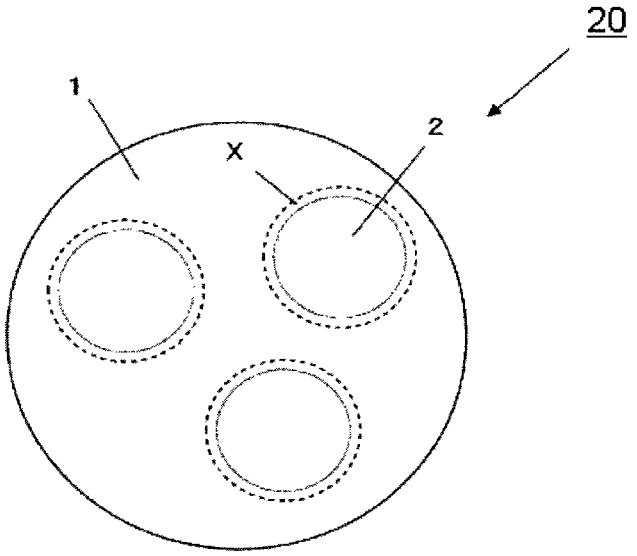
FIG. 1C is a schematic explanatory view showing one example of the structure of a conventional toner.

On the other hand, as shown in FIG. 1C, a conventional toner 20 including a release agent therein has a structure that a release agent (RA) 2 is included in a particle formed of a binder resin 1 so that the release agent (RA) is in contact with the binder resin 1. This structure poses a problem that, when the toner 20 undergoes a stress and consequently is deformed or deteriorated, some of particles formed of the release agent (RA) 2 are exposed on the surface of the toner 20, leading to a deterioration in heat-resistant storage stability of the toner 20.

<Use>

The toner according to the present invention can simultaneously realize all of excellent low-temperature fixability, hot-offset resistance, and heat-resistant storage stability and thus is suitable for use, for example, in electrophotographic toners, developers, full-color image formation methods, and image-forming apparatuses, and process cartridges.

(Process for Producing Toner)

The process for producing a toner according to the present invention includes at least an encapsulation step and a dispersion step. Preferably, the process further includes a washing step and a drying step and, if necessary, further includes other steps.

<Encapsulation Step>

The encapsulation step is a step of encapsulating the release agent (RA) in a capsule formed of a resin (I) that is different from the binder resin. The release agent (RA), the binder resin, the noncrystalline resin (R), and the resin (I) are the same as those contained in the toner according to the present invention, and, thus, detailed description thereof will be omitted.

The release agent (RA) may be encapsulated in the capsule formed of the resin (I) by any method without particular limitation, and the method may be properly selected according to purposes. Examples of such methods include:

(1) a method that includes previously preparing fine particles of the release agent (RA) and coating with the resin (I) on the circumference of the fine particles of the release agent (RA) (that is, encapsulating the fine particles of the release agent (RA) in capsules formed of the resin (I));

(2) a method that includes preparing fine particles of the release agent (RA) and the resin (I) dissolved in a solvent and removing the solvent to encapsulate the release agent (RA) in capsules formed of the resin (I) while phase-separating the release agent (RA) and the resin (I);

(3) a method that includes preparing fine particles of a dispersion obtained by dispersing fine particles of the release agent (RA) in a solution containing the resin (I) and removing the solvent to encapsulate the release agent (RA) in capsules formed of the resin (I); and (4) a method that includes dissolving the release agent (RA) in a solution containing a monomer as a starting material for the resin (I) (hereinafter sometimes referred to as "monomer solution") or dispersing the release agent (RA) as fine particles in a solution containing a monomer as a starting material for the resin (I) to obtain fine particles and then allowing the monomer as the starting material for the resin (I) to be polymerized to prepare the resin (I) and thus to form capsules that include the resin (I) and encapsulate the release agent (RA) therein.

Among these methods, the method (4) is preferred in that the release agent (RA) can be evenly encapsulated in capsules including the resin (I) and, thus, even capsule particles can easily be obtained.

In the method (4), how to prepare fine particles obtained by dispersing the release agent (RA) as fine particles in the monomer solution is not particularly limited and may be properly selected according to purposes. However, a method that includes preparing the monomer solution in an aqueous medium and dispersing the release agent (RA) in the aqueous medium is preferred in that the monomer as the starting material for the resin (I) can easily be polymerized. The monomer as the starting material for the resin (I) may be polymerized by any method without particular limitation, and the method may be properly selected according to purposes. Examples thereof include suspension polymerization and miniemulsion polymerization.

<Dispersion Step>

The dispersion step is a step of dispersing the releasing agent-encapsulating capsules in the binder resin. The dispersion step can allow the release agent (RA) encapsulated in the capsules to be introduced into the toner.

Examples of carrying out the dispersion step include the following methods (1) to (3):

(1) a method that includes preparing an oil phase with the releasing agent-encapsulating capsules dissolved or dispersed therein, dispersing the oil phase in an aqueous phase to prepare an oil droplet dispersion containing oil droplets including the releasing agent-encapsulating capsules;

(2) a method that includes preparing an aqueous phase with the releasing agent-encapsulating capsules dispersed therein and dispersing an oil phase in the aqueous phase to prepare oil droplets while incorporating the releasing agent-encapsulating capsules into the oil droplets; and (3) a method that includes dispersing an oil phase in an aqueous phase to prepare an oil droplet dispersion containing oil droplets and adding the releasing agent-encapsulating capsules in the oil droplet dispersion to incorporate the releasing agent-encapsulating capsules into the oil droplets.

Among them, the method (1) is preferred in that the releasing agent-encapsulating capsules are reliably incorporated into the oil droplets. Accordingly, preferably, the dispersion step includes an oil phase preparation treatment, an aqueous phase preparation treatment, and an oil droplet dispersion preparation treatment. More preferably, after the oil droplet dispersion preparation treatment, the dispersion step includes a solvent removing treatment to remove the solvent in the oil phase.

—Oil Phase Preparation Treatment—

The oil phase preparation treatment is a treatment that at least the releasing agent-encapsulating capsules and the colorant are dissolved or dispersed in an organic solvent to prepare an oil phase. The oil phase may if necessary further contain a modified resin, an amine compound, and the charge control agent.

The oil phase preparation treatment is not particularly limited and may be properly selected according to purposes. An example thereof is to gradually add the releasing agent-encapsulating capsules, the colorant and the like to an organic solvent with stirring for dissolution or dispersion.

When pigments are used as the colorant or when materials that are less likely to be dissolved in an organic solvent, such as charge control agents, reducing the size of particles before addition to the organic solvent is preferred. How to reduce the particles of the colorant (pigment) is not particularly limited and may be properly selected according to purposes. Examples thereof include a method using the master batch as the colorant. The method as described above in connection with the master batch can be applied to the charge control agent.

Examples of other methods for reducing the size of particles of the colorant or the like include a method that includes subjecting the colorant and the like to wet dispersion in an organic solvent optionally after addition of a dispersion aid to obtain a wet master; and a method that, when a material that melts at a temperature below the boiling point of the organic solvent is dispersed, includes heating the material together with a dispersoid in an organic solvent with stirring optionally after addition of a dispersion aid to once dissolve the ingredients, and cooling the solution with stirring or shearing for crystallization to produce microcrystals of the dispersoid.

A method may also be adopted in which the colorant dispersed by these methods, together with the releasing agent-encapsulating capsules, is dissolved or dispersed in an organic solvent, followed by further dispersion. Publicly known dispersers such as bead mills and disk mills may be used in the dispersion.

The organic solvent is not particularly limited and may be properly selected according to purposes. The organic solvent, however, is preferably a volatile organic solvent having a boiling point below 100° C. from the viewpoint of easiness on solvent removing treatment which will be described later.

Examples of such organic solvents include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. They may be used solely or in a combination of two or more of them.

When the resin dissolved or dispersed in the organic solvent is a resin having a polyester skeleton, ester-based solvents such as methyl acetate, ethyl acetate, and butyl acetate or ketone-based solvents such as methyl ethyl ketone and methyl isobutyl ketone are preferred as the organic solvent from the viewpoint of high dissolving power.

Among them, methyl acetate, ethyl acetate, and methyl ethyl ketone are particularly preferred as the organic solvent from the viewpoint of easiness on solvent removing treatment.

—Modified Resin—

When enhancing the mechanical strength of the resultant toner is contemplated or when the toner is used as the toner for electrostatic latent image development, the oil phase may contain a modified resin having an isocyanate group at the end (referred to also as "prepolymer") from the viewpoints of enhancing the mechanical strength and preventing hot offset in the fixation.

In the oil droplet dispersion preparation treatment which will be described later, isocyanate groups in the modified resin are hydrolyzed in a process of obtaining particles (oil droplets) of an oil phase dispersed in an aqueous phase, and, consequently, some of the isocyanate groups are converted to an amino group. The amino group thus produced is reacted with an unreacted isocyanate group to allow an extension reaction to proceed.

The modified resin may be produced by any method without particular limitation, and the method may be properly selected according to purposes. Examples of such methods include (1) a method that includes polymerizing a resin together with a monomer containing an isocyanate group to obtain a resin having an isocyanate group; and (2) a method that includes obtaining a resin having active hydrogen at the end by polmerization and then reacting the resultant polymer with a polyisocyanate to introduce an isocyanate group into the end of the polymer. Among them, the method (2) is preferred from the viewpoint of regulation in the introduction of the isocyanate group into the end.

In the resin having an active hydrogen at the end, the active hydrogen is not particularly limited and may be properly selected according to purposes. Examples thereof include hydroxyl (alcoholic hydroxyl and phenolic hydroxyl), amino, carboxyl, and mercapto groups. Among them, alcoholic hydroxyl groups are preferred.

The skeleton in the modified resin is not particularly limited and may be properly selected according to purposes. When the evenness of the particles is taken into consideration, the same resin as the binder resin soluble in an organic solvent is preferred, and resins having a polyester skeleton are particularly preferred.

When the active hydrogen in the resin having an active hydrogen at the end is an alcoholic hydroxyl group and the skeleton in the modified resin is a polyester skeleton, examples of methods for producing the modified resin having the alcoholic hydroxyl group at the end of the polyester skeleton include a method in which, in polycondensation of a polyol with a polycarboxylic acid, the polycondensation reaction is carried out in such a manner that the number of functional group in the polyol is larger than the number of functional group in the polycarboxylic acid.

—Amine Compound—

Preferably the oil phase is used in combination with an amine compound from the viewpoint of allowing an extension reaction of the modified resin to reliably proceed or a crosslinking point to be introduced. The same amine compounds as the amine compound (B) described in the modified crystalline resin may be mentioned as the amine compound.

—Charge Control Agent—

In the oil phase, if necessary, a charge control agent may be dissolved or dispersed in an organic solvent. Examples of charge control agent include those exemplified above.

—Aqueous Phase Preparation Treatment—

The aqueous phase preparation treatment is a treatment for preparing an aqueous phase containing at least an aqueous medium and a surfactant. If necessary, the aqueous phase may further contain the dispersion stabilizer.

—Aqueous Medium—

Water may be used solely as the aqueous medium, or alternatively may be used in combination with a solvent miscible with water. Any solvent is miscible with water may be used without particular limitation and the solvent may be properly selected according to purposes. Examples thereof include alcohols such as methanol, isopropanol, and ethylene glycol; dimethylformamide; tetrahydrofuran; cellosolves such as methyl cellosolve; and lower ketones such as acetone and methyl ethyl ketone. They may be used solely or in a combination of two or more of them.

—Surfactant—

The surfactant is used in order to disperse the oil phase in the aqueous medium to prepare oil droplets.

The surfactant is not particularly limited and may be properly selected according to purposes. Examples thereof include anionic surfactants such as alkylbenzene sulfonic acid salts, α-olefin sulfonic acid salts, and phosphoric esters; amine salt-type cationic surfactants such as alkyl amine salts, aminoalcohol fatty acid derivatives, polyamine fatty acid derivatives, and imidazoline; quaternary ammonium salt-type cationic surfactants such as alkyltrimethyl ammonium salts, dialkyldimethyl ammonium salts, alkyldimethyl benzyl ammonium salts, pyridinium salts, alkyl isoquinolinium salts, and benzethonium chloride; nonionic surfactants such as fatty acid amide derivatives and polyol derivatives; and ampholytic surfactants such as alanine, dodecyldi(aminoethyl)glycin, di(octylaminoethyl)glycin, and N-alkyl-N,N-dimethylammonium betaine. Surfactants having a fluoroalkyl group, even when used in a very small amount, can advantageously disperse the oil phase. They may be used solely or in a combination of two or more of them.

Examples of anionic surfactants having a fluoroalkyl group include fluoroalkyl carboxylic acids having from 2 to 10 carbon atoms and their metal salts, disodium perfluorooctane sulfonyl glutamate, sodium 3-{ω-fluoroalkyl(C6-C11)oxy}-1-alkyl(C3-C4)sulfonate, sodium 3-{ω-fluoroalkanoyl(C6-C8)-N-ethylamino}-1-propanesulfonate, fluoroalkyl(C11-C20) carboxylic acids and their metal salts, perfluoroalkylcarboxylic acids(C7-C13) and their metal salts, perfluoroalkyl(C4-C12) sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl(C6-C10)-N-ethylsulfonyl glycin, and monoperfluoroalkyl(C6-C16) ethylphosphates.

Examples of cationic surfactants having a fluoroalkyl group include primary and secondary aliphatic amino acids, secondary amino acids having a fluoroalkyl group, aliphatic quaternary ammonium salts such as perfluoroalkyl(C6-C10) sulfoneamidepropyltrimethyl ammonium salts, benzalkonium salts, benzetonium chloride, pyridinium salts, and imidazolinium salts.

—Dispersion Stabilizer—

The aqueous phase may contain the dispersion stabilizer such as inorganic dispersants and protective colloids from the viewpoint of improving the dispersibility of oil droplets in the oil droplet dispersion preparation treatment which will be described later. When the aqueous phase contains the dispersion stabilizer, advantageously, the particle size distribution of the toner is sharp and, at the same time, the dispersion is stable.

—Oil Droplet Dispersion Preparation Treatment—

The oil droplet dispersion preparation treatment is a treatment that the oil phase is dispersed in the aqueous phase to prepare an oil droplet dispersion with oil droplets formed of the oil phase dispersed therein.

The oil droplet dispersion may be prepared by any method without particular limitation, and the method may be properly selected according to purposes. Examples thereof include a method in which the oil droplet dispersion is prepared with publicly known apparatuses utilizing low-speed shearing, high-speed shearing, friction, high-pressure jetting, and ultrasonic waves. Among them, the high-speed shearing method is preferred in that oil droplets having desired particle diameters can be prepared.

The volume average particle diameter of oil droplets in the oil droplet dispersion is not particularly limited and may be properly selected according to purposes. The volume average particle diameter of oil droplets, however, is preferably 2 μm to 20 μm, more preferably 2 μm to 10 μm.

Any temperature may be used in the oil droplet dispersion preparation treatment without particular limitation, and the temperature may be properly selected according to purposes. The temperature, however is preferably 0° C. to 40° C., more preferably 10° C. to 30° C. When the temperature is above 40° C., molecular motion is so active that the dispersion stability lowers and aggregates and coarse particles are likely to be formed. On the other hand, when the temperature is below 0° C., the viscosity of the dispersion is so high that shear energy necessary for the dispersion is increased, leading to a lowered production efficiency.

—Solvent Removing Treatment—

The solvent removing treatment is a treatment that the organic solvent is removed from the oil droplet dispersion to prepare a dispersion slurry containing the aqueous medium and toner particles. In the present, invention, the dispersion slurry refers to a flowable state in which toner particles are dispersed in an aqueous medium.

Examples of methods for removing the solvent in the solvent, removing treatment include the following methods (1)

to (3), and these methods may be carried out solely or in a combination of two or more of them:

(1) a method in which the temperature of the whole oil droplet dispersion is gradually raised with stirring to completely evaporate and remove the organic solvent in the oil droplet dispersion (oil droplets);

(2) a method in which the oil droplet dispersion is sprayed into a drying atmosphere while stirring the whole oil droplet dispersion to completely remove the organic solvent in the oil droplet dispersion (oil droplets); and (3) a method in which the whole oil droplet dispersion is placed in a reduced pressure environment with stirring to evaporate and remove the organic solvent in the oil droplet dispersion (oil droplets).

Among them, the method (1) is preferred for the solvent removing treatment.

When the solvent removing treatment is carried out by the method (2) in which the oil droplet dispersion is sprayed into a drying atmosphere while stirring the whole oil droplet dispersion to completely remove the organic solvent in the oil droplet dispersion (oil droplets), the drying atmosphere is not particularly limited and may be properly selected according to purposes. Examples thereof include gases obtained by heating air, nitrogen, carbon dioxide, combustion gas and the like and various gas streams heated to a temperature at or above the highest boiling point of organic solvents in the oil droplet dispersion. They may be used solely or in a combination of two or more of them.

The solvent removing treatment may be carried out with an apparatus. Examples of such apparatuses include spray driers, belt driers, and rotary kilns. When these apparatuses are used, toners having contemplated satisfactory quality can be obtained in a short time.

<Washing Step>

The washing step is a step of washing the toner particles. The dispersion slurry obtained by the solvent removing treatment sometimes contains, in addition to toner particles, auxiliary materials such as a surfactant and a dispersion stabilizer, and, thus, preferably, washing is carried out to take out only the toner particles from the dispersion slurry.

The washing in the washing step may be carried out by any method without particular limitation, and the method may be properly selected according to purposes. Examples thereof include centrifugation, vacuum filtration, and filter press methods.

A cake of toner particles can be obtained by any of the above methods. When the toner particles cannot be satisfactorily washed by single washing operation, a method may also be adopted in which the resultant cake is again dispersed in an aqueous solvent to prepare a dispersion slurry and the washing step is repeated.

When the washing step is carried out by a vacuum filtration or filter press method, an aqueous solvent may be passed through a cake of the toner particles to wash away auxiliary materials contained in the toner particles.

In general, for example, water or a mixed solvent including an alcohol such as methanol or ethanol mixed into water is used as the aqueous solvent used in the washing step. Among them, water is preferred from the viewpoints of cost and an environmental load applied by waste water treatment.

When the dispersion stabilizer is added to the water phase and substances soluble in acid or alkali, such as calcium phosphate, is used as the dispersion stabilizer, a method is preferably used in which calcium phosphate is dissolved in an acid such as hydrochloric acid followed by washing with water. Further, a method using enzymatic degradation may also be adopted.

When the dispersion stabilizer is used, the dispersion stabilizer may stay on the surface of the toner particles. However, removal by washing is preferred from the viewpoint of electrification of the toner.

<Drying Step>

The drying step is a step of removing the aqueous medium from the toner particles after the washing step to dry the toner particles. After the drying step, only the toner particles can be obtained from the toner particles, after the washing step, that contained a large amount of the aqueous medium.

Preferably, the drying step is carried out until the content, of water in the toner particles is finally less than 1% by mass based on the toner particles.

Any method may be used for drying the toner in the drying step without particular limitation, as long as the aqueous medium can be removed from the toner particles after the washing step. The method may be properly selected according to purposes. Examples thereof include methods utilizing driers such as spray driers, vacuum freeze dryers, vacuum dryers, static shelf dries, mobile shelf driers, fluidization tank driers, rotary driers, and stirring-type driers.

<Other Steps>

Any other steps that do not sacrifice the effect of the present invention may be used without particular limitation and the step may be properly selected according to purposes. Examples thereof include a aging step and a disintegration step.

—Aging Step—

The aging step is a step that is carried out in a period between after the oil droplet dispersion preparation treatment and before the solvent removing treatment in the dispersion step. In the aging step, when the oil phase contains a modified resin having an isocyanate group at the end, an extension reaction and/or a crosslinking reaction of the isocyanate group is allowed to proceed.

The temperature at which the aging step is carried out is not particularly limited and may be properly selected according to purposes. The temperature, however, is preferably 0° C. to 40° C., more preferably 15° C. to 30° C.

The aging step may be carried out for any period of time without particular limitation, and the aging time may be properly selected according to purposes. The aging time, however, is preferably 10 min to 40 hr, more preferably 2 hr to 24 hr.

—Disintegration Step—

The disintegration step is a step that, when toner particles are in a loosely aggregated state, is carried out after the drying step to loosen the loosely aggregated particles.

Examples of methods for disintegrating the loosely aggregated toner particles in the disintegration step include methods utilizing jet mills, HENSCHEL MIXER, super mixers, coffee mills, Auster blenders, and food processors.

(Developer)

The developer according to the present invention includes at least the toner according to the present invention and optionally other components such as carriers.

The developer is not particularly limited as long as the toner according to the present invention is contained. The developer may be a one-component developer consisting of the toner alone or alternatively may be a two-component developer composed of the toner and a carrier.

The carrier is not particularly limited and may be properly selected according to purposes. Examples thereof include iron powders, ferrite powders, magnetite powders, and magnetic resin carriers.

Preferably, the carriers are covered. Examples of covering materials include urea-formaldehyde resins, melamine resins, benzoguanamine resins, urea resins, polyamide resins, epoxy resins, acrylic resins, polymethyl methacrylate resins, polyacrylonitrile resins, polyvinyl acetate resins, polyvinyl alcohol resins, polyvinyl butyral resins, polystyrene-based resins, halogenated olefin resins such as polyvinyl chloride, polyester-based resins such as polyethylene terephthalate resins and polybutylene terephthalate resins, polycarbonate-based resins, polyethylene resins, polyvinyl fluoride resins, polyvinylidene fluoride resins, polytrifluoroethylene resins, polyhexafluoropropylene resins, copolymers of vinylidene fluoride with acrylic monomers, copolymers of vinylidene fluoride with vinyl fluoride, fluoro terpolymers such as terpolymers of tetrafluoroethylene, vinylidene fluoride, and non-fluorinated monomers, and silicone resins. They may be used solely or in a combination of two or more of them.

The covering material may if necessary contain electroconductive powders and the like. Examples of such electroconductive powders include metal powders, carbon black, titanium oxide, tin oxide, and zinc oxide. They may be used solely or in a combination of two or more of them.

Preferably, the electroconductive powder has an average particle diameter of 1 μm or less. When the average particle diameter is more than 1 μm, difficulties are encountered in regulating the electrical resistance.

When the toner is used as the two-component developer, the content ratio between the carrier and the toner in the developer is not particularly limited and may be properly selected according to purposes. The content ratio, however, is preferably 1 part by mass to 10 parts by mass of the toner per 100 parts by mass of the carrier.

(Process Cartridge)

A process cartridge according to the present invention includes a photoconductor integrated with a developing unit and optional other units properly selected according to purposes, such as an electrostatic latent image formation unit, a transfer unit, a fixing unit, a cleaning unit, and a destaticizer. The process cartridge is detachably attachable to an image forming apparatus.

The developing unit is a unit that develops an electrostatic latent image on the photoconductor with the developer containing the toner according to the present invention to form a visible image.

<Photoconductor>

The material, shape, structure, size and the like of the photoconductor (sometimes referred to as "electrostatic latent image bearing member," "electrophotographic photoconductor," or "latent image bearing member") are not particularly limited and may be properly selected according to purposes.

Examples of materials include inorganic photoconductors such as amorphous silicon, selenium, CdS, and ZnO; and organic photoconductors (OPCs) such as polysilane and phthalopolymethine. Examples of shapes include drums, sheets, and endless belts. The structure may be either a single-layer structure or a laminated structure. The size may be properly selected according to the size, specifications and the like of the image forming apparatus.

<Electrostatic Latent Image Formation Unit>

Any electrostatic latent image formation unit that can form an electrostatic latent image on the photoconductor may be used without particular limitation, and the electrostatic latent image formation unit may be properly selected according to purposes. An example of the electrostatic latent image formation unit is a unit including at least an electrifying member that electrifies the surface of the photoconductor and an exposing member that allows the surface of the photoconductor to be exposed imagewise.

<<Electrifying Member>>

The electrifying member is a member that evenly electrifies the surface of the photoconductor. The electrification may be carried out, for example, by a method that applies a voltage to the surface of the photoconductor.

The electrifying member is not particularly limited and may be properly selected according to purposes. Examples thereof include contact electrifiers publicly known per se and provided, for example, with electroconductive or semi-electroconductive rolls, brushes, films, or rubber blades, and non-contact electrifiers that utilize corona discharge, such as corotron and scorotron electrifiers.

<<Exposing Member>>

The exposing member is a member that allows the surface of the photoconductor evenly electrified by the electrifying member to be exposed imagewise (electrostatic latent image).

The exposing member is not particularly limited and may be properly selected according to purposes. Examples thereof include various exposure devices such as copy optical, rod lens array, laser optical and liquid crystal shutter optical devices.

<Developing Unit>

The developing unit is a unit that develops the electrostatic latent image on the photoconductor with the developer containing the toner according to the present invention. The developing unit is not particularly limited and may be properly selected from publicly known developing devices according to purposes.

<Transfer Unit>

The transfer unit is a unit that transfers a visible image developed by the developing unit to a recording medium. Preferably, the transfer is carried out with an intermediate transfer body. Preferably, the transfer unit includes a primary transfer unit that transfers the visible image onto the intermediate transfer body, and a secondary transfer unit that transfers the transfer image onto the recording medium.

The intermediate transfer body is not particularly limited and may be properly selected from publicly known transfer bodies according to purposes. Examples of suitable intermediate transfer bodies include transfer belts.

Preferably, the transfer unit (the primary transfer unit and the secondary transfer unit) has at least one transfer device that transfers the visible image formed on the photoconductor to the recording medium side by peel electrification. The number of transfer units used may be one or may be two or more.

The transfer device is not particularly limited and may be properly selected according to purposes. Examples thereof include corona transfer devices utilizing corona discharge, transfer belts, transfer rollers, pressure transfer rollers, and adhesive transfer devices.

The recording medium is not particularly limited and may be properly selected from publicly known recording media (recording papers).

<Fixing Unit>

The fixing unit is a unit that fixes the visible image transferred onto the recording medium. The fixing unit is not particularly limited and may be properly selected according to purposes. The fixing unit, however, is preferably a publicly known heat-pressing unit. Examples of heat-pressing units include a combination of a heating roller with a pressing roller and a combination of a heating roller with a pressing roller and an endless belt. The heating temperature in the heat-pressing unit is preferably 80° C. to 200° C.

<Cleaning Unit>

The cleaning unit is a unit that removes a developer which stays on the photoconductor.

Any cleaning unit that can remove the developer which stays on the photoconductor may be used without particular limitation and the cleaning unit may be properly selected from publicly known cleaning units. Examples thereof include brushes such as magnetic brushes and electrostatic brushes, magnetic rollers, blades, and webs.

<Destaticizer>

The destaticizer is a unit that applies a destaticization bias to the photoconductor to destaticize the photoconductor.

Any destaticizer that can apply a destaticization bias to the photoconductor may be used without particular limitation, and the destaticizer may be properly selected from publicly known destaticizers. Examples of suitable destaticizers include destaticizing lamps.

The process cartridge according to the present invention will be described with reference to accompanying drawings. However, it should be noted that the present invention is not limited thereto.

Figure 2:
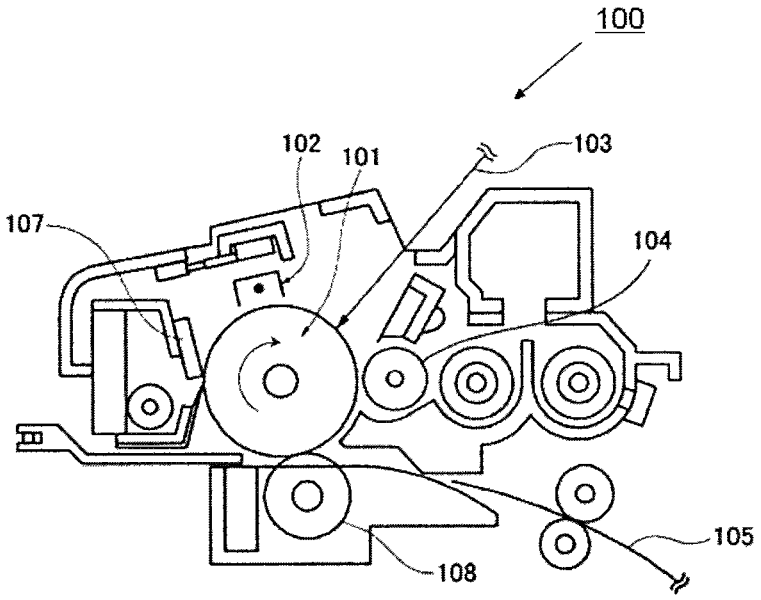
FIG. 2 is a schematic cross-sectional view showing one example of a process cartridge according to the present invention.

FIG. 2 is a schematic cross-sectional view showing one example of a process cartridge according to the present invention. A process cartridge 100 includes a photoconductor 101, a developing unit 104, an electrifying unit 102, a cleaning unit 107, a transfer roller 108 as a transfer unit and optionally other units. In FIG. 2, numeral 103 denotes exposure from an exposure device not shown, and numeral 105 a recording medium such as paper.

In the process cartridge 100 shown in FIG. 2, the photoconductor 101 is rotated in a direction indicated by an arrow and, in this state, is electrified by the electrifying unit 102. The photoconductor 101 is then exposed to light 103 emitted from an exposure unit (not shown) to form an electrostatic latent image corresponding to an exposure image on the surface of the photoconductor 101. The electrostatic latent image is developed with the toner according to the present invention by the developing unit 104 to form a toner image. The toner image is transferred by the transfer roller 108 onto a recording medium 105 and is printed out. After the image transfer, the photoconductor 101 is cleaned by the cleaning unit 107 and is destaticized by a destaticizer (not shown), and the above procedure is repeated.

<Use>

The process cartridge uses the developer containing a toner according to the present invention that simultaneously has all of excellent low-temperature fixability, hot-offset resistance, and heat-resistant storage stability and thus is suitable for use, for example, in various electrophotographic image forming apparatuses, facsimile machines, and printers.

(Image Forming Apparatus)

The image forming apparatus according to the present invention includes at least a photoconductor, an electrostatic latent image formation unit, a developing unit, a transfer unit, and a fixing unit and optionally other units such as a cleaning unit and a destaticizer.

The electrostatic latent image formation unit is a unit that forms an electrostatic latent image on the photoconductor.

The developing unit is a unit that develops the electrostatic latent image with the developer containing the toner according to the present invention to form a visible image.

The transfer unit is a unit that transfers the visible image onto a recording medium.

The fixing unit is a unit that fixes the visible image transferred onto the recording medium.

The photoconductor may be the same as the photoconductor in the process cartridge.

The electrostatic latent image formation unit may be the same as the electrostatic latent image formation unit in the process cartridge.

The developing unit may be the same as the developing unit in the process cartridge.

The transfer unit may be the same as the transfer unit in the process cartridge.

The fixing unit may be the same as the fixing unit in the process cartridge.

The other units may be the same as the other units in the process cartridge.

One example of the image forming apparatus according to the present, invention will be described with reference to accompanying drawings.

Figure 3:
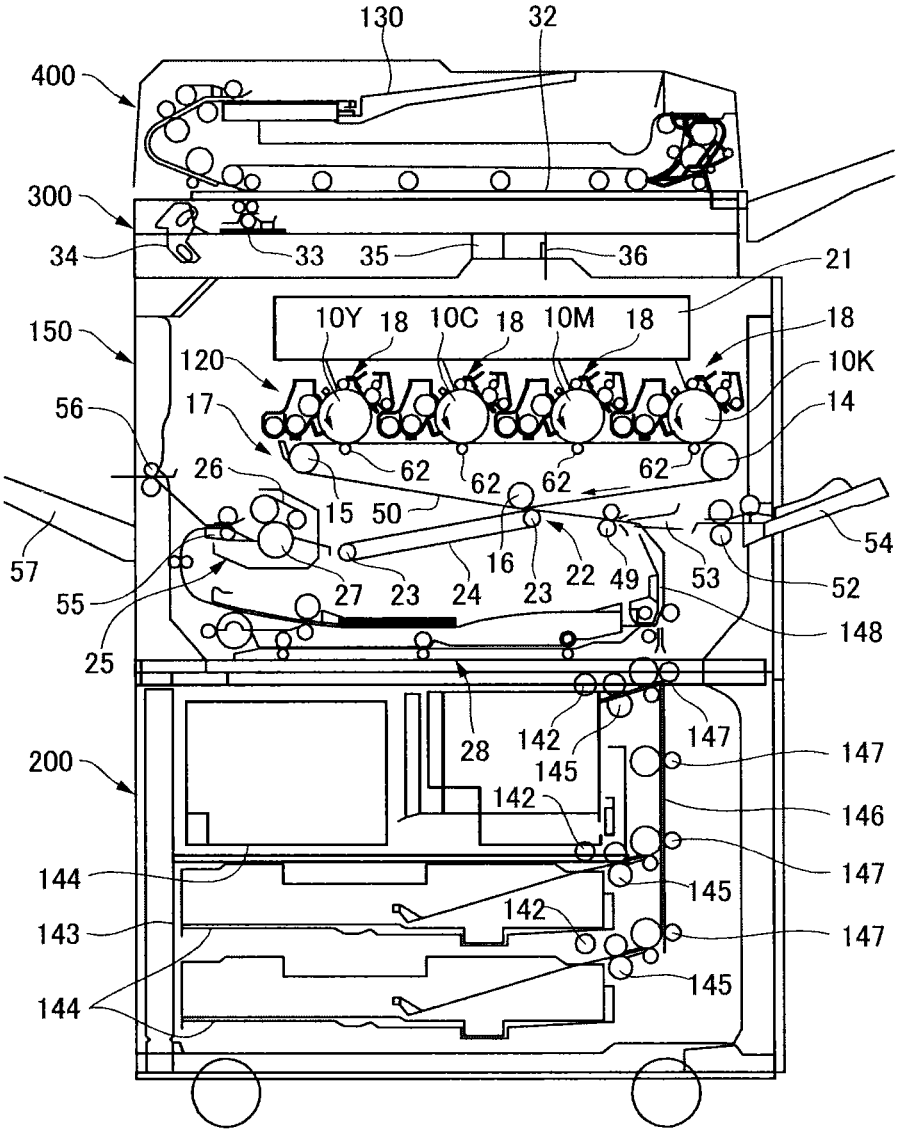
FIG. 3 is a schematic configuration view showing one example of an image forming apparatus according to the present invention.

An image forming apparatus shown in FIG. 3 includes a copier body 150, a paper feed table 200, a scanner 300, and an automatic document feeder (ADF) 400.

The copier body 150 has an endless belt-shaped intermediate transfer body 50 in its center portion. The intermediate transfer body 50 is laid across the support rollers 14, 15, 16 in a tensioned state and, in FIG. 3, is rotatable clockwise. An intermediate transfer body cleaning device 17 is provided in the vicinity of the support roller 15 to remove the toner that stays on the intermediate transfer body 50. A tandem-type developing device 120 including four image forming units 18, yellow, cyan, magenta, and black image forming units, that are juxtaposed so as to face each other is provided on the intermediate transfer body 50 laid across the support roller 14 and the support roller 15 in a tensioned state along a conveying direction of the intermediate transfer body 50. An exposure device 21 that is the exposing member is provided in the vicinity of the tandem-type developing device 120. A secondary transfer device 22 is provided on the intermediate transfer body 50 in its side remote from the tandem-type developing device 120. In the secondary transfer device 22, a secondary transfer belt 24 that is an endless belt is laid across a pair of rollers 23 in a tensioned state. A transfer paper conveyed on the secondary transfer belt 24 and the intermediate transfer body 50 can be brought into contact with each other. A fixing device 25 that is the fixing unit is provided in the vicinity of the secondary transfer device 22. The fixing device 25 includes a fixing belt 26 that is an endless belt, and a pressure roller 27 that is provided in pressure contact with the fixing belt 26.

In the tandem-type image forming apparatus, in order to form an image on both sides of the transfer paper, a sheet reversing device 28 is provided in the vicinity of the secondary transfer device 22 and the fixing device 25 to reverse the transfer paper.

Full-color image formation (color copying) using the tandem-type developing device 120 will be described. Specifically, at the outset, an original is set on a table 130 of an automatic document feeder (ADF) 400. Alternatively, the automatic document feeder 400 is opened, an original is set on a contact glass 32 of a scanner 300, and the automatic document feeder 400 is closed.

When the original is set on the automatic document feeder 400, pressing a start switch (not shown) allows the original to be conveyed onto the contact glass 32 and the scanner 300 is then driven. On the other hand, when the original is set on the contact glass 32, the scanner 300 is immediately driven. Driving of the scanner 300 is followed by travel of a first travelling body 33 and a second travelling body 34. At that time, light from a light source is applied by the first travelling body 33, and light reflected from the original surface is reflected by a mirror in the second travelling body 34. The reflected light is passed through an imaging lens 35 and is received by a reading sensor 36 to read the color original (color image), and the read data are used as information about black, yellow, magenta, and cyan images.

Figure 4:
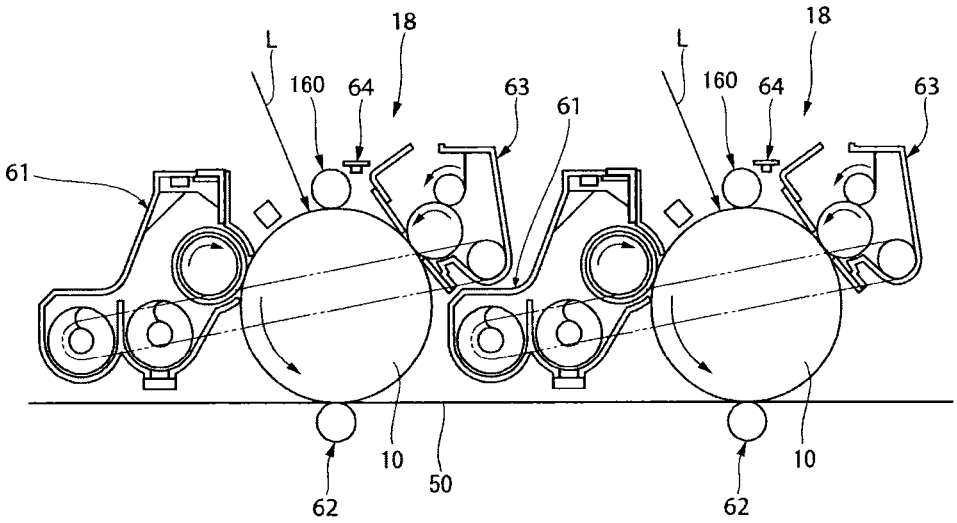
FIG. 4 is a partially enlarged view of FIG. 3.

The black image information, the yellow image information, the magenta image information, and the cyan image information are transmitted to respective image forming units 18 (black image forming unit, yellow image forming unit, magenta image forming unit, and cyan image forming unit) in the tandem-type developing device 120, and black, yellow, magenta, and cyan toner images are formed in the respective image forming units. Specifically, as shown in FIG. 4, each of the image forming units 18 (black image forming unit, yellow image forming unit, magenta image forming unit, and cyan image forming unit) in the tandem-type developing device 120 includes: a photoconductor 10 (black photoconductor 10K, yellow photoconductor 10Y, magenta photoconductor 10M, and cyan photoconductor 10C); an electrifying device 160 that is the electrifying member which evenly electrifies the photoconductor 10; an exposure device that allows the photoconductor to be exposed imagewise (so as to correspond to each color image) based on each color image information (L in FIG. 4) to form electrostatic latent images corresponding to respective color images on the photoconductor; a developing device 61 that is the developing unit and develops the electrostatic latent images with respective color toners (black toner, yellow toner, magenta toner, and cyan toner) to form toner images of the respective color toners; a transfer electrifier 62 that transfers the toner image onto the intermediate transfer body 50; a cleaning device 63; and a destaticizer 64. According to the image forming units 18, single-color images (black image, yellow image, magenta image, and cyan image) can be formed based on information about respective color images. The black image formed on the black photoconductor 10K, the yellow image formed on the yellow photoconductor 10Y, the magenta image formed on the magenta photoconductor 10M, and the cyan image formed on the cyan photoconductor 10C are successively transferred (primary transfer) onto the intermediate transfer body 50 that is rotationally moved by the support rollers 14, 15, and 16, and the black image, the yellow image, the magenta image, and the cyan image are superimposed on top of one another on the intermediate transfer body 50 to form a synthesized color image (a color transfer image).

On the other hand, in a paper feed table 200, one of paper feed rollers 142 is selectively rotated to take a sheet (recording paper) out of one of multiple-stage paper cassettes 144 in a paper bank 143. A separation roller 145 separates sheets one by one and feeds the sheet into a paper feed route 146, and a feeding roller 147 feeds the sheet into a paper feed route 148 within a copier body 150 to strike and stop the sheet against a registration roller 49. Otherwise, a paper feed roller 142 is rotated to take a sheet (recording paper) out of a manual feed tray 54, and a separation roller 52 separates sheets one by one and feeds the sheet into a paper feed route 53 again to strike and stop the sheet against a registration roller 49. The registration roller 49 is generally used in a grounded state. However, the registration roller 49 may also be used in a bias applied state for removing paper debris of the sheet. In timing with the synthesized full-color image (color transfer image) on the intermediate transfer body 50, the registration roller 49 is rotated to feed the sheet (recording paper) to a portion between the intermediate transfer body 50 and the secondary transfer device 22, and the secondary transfer device 22 transfers the synthesized color image (color transfer image) onto the sheet (recording paper) (secondary transfer), whereby a color image is transferred and formed on the sheet (recording paper). The toner that stays on the intermediate transfer body 50 after the image transfer is removed by cleaning with an intermediate transfer body cleaning device 17.

The sheet (recording paper) on which the color image is transferred and formed is conveyed by the secondary transfer device 22 to the fixing device 25. In the fixing device 25, the synthesized color image (color transfer image) is fixed to the sheet (recording paper) by heat and pressure. Thereafter, switching is carried out with a switch-over click 55, and the sheet (recording paper) is discharged by a discharge roller 56 and stacked on a catch tray 57. Otherwise, switching is carried out with a switch-over click 55, the sheet (recording paper) is reversed by the sheet reversing device 28 and is again led to a transfer position, an image is also recorded on the backside of the sheet, and the sheet is then discharged by the discharge roller 56 and is stacked on the catch tray 57.

EXAMPLES

Hereinafter, the present invention is explained in detail with reference to examples of the present invention, which however shall not be construed as limiting the scope of the present invention. Here, unless otherwise specified, "part(s)" denotes "part(s) by mass", and "%" denotes "% by mass".

For the following synthesis examples, preparation examples, examples, and comparative example, the following methods were used for measurements and evaluations.

<Measurement of Average Ester-Group Concentration>

An average ester-group concentration was calculated from Formula (1) below.

$$\text{Average ester-group concentration}=\Sigma(44/Mwi\times Wi) \qquad \text{Formula (1)}$$

In Formula (1), "Mwi" represents a molecular weight of a vinyl monomer including an ester group, and "Wi" represents a charge ratio (% by mass) of a vinyl monomer including an ester group.

<Measurement of Number Average Molecular Weight and Weight-Average Molecular Weight>

A number average molecular weight and a weight-average molecular weight were measured by gel permeation chromatography (GPC) under the following conditions.

Apparatus: GPC-150C (manufactured by Waters Corporation)

Column: Shodex (registered trademark) KF801 to 807 (manufactured by Showa Denko KK)

Column temperature: 40° C.

Solvent: THF (tetrahydrofuran)

Flow rate: 1.0 mL/min

Detector: RI (refractive index) detector

Sample: 0.1 mL of a sample having a concentration of 0.05% by mass to 0.6% by mass was injected.

Using a molecular-weight calibration curve created from the molecular weight distribution of a resin measured under the above conditions with monodispersed polystyrene standard samples, a number average molecular weight (Mn) and a weight-average molecular weight (Mw) of a resin were calculated. As the standard polystyrene sample for creating the calibration curve, Shodex (registered trademark) STANDARD Std. Nos. S-7300, S-210, S-390, S-875, S-1980, S-10.9, S-629, S-3.0 and S-0.580 (manufactured by Showa Denko KK) were used.

<Measurement of Glass Transition Temperature>

A glass transition temperature (Tg) was measured by the following method using a Differential Scanning Calorimetry (DSC) apparatus (TG-DSC SYSTEM TAS-100, manufactured by Rigaku Corporation).

About 10 mg of a measurement sample was placed in an aluminum sample container, which was then placed on a holder unit and set in an electric furnace. It was heated from a room temperature to 150° C. at a heating speed of 10°

C./min and then allowed to stand at 150° C. for 10 min. The sample was cooled to a room temperature and then allowed to stand for 10 min. Under a nitrogen atmosphere, it was heated again to 150° C. at a heating speed of 10° C./min and a DSC measurement was carried out. The glass transition temperature (Tg) was calculated from a contact point between a tangent of an endotherm curve in the vicinity of Tg and a baseline using an analysis system in TG-DSC SYSTEM.

<Measurement of Softening Point>

Regarding a softening point, using a flow tester (CFT-500D, manufactured by Shimadzu Corporation), a load of 1.96 MPa was applied by a plunger on 1 g of a measurement sample (resin) while heating at a heating speed of 6° C./min. The sample was extruded from a nozzle having a diameter of 1 mm and a length of 1 mm. An amount of descent of the plunger of the flow tester was plotted against the temperature, and the temperature at which a half of the amount of the sample was flown out was determined as the softening point.

<Measurement of Acid Value>

An acid value was measured under the following conditions according to a measurement method described in JIS K0070-1992.

First, 0.5 g of a measurement sample (polyester resin) (0.3 g as an ethyl acetate-soluble content) was added to 120 mL of toluene, which was stirred for dissolution at a room temperature (about 23° C.) for about 10 hours. Further, 30 mL of ethanol was added, and a measurement sample solution was prepared. Using this measurement sample solution, an acid value was calculated in an apparatus described in JIS K0070-1992. Specifically, it was titrated with an N/10 potassium hydroxide-alcohol solution which had been standardized beforehand, and the acid value was calculated from Formula (3) below based on the consumed amount of the potassium hydroxide-alcohol solution.

$$\text{Acid value}=\text{KOH (number of } mL\text{'s)}\times N\times 56.1/\text{mass of sample} \qquad \text{Formula (3)}$$

In Formula (3) above, "N" represents a factor of N/10 KOH.

<Measurement of Hydroxyl Value>

A hydroxyl value was measured under the following conditions by a measurement method described in JIS K0070-1966.

In a 100-mL measuring flask, 0.5 g of a measurement sample was accurately weighed, to which 5 mL of an acetylation agent was properly added. Thereafter, it was heated in a bath at 100° C.±5° C. After 1 hour to 2 hours, the flask was taken out from the bath and allowed it to cool. Then, it was shaken with an addition of water, and acetic anhydride was decomposed. Further, for complete decomposition, the flask was heated for 10 min or more and allowed to cool, and then the wall of the flask was washed well with an organic solvent. This solution was subjected to potentiometric titration with an N/2 potassium hydroxide-ethyl alcohol solution using the electrodes, and the hydroxyl value was obtained.

<Measurement of Free Isocyanate Concentration>

A free isocyanate concentration was measured by collecting a prepolymer in a stoppered Erlenmeyer flask containing 20 mL of a 1/2N-di-n-butylamine/toluene solution and back-titrating with 1/2N—HCl.

<Measurement of Melting Point>

A melting point was measured by a Differential Scanning Calorimetry (DSC) apparatus (TG-DSC SYSTEM TAS-100, manufactured by Rigaku Corporation).

<Confirmation of Capsule Structure>

Whether or not a releasing agent in a toner was encapsulated in capsules was confirmed by cutting a toner embedded in an embedding resin with a microtome to prepare a slice and observing the slice with a scanning transmission electron microscope.

A thickness of the capsules was measured from an image observed using a high-speed image processor, LUZEX AP (manufactured by Nireco Corporation), and an average thickness of the capsules was obtained by taking an average of measurement results of 100 capsules.

<Measurement of Particle Diameter of Fine Particles in Releasing Agent (RA) Dispersion>

A volume-average particle diameter of fine particles in a releasing agent (RA) dispersion was measured using a dynamic light-scattering nanotrac particle-size analyzer (UPA-150EX, manufactured by Nikkiso Co., Ltd.) with the following measurement parameters. Here, the measurement was carried out by adjusting a concentration of a measurement sample such that a loading index was in a range of 1 to 1.5.

Transparency of particles: transparent
Refractive index of particles: 1.59
Shape of particles: spherical
Solvent type: WATER
Monodisperse: invalid <Analyses of Resin (I), Resin (D) and Releasing Agent (RA) in Toner>

In a Bayer bottle, 1 g of a toner was weighed, to which 30 mL of N,N-dimethylformamide and 20 mL of chloroform were added. This was stirred for 3 hours, filtered with a membrane filter and dried at a normal temperature, and thereby capsule particles encapsulating a releasing agent in the toner were separated.

In a glass test tube with cap, 50 mg of the obtained sample was placed, which was heated for 1 min with a high-frequency heating apparatus (QUICKER 1010, manufactured by DIC Corporation). To a decomposition product, 0.5 mL of deuterated chloroform and a relaxation reagent Cr(acac)s were added, and a $^{13}$C-NMR measurement was carried out using a nuclear magnetic resonance apparatus (JNM-LA300, manufactured by JEOL Ltd). Also, a thermal decomposition GC-MS measurement was carried out at the same time using a mass spectrometer (JMS-K9, manufactured by JEOL Ltd.). As a column, INERT CAP 5MS/Sil (30 m×0.25 mm, I.D.: 0.25 μm) (manufactured by GL Science, Inc.) was used. As temperature elevation conditions, the temperature was maintained at 40° C. for 3 min, then elevated at 10° C./min and maintained at 300° C. for 5 min. From an obtained $^{13}$C-NMR spectrum and a GC-MS measurement result, an amount, a resin composition and a composition ratio of a resin (I), a resin (D) and a releasing agent (RA) in the toner were respectively calculated.

<Measurement of Particle Diameter of Toner Base Particles>

A volume-average particle diameter of toner base particles was measured by a Coulter counter method. As a measurement apparatus, a particle size distribution measurement apparatus (COULTER COUNTER TA-II, manufactured by Beckman Coulter, Inc.) was used.

Specifically, 0.1 mL to 5 mL of alkylbenzene sulfonate was added as a dispersant to 100 mL to 150 mL of an aqueous electrolyte (ISOTON-II, manufactured by Beckman Coulter, Inc.), to which 2 mg to 20 mg of a measurement sample was added. The electrolyte with a suspension of the measurement sample was subjected to dispersion treatment in an ultrasonic disperser for about 1 min to 3 min. By the particle size distribution measurement apparatus, using as an aperture a 100-μm aperture, a volume or a number of the toner particles or the toner was measured, and a volume distribution and a number distribution were calculated. From the obtained distributions, the volume-average particle diameter and the number-average particle diameter of the toner were obtained.

As the channels, the following 13 channels were used: 2.00 μm or greater and less than 2.52 μm; 2.52 μm or greater and less than 3.17 μm; 3.17 μm or greater and less than 4.00 μm; 4.00 μm or greater and less than 5.04 μm; 5.04 μm or greater and less than 6.35 μm; 6.35 μm or greater and less than 8.00 μm; 8.00 μm or greater and less than 10.08 μm; 10.08 μm or greater and less than 12.70 μm; 12.70 μm or greater and less than 16.00 μm; 16.00 μm or greater and less than 20.20 μm; 20.20 μm or greater and less than 25.40 μm; 25.40 μm or greater and less than 32.00 μm; 32.00 μm or greater and less than 40.30 μm, and particles having a particle diameter of 2.00 μm or greater and less than 40.30 μm were targeted.

Synthesis Example A-1

Synthesis of [Resin (D)-1]

In an autoclave reactor equipped with a thermometer and a stirrer, 450 parts of xylene and 150 parts of low-molecular-weight polyethylene (softening point: 128° C.; number average molecular weight: 4,000; SANWAX LEL-400(EX), manufactured by Sanyo Chemical Industries, Ltd.) were placed and sufficiently is dissolved to prepare a mixture containing an oil-soluble component, and the mixture containing an oil-soluble component was purged with nitrogen.

Next, a mixed solution composed of 594 parts of styrene, 255 parts of methyl methacrylate, 34.3 parts of di-t-butylperoxy hexahydroterephthalate and 120 parts of xylene was dropped in the mixture containing an oil-soluble component at 155° C. over 2 hours so as to polymerize the styrene and the methyl methacrylate, which was further maintained at 155° C. for 1 hour. Next, desolvation was carried out, and [Resin (D)-1] was obtained.

Synthesis Example A-2

Synthesis of [Resin (D)-2]

In an autoclave reactor equipped with a thermometer and a stirrer, 450 parts of xylene and 200 parts of low-molecular-weight polyethylene (softening point: 128° C.; number average molecular weight: 4,000; SANWAX LEL-400 (EX), manufactured by Sanyo Chemical Industries, Ltd.) were placed and sufficiently dissolved to prepare a mixture containing an oil-soluble component, and the mixture containing an oil-soluble component was purged with nitrogen.

Next, a mixed solution composed of 600 parts of styrene, 200 parts of butyl acrylate, 16.1 parts of di-t-butyl peroxy hexahydro terephthalate and 120 parts of xylene was dropped in the mixture containing an oil-soluble component at 155° C. over 2 hours so as to polymerize the styrene and the butyl acrylate, which was further maintained at 155° C. for 1 hour. Next, desolvation was carried out, and [Resin (D)-2] was obtained.

Synthesis Example A-3

Synthesis of [Resin (D)-3]

In an autoclave reactor equipped with a thermometer and a stirrer, 450 parts of xylene and 150 parts of carnauba wax (softening point: 75° C.; melting point: 85° C.; number average molecular weight: 500; WA-05, manufactured by Cerarica Noda Co., Ltd.) were placed and sufficiently dissolved to prepare a mixture containing an oil-soluble component, and the mixture containing an oil-soluble component was purged with nitrogen.

Next, a mixed solution composed of 594 parts of styrene, 255 parts of methyl methacrylate, 34.3 parts of di-t-butyl peroxy hexahydro terephthalate and 120 parts of xylene was dropped in the mixture containing an oil-soluble component at 160° C. over 2 hours so as to polymerize the styrene and the methyl methacrylate, which was further maintained at 160° C. for 1 hour. Next, desolvation was carried out, and [Resin (D)-3] was obtained.

Synthesis Example A-4

Synthesis of [Resin (D)-4]

In an autoclave reactor equipped with a thermometer and a stirrer, 450 parts of xylene and 200 parts of low-molecular-weight polypropylene (softening point: 153° C., number average molecular weight: 9,000; VISCOL 440-P, manufactured by Sanyo Chemical Industries, Ltd.) was placed and sufficiently dissolved to prepare a mixture containing an oil-soluble component, and the mixture containing an oil-soluble component was purged with nitrogen.

Next, a mixed solution composed of 280 parts of styrene, 520 parts of methyl methacrylate, 32.3 parts of di-t-butyl peroxy hexahydro terephthalate and 120 parts of xylene was dropped in the mixture containing an oil-soluble component at 150° C. over 2 hours so as to polymerize the styrene and the methyl methacrylate, which was further maintained at 150° C. for 1 hour. Next, desolvation was carried out, and [Resin (D)-4] was obtained.

Synthesis Example A-5

Synthesis of [Resin (D)-5]

In an autoclave reactor equipped with a thermometer and a stirrer, 450 parts of xylene and 150 parts of low-molecular-weight polypropylene (softening point: 153° C.; number average molecular weight: 9,000; VISCOL 440-P, manufactured by Sanyo Chemical Industries, Ltd.) were placed and sufficiently dissolved to prepare a mixture containing an oil-soluble component, and the mixture containing an oil-soluble component was purged with nitrogen.

Next, a mixed solution composed of 665 parts of styrene, 185 parts of butyl acrylate, 8.5 parts of di-t-butyl peroxy hexahydro terephthalate and 120 parts of xylene was dropped in the mixture containing an oil-soluble component at 160° C. over 2 hours so as to polymerize the styrene and the butyl acrylate, which was further maintained at 160° C. for 1 hour. Next, desolvation was carried out, and [Resin (D)-5] was obtained.

Synthesis Example A-6

Synthesis of [Resin (D)-6]

In an autoclave reactor equipped with a thermometer and a stirrer, 450 parts of xylene and 200 parts of low-molecular-weight polypropylene (softening point 153° C., number average molecular weight 9,000; VISCOL 440-P, manufactured by Sanyo Chemical Industries, Ltd.) were placed and sufficiently dissolved to prepare a mixture containing an oil-soluble component, and the mixture containing an oil-soluble component was purged with nitrogen.

Next, a mixed solution composed of 200 parts of styrene, 600 parts of methyl methacrylate, 32.3 parts of di-t-butyl peroxy hexahydro terephthalate and 120 parts of xylene was dropped in the mixture containing an oil-soluble component at 150° C. over 2 hours so as to polymerize the styrene and the methyl methacrylate, which was further maintained at 150° C. over 1 hour. Next, desolvation was carried out, and [Resin (D)-6] was obtained.

Synthesis Example A-7

Synthesis of [Resin (D)-7]

In an autoclave reactor equipped with a thermometer and a stirrer, 450 parts of xylene was placed and purged with nitrogen. Next, a mixed solution composed of 700 parts of styrene, 300 parts of methyl methacrylate, 34.3 parts of di-t-butyl peroxy hexahydro terephthalate and 120 parts of xylene was dropped in the xylene at 155° C. over 2 hours so as to polymerize the styrene and the methyl methacrylate, which was further maintained at 155° C. for 1 hour. Next, desolvation was carried out, and [Resin (D)-7] was obtained.

Table 1 below shows the measurement results of the average ester-group concentration of the vinyl monomers used as raw materials of [Resin (D)-1] to [Resin (D)-7] and the number average molecular weight (Mn), the weight-average molecular weight (Mw), the glass transition temperature, the softening point, and the SP value of [Resin (D)-1] to [Resin (D)-7].

TABLE 01

| | Oil-soluble component [parts by mass] | | | Average ester-group | Number-avg. | Weight-avg. | | Glass transition | Softening | |
|---|---|---|---|---|---|---|---|---|---|---|
| Resin (D) | Low-MW polyethylene | Carnauba wax | Low-MW polypropylene | concentration (%) | MW (Mn) | MW (Mw) | Mw/Mn | temperature (° C.) | point (° C.) | SP value |
| D-1 | 150 | — | — | 13.2 | 3,300 | 12,000 | 3.6 | 65.2 | 116 | 10.1 |
| D-2 | 200 | — | — | 8.5 | 5,300 | 18,500 | 3.5 | 52 | 125 | 10.0 |
| D-3 | — | 150 | — | 13.2 | 3,400 | 12,300 | 3.6 | 64.8 | 115 | 10.1 |
| D-4 | — | — | 200 | 28.6 | 3,300 | 16,000 | 4.8 | 58.8 | 125 | 9.7 |
| D-5 | — | — | 150 | 7.5 | 8,300 | 22,900 | 2.8 | 60.5 | 130 | 10.0 |
| D-6 | — | — | 200 | 33.0 | 3,200 | 17,000 | 5.3 | 55.3 | 125 | 9.7 |
| D-7 | — | — | — | 13.2 | 3,500 | 9,100 | 2.6 | 68.8 | 110 | 10.4 |

Synthesis Example B-1

Synthesis of [Polyester Resin (R)-1]

A reactor equipped with cooling a tube stirrer and a nitrogen inlet tube was charged with 118 parts of 2-mole ethylene oxide adduct of bisphenol A, 300 parts of 2-mole propylene oxide adduct of bisphenol A, 89 parts of terephthalic acid, 18 parts of adipic acid and 1 part of dibutyltin oxide, which was reacted under a normal pressure and at 230° C. for 8 hours. Next, it was reacted under a reduced pressure of 10 mmHg to 15 mmHg for 5 hours, and then 25 parts of trimellitic anhydride was added in the reactor. It was reacted under a normal pressure and at 180° C. for 2 hours, and thereby [Polyester Resin (R)-1] having a weight-average molecular weight of 6,700, a glass transition temperature of 51° C., an acid value of 20 mgKOH/g and an SP value of 11.2 was synthesized.

Synthesis Example C-1

Synthesis of [Crystalline Polyester Resin (A)-1]

In a reactor equipped with a cooling tube stirrer and a nitrogen inlet tube, 146 parts of adipic acid, 175 parts of 1,10-decanediol and 0.12 parts of dibutyltin oxide were stirred at 180° C. for 6 hours under a nitrogen atmosphere. Next, it was stirred for 4 hours while reducing a pressure, and [Crystalline Polyester Resin (A)-1] having a weight-average molecular weight of 16,700, a number average molecular weight of 6,500, a melting point of 68° C. and an SP value of 9.9 was synthesized.

Preparation Example 1

Preparation of [Releasing Agent (RA) Dispersion-1]

<Encapsulation Process>

In 281 parts of ion-exchanged water, 0.4 parts of sodium dodecyl sulfate was charged, which was heated to 70° C. for dissolution, and an aqueous medium was obtained.

Separately, 30 parts of a styrene monomer, 30 parts of methyl methacrylate, 5 parts of butyl acrylate, 2 parts of methacrylic acid as Resin (I), 33 parts of carnauba wax (melting point: 85° C.; WA-05, manufactured by Cerarica Noda Co., Ltd.) as a releasing agent (RA), and 33 parts of [Resin (D)-1] synthesized in Synthesis Example A-1 were stirred with heating at 80° C. under a nitrogen atmosphere, and a homogeneous monomer solution was obtained.

The obtained monomer solution was charged in the aqueous medium, which was subjected to an ultrasonic irradiation at 90 W to 110 W for 10 min using an ultrasonic homogenizer (VCX750, Tokyo Rikakikai Co., Ltd.) under a nitrogen atmosphere while maintaining at 80° C. so as to disperse the monomer solution in the aqueous medium. During the ultrasonic irradiation, the liquid temperature elevated due to the ultrasonic irradiation, but it was adjusted to 75° C. to 85° C. by a water bath.

An obtained dispersion was transferred into a reactor equipped with a cooling tube, a stirrer and a nitrogen inlet tube and maintained at 80° C. with stirring, to which 0.5 parts of potassium persulfate dissolved in 19 parts of ion-exchanged water was added, and the components in the monomer solution were subjected to a polymerization reaction for 180 min. It was cooled thereafter, and white [Releasing Agent (RA) Dispersion-1] was obtained.

Fine particles in obtained [Releasing Agent (RA) Dispersion-1] had a volume-average particle diameter of 150 nm and were confirmed to have a capsule structure.

Preparation Example 2

Preparation of Releasing Agent (RA) Dispersion-2

White [Releasing Agent (RA) Dispersion-2] was obtained in the same manner as Preparation Example 1 except that [Resin (D)-1] was changed to [Resin (D-2)] in the preparation of [Releasing Agent (RA) Dispersion-1] in Preparation Example 1. A volume-average particle diameter thereof is shown in Table 4-2 below.

Fine particles in obtained [Releasing Agent (RA) Dispersion-2] were confirmed to have a capsule structure.

Preparation Example 3

Preparation of Releasing Agent (RA) Dispersion-3

White [Releasing Agent (RA) Dispersion-3] was obtained in the same manner as Preparation Example 1 except that [Resin (D)-1] was changed to [Resin (D-3)] in the preparation of [Releasing Agent (RA) Dispersion-1] in Preparation Example 1. A volume-average particle diameter thereof is shown in Table 4-2 below.

Fine particles in obtained [Releasing Agent (RA) Dispersion-3] were confirmed to have a capsule structure.

Preparation Example 4

Preparation of Releasing Agent (RA) Dispersion-4

White [Releasing Agent (RA) Dispersion-4] was obtained in the same manner as Preparation Example 1 except that [Resin (D)-1] was changed to [Resin (D-4)] in the preparation of [Releasing Agent (RA) Dispersion-1] in Preparation Example 1. A volume-average particle diameter thereof is shown in Table 4-2 below.

Fine particles in obtained [Releasing Agent (RA) Dispersion-4] were confirmed to have a capsule structure.

Preparation Example 5

Preparation of Releasing Agent (RA) Dispersion-5

White [Releasing Agent (RA) Dispersion-5] was obtained in the same manner as Preparation Example 1 except that [Resin (D)-1] was changed to [Resin (D-5)] in the preparation of [Releasing Agent (RA) Dispersion-1] in Preparation Example 1. A volume-average particle diameter thereof is shown in Table 4-2 below.

Fine particles in obtained [Releasing Agent (RA) Dispersion-5] were confirmed to have a capsule structure.

Preparation Example 6

Preparation of Releasing Agent (RA) Dispersion-6

White [Releasing Agent (RA) Dispersion-6] was obtained in the same manner as Preparation Example 1 except that [Resin (D)-1] was changed to [Resin (D-6)] in the preparation of [Releasing Agent (RA) Dispersion-1] in Preparation Example 1. A volume-average particle diameter thereof is shown in Table 4-2 below.

Fine particles in obtained [Releasing Agent (RA) Dispersion-6] were confirmed to have a capsule structure.

Preparation Example 7

Preparation of Releasing Agent (RA) Dispersion-7

White [Releasing Agent (RA) Dispersion-7] was obtained in the same manner as Preparation Example 1 except that 33 parts of [Resin (D)-1] was changed to 16.5 parts of [Resin (D)-1] in the preparation of [Releasing Agent (RA) Dispersion-1] in Preparation Example 1. A volume-average particle diameter thereof is shown in Table 4-2 below.

Fine particles in obtained [Releasing Agent (RA) Dispersion-7] were confirmed to have a capsule structure.

Preparation Example 8

Preparation of Releasing Agent (RA) Dispersion-8

White [Releasing Agent (RA) Dispersion-8] was obtained in the same manner as Preparation Example 1 except that 33 parts of [Resin (D)-1] was changed to 1.98 parts of [Resin (D)-1] in the preparation of [Releasing Agent (RA) Dispersion-1] in Preparation Example 1. A volume-average particle diameter thereof is shown in Table 4-2 below.

Fine particles in obtained [Releasing Agent (RA) Dispersion-8] were confirmed to have a capsule structure.

Preparation Example 9

Preparation of Releasing Agent (RA) Dispersion-9

White [Releasing Agent (RA) Dispersion-9] was obtained in the same manner as Preparation Example 1 except that 33 parts of [Resin (D)-1] was changed to 66 parts of [Resin (D)-1] in the preparation of [Releasing Agent (RA) Dispersion-1] in Preparation Example 1. A volume-average particle diameter thereof is shown in Table 4-2 below.

Fine particles in obtained [Releasing Agent (RA) Dispersion-9] were confirmed to have a capsule structure.

Preparation Example 10

Preparation of Releasing Agent (RA) Dispersion-10

White [Releasing Agent (RA) Dispersion-10] was obtained in the same manner as Preparation Example 1 except that 33 parts of [Resin (D)-1] was changed to 82.5 parts of [Resin (D)-1] in the preparation of [Releasing Agent (RA) Dispersion-1] in Preparation Example 1. A volume-average particle diameter thereof is shown in Table 4-2 below.

Fine particles in obtained [Releasing Agent (RA) Dispersion-10] were confirmed to have a capsule structure.

Preparation Example 11

Preparation of Releasing Agent (RA) Dispersion-11

White [Releasing Agent (RA) Dispersion-11] was obtained in the same manner as Preparation Example 1 except that the carnauba wax (WA-05, manufactured by Cerarica Noda Co., Ltd.) was changed to a synthetic ester wax (melting point: 82° C.; NISSAN ELECTOR (registered trademark) WEP-5, manufactured by NOF Corporation) in the preparation of [Releasing Agent (RA) Dispersion-1] in Preparation Example 1. A volume-average particle diameter thereof is shown in Table 4-2 below.

Fine particles in obtained [Releasing Agent (RA) Dispersion-11] were confirmed to have a capsule structure.

Preparation Example 12

Preparation of Releasing Agent (RA) Dispersion-12

White [Releasing Agent (RA) Dispersion-12] was obtained in the same manner as Preparation Example 11 except that [Resin (D)-1] was changed to [Resin (D)-2] in the preparation of [Releasing Agent (RA) Dispersion-11] in Preparation Example 11. A volume-average particle diameter thereof is shown in Table 4-2 below.

Fine particles in obtained [Releasing Agent (RA) Dispersion-12] were confirmed to have a capsule structure.

Preparation Example 13

Preparation of Releasing Agent (RA) Dispersion-13

White [Releasing Agent (RA) Dispersion-13] was obtained in the same manner as Preparation Example 11 except that [Resin (D)-1] was changed to [Resin (D)-3] in the preparation of [Releasing Agent (RA) Dispersion-11] in Preparation Example 11. A volume-average particle diameter thereof is shown in Table 4-2 below.

Fine particles in obtained [Releasing Agent (RA) Dispersion-13] were confirmed to have a capsule structure.

Preparation Example 14

Preparation of Releasing Agent (RA) Dispersion-14

White [Releasing Agent (RA) Dispersion-14] was obtained in the same manner as Preparation Example 11 except that [Resin (D)-1] was changed to [Resin (D)-4] in the preparation of [Releasing Agent (RA) Dispersion-11] in Preparation Example 11. A volume-average particle diameter thereof is shown in Table 4-2 below.

Fine particles in obtained [Releasing Agent (RA) Dispersion-14] were confirmed to have a capsule structure.

Preparation Example 15

Preparation of Releasing Agent (RA) Dispersion-15

White [Releasing Agent (RA) Dispersion-15] was obtained in the same manner as Preparation Example 1 except that the carnauba wax (WA-05, manufactured by Cerarica Noda Co., Ltd.) was changed to a paraffin wax (melting point: 75° C.; HNP-09, manufactured by Nippon Seiro Co., Ltd.) in the preparation of [Releasing Agent (RA) Dispersion-1] in Preparation Example 1. A volume-average particle diameter thereof is shown in Table 4-2 below.

Fine particles in obtained [Releasing Agent (RA) Dispersion-15] were confirmed to have a capsule structure.

Preparation Example 16

Preparation of Releasing Agent (RA) Dispersion-16

White [Releasing Agent (RA) Dispersion-16] was obtained in the same manner as Preparation Example 15 except that [Resin (D)-1] was changed to [Resin (D)-2] in the preparation of [Releasing Agent (RA) Dispersion-15] in Preparation Example 15. A volume-average particle diameter thereof is shown in Table 4-2 below.

Fine particles in obtained [Releasing Agent (RA) Dispersion-16] were confirmed to have a capsule structure.

Preparation Example 17

Preparation of Releasing Agent (RA) Dispersion-17

White [Releasing Agent (RA) Dispersion-17] was obtained in the same manner as Preparation Example 15 except that [Resin (D)-1] was changed to [Resin (D)-3] in the preparation of [Releasing Agent (RA) Dispersion-15] in Preparation Example 15. A volume-average particle diameter thereof is shown in Table 4-2 below.

Fine particles in obtained [Releasing Agent (RA) Dispersion-17] were confirmed to have a capsule structure.

Preparation Example 18

Preparation of Releasing Agent (RA) Dispersion-18

White [Releasing Agent (RA) Dispersion-18] was obtained in the same manner as Preparation Example 15 except that [Resin (D)-1] was changed to [Resin (D)-4] in the preparation of [Releasing Agent (RA) Dispersion-15] in Preparation Example 15. A volume-average particle diameter thereof is shown in Table 4-2 below.

Fine particles in obtained [Releasing Agent (RA) Dispersion-18] were confirmed to have a capsule structure.

Preparation Example 19

Preparation of Releasing Agent (RA) Dispersion-19

White [Releasing Agent (RA) Dispersion-19] was obtained in the same manner as Preparation Example 1 except that the carnauba wax (WA-05, manufactured by Cerarica Noda Co., Ltd.) was changed to a synthetic ester wax (melting point: 73° C.; NISSAN ELECTOR (registered trademark) WEP-3, manufactured by NOF Corporation) in the preparation of [Releasing Agent (RA) Dispersion-1] in Preparation Example 1. A volume-average particle diameter thereof is shown in Table 4-2 below.

Fine particles in obtained [Releasing Agent (RA) Dispersion-19] were confirmed to have a capsule structure.

Preparation Example 20

Preparation of Releasing Agent (RA) Dispersion-20

White [Releasing Agent (RA) Dispersion-20] was obtained in the same manner as Preparation Example 19 except that [Resin (D)-1] was changed to [Resin (D)-2] in the preparation of [Releasing Agent (RA) Dispersion-19] in Preparation Example 19. A volume-average particle diameter thereof is shown in Table 4-2 below.

Fine particles in obtained [Releasing Agent (RA) Dispersion-20] were confirmed to have a capsule structure.

Preparation Example 21

Preparation of Releasing Agent (RA) Dispersion-21

White [Releasing Agent (RA) Dispersion-21] was obtained in the same manner as Preparation Example 19 except that [Resin (D)-1] was changed to [Resin (D)-3] in the preparation of [Releasing Agent (RA) Dispersion-19] in Preparation Example 19. A volume-average particle diameter thereof is shown in Table 4-2 below.

Fine particles in obtained [Releasing Agent (RA) Dispersion-21] were confirmed to have a capsule structure.

Preparation Example 22

Preparation of Releasing Agent (RA) Dispersion-22

White [Releasing Agent (RA) Dispersion-22] was obtained in the same manner as Preparation Example 19 except that [Resin (D)-1] was changed to [Resin (D)-4] in the preparation of [Releasing Agent (RA) Dispersion-19] in Preparation Example 19. A volume-average particle diameter thereof is shown in Table 4-2 below.

Fine particles in obtained [Releasing Agent (RA) Dispersion-22] were confirmed to have a capsule structure.

Preparation Example 23

Preparation of Releasing Agent (RA) Dispersion-23

First, 100 parts of a paraffin wax (melting point: 75° C., HNP-09 (manufactured by Nippon Seiro Co., Ltd.)), 5 parts of an anionic surfactant (NEOGEN SC, manufactured by Dai-ichi Kogyo Seiyaku Co., Ltd.) and 300 parts of ion-exchanged water were mixed and heated to 97° C., and it was dispersed by a homogenizer (IKA ULTRA-TURRAX T50, manufactured by IKA). Next, it was subjected to a dispersion treatment 20 times by a homogenizer (Gaulin homogenizer, manufactured by Meiwafosis Co., Ltd. (formerly known as Meiwa Shoji Co., Ltd.)), with conditions of 105° C. and 550 kg/cm$^2$, and thereby white [Releasing Agent (RA) Dispersion-23] was obtained. A volume-average particle diameter thereof is shown in Table 4-2 below.

Fine particles in obtained [Releasing Agent (RA) Dispersion-23] did not have a capsule structure.

Preparation Example 24

Preparation of Releasing Agent (RA) Dispersion-24

White [Releasing Agent (RA) Dispersion-24] was obtained in the same manner as Preparation Example 1 except that the carnauba wax (WA-05, manufactured by Cerarica Noda Co., Ltd.) was changed to a low-molecular-weight polyethylene (melting point: 122° C.; HI-WAX 200P, manufactured by Mitsui Chemicals Inc.) in the preparation of [Releasing Agent (RA) Dispersion-1] in Preparation Example 1. A volume-average particle diameter thereof is shown in Table 4-2 below.

Fine particles in obtained [Releasing Agent (RA) Dispersion-24] were confirmed to have a capsule structure.

Preparation Example 25

Preparation of Releasing Agent (RA) Dispersion-25

White [Releasing Agent (RA) Dispersion-25] was obtained in the same manner as Preparation Example 15 except that [Resin (D)-1] was changed to [Resin (D)-7] in the preparation of [Releasing Agent (RA) Dispersion-15] in Preparation Example 15. A volume-average particle diameter thereof is shown in Table 4-2 below.

Fine particles in obtained [Releasing Agent (RA) Dispersion-25] did not have a capsule structure.

Preparation Example 26

Preparation of Releasing Agent (RA) Dispersion-26

White [Releasing Agent (RA) Dispersion-26] was obtained in the same manner as Preparation Example 1 except that Resin (I) was not added in the preparation of [Releasing Agent (RA) Dispersion-1] in Preparation Example 1. A volume-average particle diameter thereof could not be measured.

Fine particles in obtained [Releasing Agent (RA) Dispersion-26] did not have a capsule structure.

Preparation Example 27

Preparation of Releasing Agent (RA) Dispersion-27

White [Releasing Agent (RA) Dispersion-27] was obtained in the same manner as Preparation Example 1 except that [Resin (D)-1] was not added in the preparation of [Releasing Agent (RA) Dispersion-1] in Preparation Example 1. A volume-average particle diameter thereof could not be measured.

Fine particles in obtained [Releasing Agent (RA) Dispersion-27] did not have a capsule structure.

Preparation Example 28

Preparation of Releasing Agent (RA) Dispersion-28

White [Releasing Agent (RA) Dispersion-28] was obtained in the same manner as Preparation Example 1 except that the amount of sodium dodecyl sulfate was changed from 0.4 parts to 0.2 parts in the preparation of [Releasing Agent (RA) Dispersion-1] in Preparation Example 1. A volume-average particle diameter thereof is shown in Table 4-2 below.

Fine particles in obtained [Releasing Agent (RA) Dispersion-28] were confirmed to have a capsule structure.

Preparation Example 29

Preparation of Releasing Agent (RA) Dispersion-29

White [Releasing Agent (RA) Dispersion-29] was obtained in the same manner as Preparation Example 1 except that the amount of sodium dodecyl sulfate was changed from 0.4 parts to 0.1 parts in the preparation of [Releasing Agent (RA) Dispersion-1] in Preparation Example 1. A volume-average particle diameter thereof is shown in Table 4-2 below.

Fine particles in obtained [Releasing Agent (RA) Dispersion-29] were confirmed to have a capsule structure.

Properties of the releasing agents used for preparing [Releasing Agent (RA) Dispersion-1] to [Releasing Agent (RA) Dispersion-29] are summarized in Table 2 below, and prepared [Releasing Agent (RA) Dispersion-1] to [Releasing Agent (RA) Dispersion-29] are summarized in Table 3-1, Table 3-2, Table 4-1 and Table 4-2 below.

TABLE 2

| Type | Product name | Melting point (° C.) | SP value |
|---|---|---|---|
| Carnauba wax | WA-05 | 85 | 8.5 |
| Synthetic ester wax | WEP-5 | 82 | 8.9 |
| Synthetic ester wax | WEP-03 | 73 | 8.6 |
| Paraffin wax | HNP-09 | 75 | 8.3 |
| Low-molecular-weight polyethylene | HI-WAX 200P | 122 | 8.4 |

TABLE 3-1

| Releasing Agent (RA) Dispersion | Resin (I) [parts by mass] | | | |
|---|---|---|---|---|
| | styrene monomer | methyl methacrylate | butyl acrylate | methacrylic acid |
| 1 | 30 | 30 | 5 | 2 |
| 2 | 30 | 30 | 5 | 2 |

TABLE 3-1-continued

| Releasing Agent (RA) Dispersion | Resin (I) [parts by mass] styrene monomer | methyl methacrylate | butyl acrylate | methacrylic acid |
|---|---|---|---|---|
| 3 | 30 | 30 | 5 | 2 |
| 4 | 30 | 30 | 5 | 2 |
| 5 | 30 | 30 | 5 | 2 |
| 6 | 30 | 30 | 5 | 2 |
| 7 | 30 | 30 | 5 | 2 |
| 8 | 30 | 30 | 5 | 2 |
| 9 | 30 | 30 | 5 | 2 |
| 10 | 30 | 30 | 5 | 2 |
| 11 | 30 | 30 | 5 | 2 |
| 12 | 30 | 30 | 5 | 2 |
| 13 | 30 | 30 | 5 | 2 |
| 14 | 30 | 30 | 5 | 2 |
| 15 | 30 | 30 | 5 | 2 |
| 16 | 30 | 30 | 5 | 2 |
| 17 | 30 | 30 | 5 | 2 |
| 18 | 30 | 30 | 5 | 2 |
| 19 | 30 | 30 | 5 | 2 |
| 20 | 30 | 30 | 5 | 2 |
| 21 | 30 | 30 | 5 | 2 |
| 22 | 30 | 30 | 5 | 2 |
| 23 | — | — | — | — |
| 24 | 30 | 30 | 5 | 2 |
| 25 | 30 | 30 | 5 | 2 |
| 26 | — | — | — | — |
| 27 | 30 | 30 | 5 | 2 |
| 28 | 30 | 30 | 5 | 2 |
| 29 | 30 | 30 | 5 | 2 |

TABLE 3-2

| Releasing Agent (RA) Dispersion | Resin (D) [parts by mass] D-1 | D-2 | D-3 | D-4 | D-5 | D-6 | D-7 |
|---|---|---|---|---|---|---|---|
| 1 | 33 | — | — | — | — | — | — |
| 2 | — | 33 | — | — | — | — | — |
| 3 | — | — | 33 | — | — | — | — |
| 4 | — | — | — | 33 | — | — | — |
| 5 | — | — | — | — | 33 | — | — |
| 6 | — | — | — | — | — | 33 | — |
| 7 | 16.5 | — | — | — | — | — | — |
| 8 | 1.98 | — | — | — | — | — | — |
| 9 | 66 | — | — | — | — | — | — |
| 10 | 82.5 | — | — | — | — | — | — |
| 11 | 33 | — | — | — | — | — | — |
| 12 | — | 33 | — | — | — | — | — |
| 13 | — | — | 33 | | — | — | — |
| 14 | — | — | — | 33 | — | — | — |
| 15 | 33 | — | — | — | — | — | — |
| 16 | — | 33 | — | — | — | — | — |
| 17 | — | — | 33 | — | — | — | — |
| 18 | — | — | — | 33 | — | — | — |
| 19 | 33 | — | — | — | — | — | — |
| 20 | — | 33 | — | — | — | — | — |
| 21 | — | — | 33 | — | — | — | — |
| 22 | — | — | — | 33 | — | — | — |
| 23 | — | — | — | — | — | — | — |
| 24 | 33 | — | — | — | — | — | — |
| 25 | — | — | — | — | — | — | 33 |
| 26 | 33 | — | — | — | — | — | — |
| 27 | — | — | — | — | — | — | — |
| 28 | 33 | — | — | — | — | — | — |
| 29 | 33 | — | — | — | — | — | — |

TABLE 4-1

| Releasing Agent (RA) Dispersion | Releasing agent (RA) [parts by mass] Carnauba wax (WA-05) | Synthetic ester wax (WEP-5) | Synthetic ester wax (WEP-3) | Paraffin wax (HNP-09) | Low-molecular-weight polyethylene (HI-WAX 200P) |
|---|---|---|---|---|---|
| 1 | 33 | — | — | — | — |
| 2 | 33 | — | — | — | — |
| 3 | 33 | — | — | — | — |
| 4 | 33 | — | — | — | — |
| 5 | 33 | — | — | — | — |
| 6 | 33 | — | — | — | — |
| 7 | 33 | — | — | — | — |
| 8 | 33 | — | — | — | — |
| 9 | 33 | — | — | — | — |
| 10 | 33 | — | — | — | — |
| 11 | — | 33 | — | — | — |
| 12 | — | 33 | — | — | — |
| 13 | — | 33 | — | — | — |
| 14 | — | 33 | — | — | — |
| 15 | — | — | — | 33 | — |
| 16 | — | — | — | 33 | — |
| 17 | — | — | — | 33 | — |
| 18 | — | — | — | 33 | — |
| 19 | — | — | 33 | — | — |
| 20 | — | — | 33 | — | — |
| 21 | — | — | 33 | — | — |
| 22 | — | — | 33 | — | — |
| 23 | — | — | — | 100 | — |
| 24 | — | — | — | — | 33 |
| 25 | — | — | — | 33 | — |
| 26 | 33 | — | — | — | — |
| 27 | 33 | — | — | — | — |
| 28 | 33 | — | — | — | — |
| 29 | 33 | — | — | — | — |

TABLE 4-2

| Releasing Agent (RA) Dispersion | Mass ratio (D)/(RA) | Mass ratio (I)/(D) | Volume-average particle diameter (nm) | Capsule structure | Difference in SP value between Resin (D) and Releasing Agent (RA) |
|---|---|---|---|---|---|
| 1 | 1 | 2 | 150 | Yes | 1.6 |
| 2 | 1 | 2 | 150 | Yes | 1.5 |
| 3 | 1 | 2 | 150 | Yes | 1.6 |
| 4 | 1 | 2 | 150 | Yes | 1.2 |
| 5 | 1 | 2 | 150 | Yes | 1.5 |
| 6 | 1 | 2 | 150 | Yes | 1.2 |
| 7 | 0.5 | 4 | 140 | Yes | 1.6 |
| 8 | 0.06 | 34 | 130 | Yes | 1.6 |
| 9 | 2 | 1 | 160 | Yes | 1.6 |
| 10 | 2.5 | 0.8 | 170 | Yes | 1.6 |
| 11 | 1 | 2 | 150 | Yes | 1.2 |
| 12 | 1 | 2 | 150 | Yes | 1.1 |
| 13 | 1 | 2 | 150 | Yes | 1.2 |
| 14 | 1 | 2 | 150 | Yes | 0.8 |
| 15 | 1 | 2 | 150 | Yes | 1.8 |
| 16 | 1 | 2 | 150 | Yes | 1.7 |
| 17 | 1 | 2 | 150 | Yes | 1.8 |
| 18 | 1 | 2 | 150 | Yes | 1.4 |
| 19 | 1 | 2 | 150 | Yes | 1.5 |
| 20 | 1 | 2 | 150 | Yes | 1.4 |
| 21 | 1 | 2 | 150 | Yes | 1.5 |
| 22 | 1 | 2 | 150 | Yes | 1.1 |
| 23 | — | — | — | No | — |
| 24 | 1 | 2 | 150 | Yes | 1.7 |
| 25 | 1 | 2 | 150 | Yes | 2.1 |
| 26 | 1 | — | | No | 1.6 |
| 27 | | — | | No | — |
| 28 | 1 | 2 | 240 | Yes | 1.6 |
| 29 | 1 | 2 | 255 | Yes | 1.6 |

Synthesis Example D-1

Synthesis of Prepolymer 1

A reactor equipped with a cooling tube, a stirrer and a nitrogen inlet tube was charged with 682 parts of 2-mole ethylene oxide adduct of bisphenol A, 81 parts of 2-mole propylene oxide adduct of bisphenol A, 283 parts of terephthalic acid, 22 parts of trimellitic anhydride and 2 parts of dibutyltin oxide, which was reacted under a normal pressure and at 230° C. for 8 hours. Next, it was reacted for 5 hours under a reduced pressure of 10 mmHg to 15 mmHg, and [Intermediate Polyester 1] having a number average molecular weight of 2,100, a weight-average molecular weight of 9,500, a glass transition temperature of 55° C., an acid value of 0.5, and a hydroxyl value of 49 was obtained.

Next, a reactor equipped with a cooling tube, a stirrer and a nitrogen inlet tube was charged with 411 parts of obtained [Intermediate Polyester 1], 89 parts of isophorone diisocyanate, and 500 parts of ethyl acetate, which was reacted at 100° C. for 5 hours, and [Prepolymer 1] having free isocyanates of to 1.53% by mass was obtained.

Synthesis Example E-1

Synthesis of Crystalline Polyester Resin (C)-1

A reactor equipped with a cooling tube, a stirrer and a nitrogen inlet tube was charged with 353 parts of 1,10-decanediol, 289 parts of adipic acid, and 0.8 parts of dibutyltin oxide, which was reacted under a normal pressure and at is 180° C. for 6 hours. Next, it was reacted for 4 hours under a reduced pressure of 10 mmHg to 15 mmHg, and [Crystalline Polyester Resin (C)-1] was synthesized. Obtained [Crystalline Polyester Resin (C)-1] had a Mn of 14,000, a Mw of 33,000, an SP value of 10.3, and a melting point of 65° C., and an endothermic quantity thereof showed a maximum value at the melting point.

Synthesis Example E-2

Synthesis of Urethane-Modified Crystalline Polyester Resin (C)-2

A reactor equipped with a cooling tube, a stirrer and a nitrogen inlet tube was charged with 202 parts by mass (1.00 mol) of sebacic acid, 189 parts by mass (1.60 mol) of 1,6-hexanediol, and 0.5 parts by mass of dibutyltin oxide as a polycondensation catalyst, which was reacted at 180° C. for 8 hours under a stream of nitrogen while distilling generated water. Next, it was reacted 4 hours under a stream of nitrogen while gradually elevating the temperature to 220° C. and distilling generated water and 1,6-hexanediol. It was further reacted under a reduced pressure of 5 mmHg to 20 mmHg until a Mw reached to about 7,000, and thereby [Crystalline Polyester Resin (C')-2] was obtained. Obtained [Crystalline Polyester Resin (C')-2] had a Mw of 7,000.

Next, obtained [Crystalline Polyester Resin (C')-2] was transferred to a reactor with a cooling tube, a stirrer and a nitrogen inlet tube, and it was reacted under a stream of nitrogen at 80° C. for 5 hours with an addition of 300 parts by mass of ethyl acetate and 38 parts by mass (0.15 mol) of 4,4'-diphenyhnlmethane diisocyanate (MIDI). Then, ethyl acetate was distilled under a reduced pressure, and [Urethane-Modified Crystalline Polyester Resin (C)-2] was obtained. Obtained [Urethane-Modified Crystalline Polyester Resin (C)-2] had a Mw of 15,000, an SP value of 10.5, and a melting point of 65° C., and an endothermic quantity thereof showed a maximum value at the melting point.

Synthesis Example E-3

Synthesis of Crystalline Resin Precursor (C)-3

A reactor equipped with a cooling tube, a stirrer and a nitrogen inlet tube was charged with 202 parts by mass (1.00 mol) of sebacic acid, 122 parts by mass (1.03 mol) of 1,6-hexanediol, and 0.5 parts by mass of titanium dihydroxybis (triethanolaminate) as a polycondensation catalyst, which was reacted at 180° C. for 8 hours under a stream of nitrogen while distilling generated water. Then, it was reacted for 4 hours under a stream of nitrogen while gradually elevating the temperature to 220° C. and distilling generated water and 1,6-hexanediol. It was further reacted under a reduced pressure of 5 mmHg to 20 mmHg until a Mw reached to about 25,000.

Obtained [Crystalline Resin] was transferred to a reactor equipped with a cooling tube, a stirrer and a nitrogen inlet tube, and it was reacted under a stream of nitrogen at 80° C. for 5 hours with an addition of 300 parts by mass of ethyl acetate and 27 parts by mass (0.16 mol) of hexamethylene diisocyanate (HDI), and a 50-% by mass ethyl acetate solution of [Crystalline Resin Precursor (C)-3] having an isocyanate group at an end thereof was obtained.

Then, 10 parts by mass of the obtained ethyl acetate solution of [Crystalline Resin Precursor (C)-3] was mixed with 10 parts by mass of tetrahydrofuran (THF). This was stirred for 2 hours with an addition of 1 part by mass of dibutylamine. A GPC measurement was carried out with the obtained solution as a sample, and from a result thereof, [Crystalline Resin Precursor (C)-3] had a Mw of 53,000. Also, a DSC measurement was carried out with a sample obtained by removing the solvent from the solution. From a result thereof, [Crystalline Resin Precursor (C)-3] had a melting point of 57° C., and an endothermic quantity thereof showed a maximum value at the melting point.

Synthesis Example F-1

Synthesis of [Masterbatch 1]

First, 40 parts of carbon black, 60 parts of [Polyester Resin (R)-1], 30 parts of water were mixed with a HENSCHEL mixer, and a mixture of water soaked into a pigment agglomerate was obtained. This was kneaded for 45 min with a two-roll mill with a roll surface temperature set at 130° C. and then pulverized with a pulverizer to a size of 1 mm, and [Masterbatch 1] was obtained.

Example 1

<Dispersion Step>

—Oil-Phase Preparation Process—

A reactor equipped with a stirring rod and a thermometer was charged with 545 parts of [Polyester Resin (R)-1], 181 parts of [Crystalline Polyester Resin (A)-1], and 1,450 parts of ethyl acetate. The reactor was heated to 80° C. with stirring and maintained at 80° C. for 5 hours, and then it was cooled to 30° C. over 1 hour. Next, the reactor was charged with 500 parts of [Masterbatch 1] and 100 parts of ethyl acetate, which was mixed for 1 hour, and [Raw-Material Solution 1] was obtained. Then, 1,500 parts of [Raw-Material Solution 1] was transferred to a reactor, and using a bead mill (ULTRAVISCO MILL, manufactured by Aimex Co., Ltd.) packed by 80% by volume with 0.5-mm zirconia beads, [Masterbatch 1] and [Crystalline Polyester Resin (A)-1] were dispersed by running 3 passes under the conditions of a liquid feed rate of 1 kg/hour and a peripheral speed of a disk of 6 m/second. Next, 655 parts of 66-% ethyl acetate solution of [Polyester Resin (R)-1] was added, and by running 1 pass under the above conditions, [Pigment-Crystalline Polyester Dispersion-1] was obtained. After 976 parts of [Pigment-Crystalline Polyester Dispersion-1] and 2.6 parts of isophoronediamine were mixed for 1 min with a mixing stirrer (TK HOMOMIXER, manufactured by Primix Corporation) at 5,000 rpm, it was further mixed for 1 min at 8,000 rpm with an addition of 596 parts of [Releasing Agent (RA) Dispersion-1]. Then, it was mixed for 1 min with TK HOMOMIXER at a rotational speed of 5,000 rpm with an addition of 88 parts of [Prepolymer 1], and [Oil Phase 1] was obtained.

—Aqueous-Phase Preparation Process—

[Aqueous Phase 1] was obtained by mixing and stirring 970 parts of ion-exchanged water, 40 parts of a 25-% aqueous dispersion of organic resin fine particles (a copolymer of styrene-methacrylic acid-butyl acrylate-sodium salt of sulfate of ethylene oxide adduct of methacrylic acid of methacrylic acid) as a dispersion stabilizer, 95 parts of a 48.5-% aqueous solution of sodium dodecyl diphenyl ether disulfonate, and 98 parts of ethyl acetate.

—Oil-Droplet Dispersion Preparation Process—

To [Oil Phase 1] obtained in the oil-phase preparation process, 1,100 parts of [Aqueous Phase 1] obtained in the aqueous-phase preparation process was added. This was mixed for 2 min with TK HOMOMIXER while adjusting a rotational speed thereof in a range of 8,000 rpm to 15,000 rpm and adjusting a liquid temperature thereof in a range of 20° C. to 23° C. by cooling in a water bath to suppress a temperature increase due to shear heat of the mixer, and then it was stirred for 10 min with a stirrer equipped with anchor blades (THREE-ONE MOTOR) while adjusting a rotational speed thereof in a range of 130 rpm to 350 rpm. Thereby, [Particles Slurry 1] in which oil droplets (droplets of the oil phase) were dispersed in the aqueous phase was obtained.

<Desolvation Process>

A reactor equipped with a stirrer and a thermometer was charged with [Particles Slurry 1], which was subjected to desolvation with stirring at 30° C. for 8 hours, and [Dispersion Slurry 1] was obtained.

<Washing Step and Drying Step>

After 100 parts of [Dispersion Slurry 1] was subjected to vacuum filtration, operations described in (1) to (4) below were carried out, and [Toner 1] was obtained.

(1) To a filter cake, 100 parts of ion-exchanged water was added, which was mixed with TK HOMOMIXER at a rotational speed of 12,000 rpm for 10 min, followed by filtration.

(2) To the filter cake after filtrating in (1), 900 parts of ion-exchanged water was added, to which ultrasonic vibration was applied. It was then mixed with TK HOMOMIXER at a rotational speed of 12,000 rpm for 30 min, followed by vacuum filtration, and a slurry liquid was obtained again (reslurry liquid). This operation was repeated so that this reslurry liquid had an electrical conductivity of 10 μC/cm or less.

(3) 10-% hydrochloric acid was added such that the reslurry liquid of (2) had a pH of 4, and it was stirred with THREE-ONE MOTOR for 30 min, followed by filtration.

(4) To the filter cake after filtrating in (3), 100 parts of ion-exchanged water was added, which was mixed with TK HOMOMIXER at a rotational speed of 12,000 rpm for 10 min, followed by filtration, and a reslurry liquid was obtained. This operation was repeated so that this reslurry liquid had an electrical conductivity of 10 μC/cm or less, and [Filter Cake 1] was obtained.

[Filter Cake 1] was dried in a wind dryer at 32° C. for 48 hours and sieved with a mesh having openings of 75 μm, and [Toner Base Particles 1] having a volume-average particle diameter (Dv) of 6.2 μm and a ratio of volume-average particle diameter (Dv)/number-average particle diameter (Dn) of 1.13 was obtained. Next, to 100 parts of this [Toner Base Particles 1], 0.5 parts of hydrophobic silica and 0.5 parts of hydrophobic titanium oxide were added, which was mixed in a mixer (HENSCHEL mixer, manufactured by Mitsui Miike Machinery Co., Ltd.), and [Toner 1] was obtained.

Examples 2 to 24 and 26, Comparative Examples 1 to 3 and 5

[Toner 2] to [Toner 29] were obtained in the same manner as Example 1 except that [Releasing Agent (RA) Dispersion-1] in Example 1 was changed to [Releasing Agent (RA) Dispersion-2] to [Releasing Agent (RA) Dispersion-29] as shown in Table 1 below.

Example 25

<Dispersion Step>

—Oil-Phase Preparation Process—

A reactor equipped with a stirring rod and a thermometer was charged with 726 parts of [Polyester Resin (R)-1] above and 1,450 parts of ethyl acetate. The reactor was heated to 80° C. with stirring and maintained at 80° C. for 5 hours, and it was cooled to 30° C. over 1 hour. Next, the reactor was charged with 500 parts of [Masterbatch 1] and 100 parts of ethyl acetate, which was mixed for 1 hour, and [Raw-Material Solution 2] was obtained. Then, 1,500 parts of [Raw-Material Solution 2] was transferred to a reactor, and using a bead mill (ULTRA VISCO MILL, manufactured by Aimex Co., Ltd.) packed by 80% by volume with 0.5-mm zirconia beads, [Masterbatch 1] was dispersed by running 3 passes under the conditions of a liquid feed rate of 1 kg/hour and a peripheral speed of a disk of 6 m/second. Next, 655 parts of 66-% ethyl acetate solution of [Polyester Resin (R)-1] was added, and by running 1 pass under the above conditions, [Pigment-Polyester Dispersion-2] was obtained. After 976 parts of [Pigment-Polyester Dispersion-2] and 2.6 parts of isophoronediamine were mixed in a mixing stirrer (TK HOMOMIXER, manufactured by Primix Corporation) at 5,000 rpm for 1 min, it was further mixed for 1 min at 8,000 rpm with an addition of 596 parts of [Releasing Agent (RA) Dispersion-1]. Then, it was mixed for 1 min with TK HOMOMIXER at a rotational speed of 5,000 rpm with an addition of 88 parts of [Prepolymer 1], and [Oil Phase 2] was obtained.

—Oil-Droplet Dispersion Preparation Process—

To [Oil Phase 2] obtained in the oil-phase preparation process, 1,100 parts of [Aqueous Phase 1] obtained in the aqueous-phase preparation process was added. This was mixed for 2 min while adjusting a rotational speed thereof in a range of 8,000 rpm to 15,000 rpm and adjusting a liquid temperature thereof in a range of 20° C. to 23° C. by cooling in a water bath to suppress a temperature increase due to shear heat of the mixer, and then it was stirred for 10 min with a stirrer equipped with anchor blades (THREE-ONE MOTOR) while adjusting a rotational speed thereof in a range of 130 rpm to 350 rpm. Thereby, [Particles Slurry 2] in which oil droplets (droplets of the oil phase) were dispersed in the aqueous phase was obtained.

<Desolvation Process>

A reactor equipped with a stirrer and a thermometer was charged with [Particles Slurry 2], which was subjected to desolvation with stirring at 30° C. for 8 hours, and [Dispersion Slurry 2] was obtained.

<Washing Step and Drying Step>

After 100 parts of [Dispersion Slurry 2] was subjected to vacuum filtration, operations described in (1) to (4) below were carried out, and [Toner 28] was obtained.

(1) To a filter cake, 100 parts of ion-exchanged water was added, which was mixed with TK HOMOMIXER at a rotational speed of 12,000 rpm for 10 min, followed by filtration.

(2) To the filter cake after filtrating in (1), 900 parts of ion-exchanged water was added, to which ultrasonic vibration was applied. It was then mixed with TK HOMOMIXER at a rotational speed of 12,000 rpm for 30 min, followed by vacuum filtration, and a slurry liquid was obtained again (reslurry liquid). This operation was repeated so that this reslurry liquid had an electrical conductivity of 10 μC/cm or less.

(3) 10-% hydrochloric acid was added such that the reslurry liquid of (2) had a pH of 4, and it was stirred with THREE-ONE MOTOR for 30 min, followed by filtration.

(4) To the filter cake after filtrating in (3), 100 parts of ion-exchanged water was added, which was mixed with TK HOMOMIXER at a rotational speed of 12,000 rpm for 10 min, followed by filtration, and a reslurry liquid was obtained. This operation was repeated so that this reslurry liquid had an electrical conductivity of 10 μC/cm or less, and [Filter Cake 2] was obtained.

[Filter Cake 2] was dried in a wind dryer at 32° C. for 48 hours and sieved with a mesh having openings of 75 μm, and [Toner Base Particles 28] having a volume-average particle diameter (Dv) of 5.6 μm and a ratio of volume-average particle diameter (Dv)/number-average particle diameter (Dn) of 1.12 was obtained. Next, to 100 parts of this [Toner Base Particles 28], 0.5 parts of hydrophobic silica and 0.5 parts of hydrophobic titanium oxide were added, which was mixed in a mixer (HENSCHEL mixer, manufactured by Mitsui Miike Machinery Co., Ltd.), and [Toner 30] was obtained.

Comparative Example 4

<Dispersion Step>

—Oil-Phase Preparation Process—

A reactor equipped with a stirring rod and a thermometer was charged with 904 parts of [Polyester Resin (R)-1], 181 parts of [Crystalline Polyester Resin (A)-1], 119 parts of a carnauba wax (melting point: 85° C.; WA-05, manufactured by Cerarica Noda Co., Ltd.) and 1,450 parts of ethyl acetate. The reactor was heated to 80° C. with stirring and maintained at 80° C. for 5 hours, and it was cooled to 30° C. over 1 hour. Next, the reactor was charged with 500 parts of [Masterbatch 1] and 100 parts of ethyl acetate, which was mixed for 1 hour, and [Raw-Material Solution 3] was obtained. Then, 1,500 parts of [Raw-Material Solution 3] was transferred to a reactor, and using a bead mill (ULTRA VISCO MILL, manufactured by Aimex Co., Ltd.) packed by 80% by volume of 0.5-mm zirconia beads, [Masterbatch 1], the crystalline polyester and the wax were dispersed by running 3 passes under the conditions of a liquid feed rate of 1 kg/hour and a peripheral speed of a disk of 6 m/second. Next, 655 parts of 66-% ethyl acetate solution of [Polyester Resin (R)-1] was added, and by running 1 pass under the above conditions, [Pigment-Wax-Crystalline Polyester Dispersion-3] was obtained. After 976 parts of [Pigment-Wax-Crystalline Polyester Dispersion-3] and 2.6 parts of isophoronediamine were mixed in a mixing stirrer (TK HOMOMIXER, manufactured by Primix Corporation) at 5,000 rpm for 1 min, it was further mixed for 1 min with TK HOMOMIXER at a rotational speed of 5,000 rpm with an addition of 88 parts of [Prepolymer 1], and [Oil Phase 3] was obtained.

—Oil-Droplet Dispersion Preparation Process—

To [Oil Phase 3] obtained in the oil-phase preparation process, 1,100 parts of [Aqueous Phase 1] obtained in the aqueous-phase preparation process was added. This was mixed for 2 min while adjusting a rotational speed thereof in a range of 8,000 rpm to 15,000 rpm and adjusting a liquid temperature thereof in a range of 20° C. to 23° C. by cooling in a water bath to suppress a temperature increase due to shear heat of the mixer, and then it was stirred for 10 min with a stirrer equipped with anchor blades (THREE-ONE MOTOR) while adjusting a rotational speed thereof in a range of 130 rpm to 350 rpm. Thereby, [Particles Slurry 3] in which oil droplets (droplets of the oil phase) were dispersed in the aqueous phase was obtained.

<Desolvation Process>

A reactor equipped with a stirrer and a thermometer was charged with is [Particles Slurry 3], which was subjected to desolvation with stirring at 30° C. for 8 hours, and [Dispersion Slurry 3] was obtained.

<Washing Step and Drying Step>

After 100 parts of [Dispersion Slurry 3] was subjected to vacuum filtration, operations described in (1) to (4) below were carried out, and [Toner 29] was obtained.

(1) To a filter cake, 100 parts of ion-exchanged water was added, which was mixed with TK HOMOMIXER at a rotational speed of 12,000 rpm for 10 min, followed by filtration.

(2) To the filter cake after filtrating in (1), 900 parts of ion-exchanged water was added, to which ultrasonic vibration was applied. It was then mixed with TK HOMOMIXER at a rotational speed of 12,000 rpm for 30 min, followed by vacuum filtration, and a slurry liquid was obtained again (reslurry liquid). This operation was repeated so that this reslurry liquid had an electrical conductivity of 10 μC/cm or less.

(3) 10-% hydrochloric acid was added such that the reslurry liquid of (2) had a pH of 4, and it was stirred with THREE-ONE MOTOR for 30 min, followed by to filtration.

(4) To the filter cake after filtrating in (3), 100 parts of ion-exchanged water was added, which was mixed with TK HOMOMIXER at a rotational speed of 12,000 rpm for 10 min, followed by filtration, and a reslurry liquid was obtained. This operation was repeated so that this reslurry liquid had an electrical conductivity of 10 μC/cm or less, and [Filter Cake 3] was obtained.

[Filter Cake 3] was dried in a wind dryer at 32° C. for 48 hours and sieved with a mesh having openings of 75 μm, and [Toner Base Particles 31] having a volume-average particle diameter (Dv) of 5.4 μm and a ratio of volume-average particle diameter (Dv)/number-average particle diameter (Dn) of 1.13 was obtained. Next, to 100 parts of this [Toner Base Particles 31], 0.5 parts of hydrophobic silica and 0.5 parts of hydrophobic titanium oxide were added, which was mixed in a mixer (HENSCHEL mixer, manufactured by Mitsui Miike Machinery Co., Ltd), and [Toner 31] was obtained.

Example 27

<Dispersion Step>

—Oil-Phase Preparation Process—

A reactor equipped with a thermometer and a stirrer was charged with 100 parts of [Crystalline Polyester Resin C-1] and 100 parts of ethyl acetate, which was heated to 50° C. and stirred to prepare a homogeneous phase, and [Resin Solution 1] was obtained.

<Preparation of Colorant Dispersion>

In a beaker, 20 parts of carbon black, 4 parts of a colorant dispersant (SOLSPERSE 28000, manufactured by Avecia Inc.) and 76 parts of ethyl acetate were placed and homogeneously dispersed by stirring. Then, the carbon black was finely dispersed with a bead mill, and [Colorant Dispersion-1] was obtained. [Colorant Dispersion-1] was measured with a particles diameter measurement apparatus LA-920 (manufactured by Horiba Ltd.), and a volume-average particle diameter thereof was 0.3 μm.

In a beaker, 75 parts of [Resin Solution 1] and 12.5 parts of [Colorant Dispersion-1] were placed, which was stirred at 50° C. with TK HOMOMIXER at 8,000 rpm for homogeneous dissolution and dispersion, and [Oil Phase 4] was obtained.

—Aqueous-Phase Preparation Process—

In a beaker, 200 parts of ion-exchanged water, 6 parts of 25-% aqueous dispersion of organic resin fine particles (a copolymer of styrene-butyl acrylate-sodium salt of sulfate of ethylene oxide adduct of methacrylic acid) for stable dispersion, 1 part of sodium carboxymethyl cellulose, and 30 parts of a 48.5-% aqueous solution of sodium dodecyl diphenyl ether disulfonate ("Eleminol MON-7", manufactured by Sanyo Chemical Industries, Ltd.) were placed and homogeneously dissolved, and [Aqueous Phase 4] was obtained.

—Oil-Droplet Dispersion Preparation Process—

Next, 75 parts of [Oil Phase 4] was fed in [Aqueous Phase 4] stirred at 50° C. with TK HOMOMIXER at 10,000 rpm, which was stirred for 2 min, and [Slurry 1] was obtained.

<Introduction of Releasing Agent Dispersion>

First, 15 parts of [Releasing Agent (RA) Dispersion-15] was diluted with 25 parts of ion-exchanged water, and it was dropped over 3 min in [Slurry 1] being stirred at 50° C. using THREE-ONE MOTOR at 400 rpm, and the stirring continued for 20 min. Thereafter, a small amount of a slurry sample was collected and diluted with water in an amount of 10 times, which was centrifuged using a centrifuge. Then, toner base particles were precipitated at a bottom of a test tube, and supernatant solution was almost transparent.

Thereby, [Slurry 2] was obtained.

<Desolvation Process>

A container equipped with a stirrer and a thermometer was charged with [Slurry 2], which was subjected to desolvation at 50° C. for 1 hour, and [Dispersion Slurry 1] was obtained.

<Washing Step and Drying Step>

After 100 parts of [Dispersion Slurry 1] was subjected to vacuum filtration, operations described in (1) to (4) below were carried out.

(1): To a filter cake, 100 parts of ion-exchanged water was added, which was mixed with TK HOMOMIXER (at a rotational speed of 12,000 rpm for 10 min), followed by filtration.

(2): To the filter cake of (1), 100 parts of ion-exchanged water was added, to which ultrasonic vibration was applied. It was then mixed with TK HOMOMIXER (at a rotational speed of 12,000 rpm for 30 min), followed by vacuum filtration. This operation was repeated so that this reslurry liquid had an electrical conductivity of 10 μC/cm or less.

(3): 10-% hydrochloric acid was added such that the reslurry liquid of (2) had a pH of 4, and it was stirred with THREE-ONE MOTOR for 30 min, followed by filtration.

(4): To the filter cake of (3), 100 parts of ion-exchanged water was added, which was mixed with TK HOMOMIXER (at a rotational speed of 12,000 rpm for 10 min), followed by filtration. This operation was repeated so that the reslurry liquid had an electrical conductivity of 10 μS/cm or less, and [Filter Cake 1] was obtained. Remaining [Dispersion Slurry 1] was washed in the same manner, and it was additionally mixed as [Filter Cake 1].

[Filter Cake 1] was dried in a wind dryer at 45° C. for 48 hours and sieved with a mesh having openings of 75 μm, and [Toner Base Particles 32] was obtained. To 100 parts of this [Toner Base Particles 32], 0.5 parts of hydrophobic silica and 0.5 parts of hydrophobic titanium oxide were added, which was mixed with in a mixer (HENSCHEL mixer, manufactured by Mitsui Miike Machinery Co., Ltd.), and [Toner 32] was obtained.

Example 28

[Toner 33] was obtained in the same manner as Example 27 except that [Releasing Agent Dispersion-15] in Example 27 was changed to [Releasing Agent Dispersion-19].

Example 29

[Toner 34] was obtained in the same manner as Example 27 except that [Crystalline Polyester Resin (C)-1] in Example 27 was changed to 70 parts of [Urethane-Modified Crystalline Polyester Resin (C)-2] and 30 parts of [Crystalline Resin Precursor (C)-3].

Example 30

[Toner 35] was obtained in the same manner as Example 28 except that [Crystalline Polyester Resin (C)-1] in Example 28 was changed to 70 parts of [Urethane-Modified Crystalline Polyester Resin (C)-2] and 30 parts of [Crystalline Resin Precursor (C)-3].

<Evaluation Methods>

By the methods described below, [Toner 1] to [Toner 35] prepared in Examples 1 to 30 and Comparative Examples 1 to 5 were evaluated for their heat-resistant storage stability (1), heat-resistant storage stability (2), low-temperature fixing property (1), low-temperature fixing property (2), hot-offset resistance (1) and hot-offset resistance (2), and based on these evaluation results, overall evaluations were made. Results are shown in Table 6-1 and Table 6-2 below. Also, the toners are summarized in Table 5-1, Table 5-2 and Table 5-3. In Table 5-3, one having a capsule structure is indicated by "Yes", and one having no capsule structure is indicated by "No".

Also, a ratio (%) of the releasing agent-encapsulating capsule or fine particles of the releasing agent, or both thereof existing in a region from a surface of the toner to a depth of 0.10 times a volume-average particle diameter of the toner was measured by a method described below. Results are shown in Table 5-3.

Each toner was embedded and cured in an epoxy resin curable at a normal temperature, to thereby prepare a block. The prepared block was sliced into a slice of the toner having a thickness of 80 nm with an ultramicrotome having diamond teeth (ULTRACUT-S, manufactured by Leica Microsystems Ltd.), and, and the slice was stained with ruthenium tetroxide. This was observed with a scanning transmission electron microscope (STEM). From a cross-sectional image of the toner obtained, a ratio (% by area) of the releasing agent-encapsulating capsule and the fine particles of the releasing agent existing in a predetermined region (that is, the region from a surface of the toner to a depth of 0.10 times a volume-average particle diameter of the toner) was calculated. For the measurements of the ratio (% by area) of the releasing agent-encapsulating capsule and the fine particles of the releasing agent and the depth from the toner surface, a particle size distribution analysis software (Mac-View, manufactured by Mountech Co., Ltd.) was used. Among the cross-sectional images of the toner observed, 100 cross-sectional images of the toner which has a diameter within ±10% of the volume-average particle diameter of the toner were selected as a cross-sectional image through a center of gravity of the toner. Then, in each cross-sectional image of the toner, the ratio (% by area) of the releasing agent-encapsulating capsule and the fine particles of the releasing agent existing in the region from a surface of the toner to a depth of 0.10 times a volume-average particle diameter of the toner was obtained, and an average of 100 cross-sectional images of the toner. This is shown in Table 5-3.

Here, low-temperature fixing property (1), low-temperature fixing property (2), hot-offset resistance (1) and hot-offset resistance (2) were evaluated using a remodeled laser printer of IPSIO SP C220, manufactured by Ricoh Company, Ltd., in which a fixing unit had been removed so that an image before fixing may be taken out, and the removed fixing unit had been modified so that a temperature on a fixing roller and system speed may be arbitrarily changed externally —Evaluation of Heat-Resistant Storage Stability (1)—

First, 20 g of each toner was placed in a 20-mL glass bottle, which was allowed to stand in a thermostatic bath at 55° C. for 24 hours. Thereafter, this toner was cooled to 24° C. and measured for penetration by a penetration test according to JIS K2235-1991, and heat-resistant storage stability was evaluated based on the following evaluation criteria.

A larger value of penetration indicates superior storage stability of the toner against heat. Here, a toner with penetration of less than 10 mm is likely to have problems on the use.

[Evaluation Criteria]

A: 20 mm or greater

B: 15 mm to less than 20 mm

C: 10 mm to less than 15 mm

D: less than 10 mm

—Evaluation of Heat-Resistant Storage Stability (2)—

First, 20 g of each toner was placed in a 20-mL glass bottle, which was allowed to stand in a thermostatic bath at 55° C. for 24 hours with a load of 1 kg applied on the glass bottle. Thereafter, this toner was cooled to 24° C. and measured for penetration by a penetration test according to JIS K2235-1991, and heat-resistant storage stability was evaluated based on the following evaluation criteria.

A larger value of penetration indicates superior storage stability of the toner against heat. Here, a toner with penetration of less than 10 mm is likely to have problems on the use.

[Evaluation Criteria]

A: 20 mm or greater

B: 15 mm to less than 20 mm

C: 10 mm to less than 15 mm

D: less than 10 mm

—Evaluation of Low-Temperature Fixing Property (1)—

Each toner was mounted on the remodeled laser printer (IPSIO SP C220), a non-fixed solid image of a 40-mm square was printed on transfer paper (TYPE 6200 short-grain paper, manufactured by Ricoh Company, Ltd.) with an adhered amount of the toner of 8 g/m$^2$, and 19 sheets of such were prepared. Next, the prepared non-fixed solid image was fed to the remodeled fixing unit with the system speed set at 350 mm/second, and the image was fixed. The test was carried out with the fixing temperature varied from 120° C. to 200° C. with increments of 5° C.

Regarding the fixed image, using a drawing tester (AD-401, manufactured by Ueshima Seisakusho Co., Ltd.), a sapphire needle was allowed to run while it was in contact with a central portion of the fixed image with the following conditions: sapphire needle: 125 μR; needle rotation diameter: 8 mm, and a load: 1 g, and a running surface of a tip of the sapphire needle was visually observed. At this time, a scratch by the sapphire needle was clearly recognized as white dots beyond a certain temperatures. A temperature just before the scratch recognized as white dots (minimum temperature) was regarded as a minimum fixing temperature, low-temperature fixing property was evaluated based on the following evaluation criteria.

[Evaluation Criteria]

AA: The minimum fixing temperature was 110° C. or less.

AB: The minimum fixing temperature exceeded 110° C. and 120° C. or less.

A: The minimum fixing temperature exceeded 120° C. and 130° C. or less.

B: The minimum fixing temperature exceeded 130° C. and 140° C. or less.

C: The minimum fixing temperature exceeded 140° C. and 155° C. or less.

D: The minimum fixing temperature exceeded 155° C.

—Evaluation of Low-Temperature Fixing Property (2)—

Evaluation of low-temperature fixing property (2) was carried out in the same manner as Evaluation of low-temperature fixing property (1) except that the system speed of 350 mm/second in Evaluation of low-temperature fixing property (1) was changed to 800 mm/second and that the evaluation criteria were changed to the evaluation criteria below.

[Evaluation Criteria]

AA: The minimum fixing temperature was 120° C. or less.

AB: The minimum fixing temperature exceeded 120° C. and 130° C. or less.

A: The minimum fixing temperature exceeded 130° C. and 140° C. or less.

B: The minimum fixing temperature exceeded 140° C. and 150° C. or less.

C: The minimum fixing temperature exceeded 150° C. and 165° C. or less.

D: The minimum fixing temperature exceeded 165° C.

—Evaluation of Hot-Offset Resistance (1)—

Each toner was mounted on the remodeled laser printer (IPSIO SP C220), a non-fixed solid image of a 40-mm square was printed on transfer paper (TYPE 6200 short-grain paper, manufactured by Ricoh Company, Ltd.) with an adhered amount of the toner of 8 g/m$^2$, and 19 sheets of such were prepared. Next, the prepared non-fixed solid image was fed to the remodeled fixing unit with the system speed set at 350 mm/second, and the image was fixed. The test was carried out with the fixing temperature varied from 120° C. to 200° C. with increments of 5° C.

Regarding the fixed image, gloss of the fixed image was measured with a gloss meter (PG-1, manufactured by Nippon Denshoku Industries Co., Ltd.). A value of the gloss of the fixed image gradually increased as the fixing temperature increased, but the gloss decreased beyond a certain temperature, resulting in degraded image quality. The temperature just before the gloss started to decrease was regarded as a maximum fixing temperature, and hot-offset resistance was evaluated based on the following evaluation criteria.

[Evaluation Criteria]

A: The maximum fixing temperature was 200° C. or greater.

B: The maximum fixing temperature was 190° C. or greater and less than 200° C.

C: The maximum fixing temperature was 180° C. or greater and less than 190° C.

D: The maximum fixing temperature was less than 180° C.

—Evaluation of Hot-Offset Resistance (2)—

Evaluation of hot-offset resistance (2) was carried out in the same manner as Evaluation of hot-offset resistance (1) except that the system speed of 50 mm/second in Evaluation of hot-offset resistance (1) was changed to 800 mm/second. The evaluation criteria are the same as those in Evaluation of hot-offset resistance (1).

—Overall Evaluation—

In the evaluation results of heat-resistant storage stability (1), heat-resistant storage stability (2), low-temperature fixing property (1), low-temperature fixing property (2), hot-offset resistance (1) and hot-offset resistance (2), points were given for the grades as: 5 points for "AA"; 4 points for "AB"; 3 points for "A"; 2 points for "B"; 1 point, for "C"; and 0 points for "D", and overall evaluations were made based on the following criteria as well.

[Evaluation Criteria]

AA: There was no "D" grade in the evaluations, and a total of all the evaluation points was 21 points or greater.

AB: There was no "D" grade in the evaluations, and a total of all the evaluation points was 19 points or greater and less than 21 points.

A: There was no "D" grade in the evaluations, and a total of all the evaluation points was 16 points or greater and less than 19 points.

B: There was no "D" grade in the evaluations, and a total of all the evaluation points was 13 points or greater and less than 16 points.

C: There was no "D" grade in the evaluations, and a total of all the evaluation points was less than 13 points.

D: There was one or more "D" grade in any of the evaluations.

TABLE 5-1

| | Releasing agent (RA) dispersion | | | |
|---|---|---|---|---|
| | No. | Mass ratio (D)/(RA) | Average ester-group conc. (%) of Resin (D) | Melting point of releasing agent (RA) |
| Example 1 | 1 | 1 | 13.2 | 85 |
| Example 2 | 2 | 1 | 8.5 | 85 |
| Example 3 | 3 | 1 | 13.2 | 85 |
| Example 4 | 4 | 1 | 28.6 | 85 |
| Example 5 | 5 | 1 | 7.5 | 85 |
| Example 6 | 6 | 1 | 33.0 | 85 |
| Example 7 | 7 | 0.5 | 13.2 | 85 |
| Example 8 | 8 | 0.06 | 13.2 | 85 |
| Example 9 | 9 | 2 | 13.2 | 85 |
| Example 10 | 10 | 2.5 | 13.2 | 85 |
| Example 11 | 11 | 1 | 13.2 | 82 |
| Example 12 | 12 | 1 | 8.5 | 82 |
| Example 13 | 13 | 1 | 13.2 | 82 |
| Example 14 | 14 | 1 | 28.6 | 82 |
| Example 15 | 15 | 1 | 13.2 | 75 |
| Example 16 | 16 | 1 | 8.5 | 75 |
| Example 17 | 17 | 1 | 13.2 | 75 |
| Example 18 | 18 | 1 | 28.6 | 75 |
| Example 19 | 19 | 1 | 13.2 | 73 |
| Example 20 | 20 | 1 | 8.5 | 73 |
| Example 21 | 21 | 1 | 13.2 | 73 |
| Example 22 | 22 | 1 | 28.6 | 73 |

TABLE 5-1-continued

| | Releasing agent (RA) dispersion | | | |
|---|---|---|---|---|
| | No. | Mass ratio (D)/(RA) | Average ester-group conc. (%) of Resin (D) | Melting point of releasing agent (RA) |
| Example 23 | 24 | 1 | 13.2 | 122 |
| Comp. Ex. 1 | 23 | — | — | 75 |
| Example 24 | 25 | 1 | 13.2 | 75 |
| Comp. Ex. 2 | 26 | 1 | 13.2 | 85 |
| Comp. Ex. 3 | 27 | — | — | 85 |
| Example 25 | 1 | 1 | 1.0 | 85 |
| Comp. Ex. 4 | — | — | — | — |
| Example 26 | 28 | 1 | 13.2 | 85 |
| Comp. Ex. 5 | 29 | 1 | 13.2 | 85 |
| Example 27 | 15 | 1 | 13.2 | 75 |
| Example 28 | 19 | 1 | 13.2 | 73 |
| Example 29 | 15 | 1 | 13.2 | 75 |
| Example 30 | 19 | 1 | 13.2 | 73 |

TABLE 5-2

| | Toner | | | |
|---|---|---|---|---|
| | Volume-average particle diameter (Dv) [μm] | Number-average particle diameter (Dn) [μm] | Dv/Dn | Average sphericity |
| Example 1 | 6.2 | 5.5 | 1.13 | 0.98 |
| Example 2 | 6.1 | 5.4 | 1.13 | 0.98 |
| Example 3 | 5.4 | 4.8 | 1.13 | 0.98 |
| Example 4 | 5.2 | 4.7 | 1.11 | 0.98 |
| Example 5 | 5.5 | 4.9 | 1.12 | 0.98 |
| Example 6 | 5.4 | 4.9 | 1.10 | 0.98 |
| Example 7 | 5.6 | 5.0 | 1.12 | 0.98 |
| Example 8 | 5.8 | 5.2 | 1.12 | 0.98 |
| Example 9 | 6.0 | 5.3 | 1.13 | 0.98 |
| Example 10 | 5.2 | 4.6 | 1.13 | 0.98 |
| Example 11 | 5.4 | 4.8 | 1.13 | 0.98 |
| Example 12 | 5.5 | 4.9 | 1.12 | 0.98 |
| Example 13 | 5.8 | 5.1 | 1.14 | 0.98 |
| Example 14 | 6.0 | 5.3 | 1.13 | 0.98 |
| Example 15 | 5.8 | 5.2 | 1.12 | 0.98 |
| Example 16 | 5.6 | 5.0 | 1.12 | 0.98 |
| Example 17 | 5.7 | 5.1 | 1.12 | 0.98 |
| Example 18 | 5.6 | 4.9 | 1.14 | 0.98 |
| Example 19 | 5.8 | 5.1 | 1.14 | 0.98 |
| Example 20 | 6.0 | 5.3 | 1.13 | 0.98 |
| Example 21 | 6.1 | 5.4 | 1.13 | 0.98 |
| Example 22 | 5.9 | 5.2 | 1.13 | 0.98 |
| Example 23 | 5.2 | 4.6 | 1.13 | 0.98 |
| Comp. Ex. 1 | 5.0 | 4.5 | 1.11 | 0.98 |
| Example 24 | 5.1 | 4.6 | 1.11 | 0.98 |
| Comp. Ex. 2 | 5.4 | 4.8 | 1.13 | 0.98 |
| Comp. Ex. 3 | 5.5 | 4.9 | 1.12 | 0.98 |
| Example 25 | 5.6 | 5.0 | 1.12 | 0.98 |
| Comp. Ex. 4 | 5.4 | 4.8 | 1.13 | 0.98 |
| Example 26 | 6.3 | 5.5 | 1.15 | 0.98 |
| Comp. Ex. 5 | 6.2 | 5.4 | 1.15 | 0.98 |
| Example 27 | 5.8 | 5.1 | 1.14 | 0.98 |
| Example 28 | 5.8 | 5.0 | 1.16 | 0.98 |
| Example 29 | 5.9 | 5.2 | 1.13 | 0.98 |
| Example 30 | 5.8 | 5.1 | 1.14 | 0.98 |

TABLE 5-3

| | Toner Releasing agent (RA)-encapsulating capsule | | | | | |
|---|---|---|---|---|---|---|
| | Circle-equivalent diameter (nm) | Avg. thickness of capsules (nm) | Resin (I) (% by mass) | Resin (D) (% by mass) | Ratio* (% by number) | Capsule structure |
| Example 1 | 160 | 35 | 12.6 | 6.3 | 82 | Yes |
| Example 2 | 160 | 35 | 12.6 | 6.3 | 85 | Yes |
| Example 3 | 165 | 40 | 13.1 | 6.8 | 81 | Yes |
| Example 4 | 160 | 35 | 12.6 | 6.3 | 75 | Yes |
| Example 5 | 160 | 35 | 12.6 | 6.3 | 87 | Yes |
| Example 6 | 160 | 35 | 12.6 | 6.3 | 60 | Yes |
| Example 7 | 150 | 20 | 13.0 | 3.2 | 85 | Yes |
| Example 8 | 140 | 15 | 13.0 | 0.4 | 91 | Yes |
| Example 9 | 175 | 45 | 11.8 | 11.9 | 70 | Yes |
| Example 10 | 180 | 50 | 11.5 | 14.4 | 65 | Yes |
| Example 11 | 160 | 35 | 12.6 | 6.3 | 82 | Yes |
| Example 12 | 160 | 35 | 12.6 | 6.3 | 85 | Yes |
| Example 13 | 165 | 40 | 13.1 | 6.8 | 82 | Yes |
| Example 14 | 160 | 35 | 12.6 | 6.3 | 75 | Yes |
| Example 15 | 160 | 35 | 12.6 | 6.3 | 83 | Yes |
| Example 16 | 160 | 35 | 12.6 | 6.3 | 85 | Yes |
| Example 17 | 165 | 40 | 13.1 | 6.8 | 81 | Yes |
| Example 18 | 160 | 35 | 12.6 | 6.3 | 75 | Yes |
| Example 19 | 160 | 35 | 12.6 | 6.3 | 82 | Yes |
| Example 20 | 160 | 35 | 12.6 | 6.3 | 86 | Yes |
| Example 21 | 160 | 35 | 12.6 | 6.3 | 82 | Yes |
| Example 22 | 160 | 35 | 12.6 | 6.3 | 74 | Yes |
| Example 23 | 160 | 35 | 12.6 | 6.3 | 82 | Yes |
| Comp. Ex. 1 | 160 | 35 | — | — | — | No |
| Example 24 | 165 | 40 | 13.1 | 6.8 | 82 | Yes |
| Comp. Ex. 2 | — | — | — | — | 40 | No |
| Comp. Ex. 3 | — | — | — | — | 38 | No |
| Example 25 | 160 | 35 | 12.6 | 6.3 | 75 | Yes |
| Comp. Ex. 4 | — | — | — | — | 38 | No |
| Example 26 | 245 | 35 | 12.6 | 6.3 | 53 | Yes |
| Comp. Ex. 5 | 260 | 35 | 12.6 | 6.3 | 45 | Yes |
| Example 27 | 160 | 35 | 12.6 | 6.3 | 87 | Yes |
| Example 28 | 160 | 35 | 12.6 | 6.3 | 86 | Yes |
| Example 29 | 160 | 35 | 12.6 | 6.3 | 85 | Yes |
| Example 30 | 160 | 35 | 12.6 | 6.3 | 85 | Yes |

*Ratio: Ratio of capsules or releasing agent fine particles existing in region from surface of toner to depth of 0.10 times volume-average particle diameter of toner (% by number)

TABLE 6-1

| | Evaluation | | | |
|---|---|---|---|---|
| | Heat-resistant storage stability | | Low-temperature fixing property | |
| | No pressurization | With pressurization | System speed 350 mm/sec | System speed 800 mm/sec |
| Example 1 | A | A | A | A |
| Example 2 | B | B | A | A |
| Example 3 | A | B | A | A |
| Example 4 | B | B | B | A |
| Example 5 | C | B | B | A |
| Example 6 | C | B | C | C |
| Example 7 | B | C | A | A |
| Example 8 | C | C | A | A |
| Example 9 | A | A | A | A |
| Example 10 | A | A | A | A |
| Example 11 | A | B | A | A |
| Example 12 | A | B | A | A |
| Example 13 | A | A | B | B |
| Example 14 | B | B | B | A |
| Example 15 | A | A | A | A |
| Example 16 | B | B | A | A |
| Example 17 | A | B | A | A |
| Example 18 | B | B | B | A |
| Example 19 | A | A | A | A |

TABLE 6-1-continued

| | Evaluation | | | |
|---|---|---|---|---|
| | Heat-resistant storage stability | | Low-temperature fixing property | |
| | No pressurization | With pressurization | System speed 350 mm/sec | System speed 800 mm/sec |
| Example 20 | A | B | A | A |
| Example 21 | A | B | A | A |
| Example 22 | B | B | B | A |
| Example 23 | A | A | C | C |
| Comp. Ex. 1 | D | D | B | B |
| Example 24 | C | C | B | B |
| Comp. Ex. 2 | D | D | B | B |
| Comp. Ex. 3 | D | D | B | B |
| Example 25 | B | B | C | C |
| Comp. Ex. 4 | D | D | B | B |
| Example 26 | B | B | A | A |
| Comp. Ex. 5 | B | B | A | A |
| Example 27 | A | A | AB | AB |
| Example 28 | A | A | AB | AB |
| Example 29 | A | A | AA | AA |
| Example 30 | A | A | AA | AA |

TABLE 6-2

| | Evaluation | | | |
|---|---|---|---|---|
| | Hot-offset resistance | | Total | |
| | System speed 350 mm/sec | System speed 800 mm/sec | evaluation points | Overall evaluation |
| Example 1 | B | C | 15 | B |
| Example 2 | B | C | 13 | B |
| Example 3 | B | C | 14 | B |
| Example 4 | B | C | 12 | C |
| Example 5 | B | C | 11 | C |
| Example 6 | B | C | 8 | C |
| Example 7 | B | B | 13 | B |
| Example 8 | B | B | 12 | C |
| Example 9 | B | C | 15 | B |
| Example 10 | C | C | 14 | B |
| Example 11 | B | C | 14 | B |
| Example 12 | B | C | 14 | B |
| Example 13 | B | C | 13 | B |
| Example 14 | B | C | 12 | C |
| Example 15 | A | A | 18 | A |
| Example 16 | A | A | 16 | A |
| Example 17 | A | A | 17 | A |
| Example 18 | A | A | 15 | B |
| Example 19 | A | B | 17 | A |
| Example 20 | A | B | 16 | A |
| Example 21 | A | B | 16 | A |
| Example 22 | A | B | 14 | B |
| Example 23 | C | C | 10 | C |
| Comp. Ex. 1 | B | B | 8 | D |
| Example 24 | A | B | 11 | C |
| Comp. Ex. 2 | B | C | 7 | D |
| Comp. Ex. 3 | B | C | 7 | D |
| Example 25 | B | C | 9 | C |
| Comp. Ex. 4 | B | C | 7 | D |
| Example 26 | C | C | 12 | C |
| Comp. Ex. 5 | D | D | 8 | D |
| Example 27 | A | A | 20 | AB |
| Example 28 | A | B | 19 | AB |
| Example 29 | A | A | 21 | AA |
| Example 30 | A | A | 21 | AA |

From the results of Examples 1 to 30, the toner of the present invention may be favorably used for an electrophotographic toner, developer, a full-color image forming method and image forming apparatus, a process cartridge and so on since it has superior low-temperature fixing property, hot-offset resistance and heat-resistant storage stability altogether.

Also, the process cartridge of the present invention may be favorably used for various electrophotographic image forming apparatuses, facsimiles, printers and so on since it uses a developer including the toner of the present invention.

Aspects of the present invention are as follows, for example.

<1> A toner, including:

a binder resin;

releasing agent-encapsulating capsules; and a colorant, wherein the releasing agent-encapsulating capsules each include: a capsule formed of a resin (I) which is different from the binder resin; and a releasing agent (RA) which is encapsulated in the capsule, and the releasing agent-encapsulating capsules exist in the binder resin, and wherein 50% to 100% of the releasing agent-encapsulating capsules exist in a region from a surface of the toner to a depth of 0.10 times a volume-average particle diameter of the toner.

<2> The toner according to <1>, wherein the binder resin includes: a non-crystalline resin (R); and a material (A) which is compatible with the non-crystalline resin (R).

<3> The toner according to <1> or <2>, wherein the releasing agent-encapsulating capsules each include: a capsule formed of the resin (I) which is different from the binder resin and of a resin (D) including a vinyl monomer and having a high affinity with the releasing agent (RA); and the releasing agent (RA) which is encapsulated in the capsule, and wherein the releasing agent-encapsulating capsule exists in the binder resin.

<4> The toner according to any one of <1> to <3>, wherein the releasing agent-encapsulating capsules have an average circle-equivalent diameter of 50 nm to 200 nm.

<5> The toner according to <3> or <4>, wherein the resin (D) includes a vinyl monomer including an ester group introduced in an oil-soluble component, and wherein an average ester-group concentration of the vinyl monomer calculated by Formula (1) below is 8% by mass to 30% by mass:

$$\text{Ester-group concentration}=\Sigma(44/Mwi\times Wi) \qquad \text{Formula (1)}$$

where, in Formula (1), "Mwi" represents a molecular weight of the vinyl monomer including an ester group, and "Wi" represents a charge ratio (% by mass) of the vinyl monomer including an ester group.

<6> The toner according to any one of <3> to <5>, wherein the resin (D) is a polyolefin resin.

<7> The toner according to any one of <3> to <6>, wherein a mass ratio of a mass of the resin (D) to a mass of the releasing agent (RA) [(D)/(RA)] is 0.01 to 2.5.

<8> The toner according to any one of <1> to <7>, wherein the releasing agent (RA) includes a hydrocarbon wax.

<9> The toner according to any one of <1> to <8>, wherein the releasing agent (RA) has a melting point of less than 80° C.

<10> The toner according to any one of <2> to <9>, wherein the material (A) is a crystalline polyester.

<11> The toner according to any one of <1> to <10>, wherein the binder resin includes a crystalline resin (C) as a main component.

<12> The toner according to <11>, wherein the binder resin includes, as the crystalline resin (C): a first crystalline resin (C-1); and a second crystalline resin (C-2) having a weight-average molecular weight Mw greater than that of the first crystalline resin, and wherein the first crystalline resin (C-1) is a crystalline polyester.

<13> The toner according to <12>, wherein the second crystalline resin (C-2) is a crystalline resin including a urethane bond or a urea bond, or both thereof, in a backbone thereof.

<14> The toner according to <13>, wherein the second crystalline resin (C-2) is a crystalline resin formed by elongation of a modified crystalline having an isocyanate group at an end thereof.

<15> The toner according to any one of <11> to <14>, wherein the binder resin includes, as the crystalline resin (C): the first crystalline resin (C-1); and the second crystalline resin (C-2) having a weight-average molecular weight Mw greater than that of the first crystalline resin, and wherein the first crystalline resin (C-1) is a crystalline resin including a urethane bond or a urea bond, or both thereof, in a backbone thereof.

<16> A developer, including:

the toner according to any one of <1> to <15>.

<17> A process cartridge, including:

a photoconductor; and a developing unit which develops an electrostatic latent image on the photoconductor with a developer including the toner according to any one of <1> to <15> to form a visible image, wherein the photoconductor and the developing unit are integrally supported, and the process cartridge is detachably attached to an image forming apparatus.

<18> An image forming apparatus, including:

a photoconductor;

an electrostatic latent image forming unit which forms an electrostatic latent image on the photoconductor;

a developing unit which develops the electrostatic latent image using a developer including the toner according to any one of <1> to <15> to form a visible image;

a transfer unit which transfers the visible image to a recording medium; and a fixing unit which fixes the visible image transferred to the recording medium.

This application claims priority to Japanese application No. 2012-058783, filed on Mar. 15, 2012, and Japanese application No. 2013-013622, filed on Jan. 28, 2013, and incorporated herein by reference.

What is claimed is:

1. A toner, comprising:

a binder resin comprising a non-crystalline resin (R), which comprises a polyester skeleton;

releasing agent-encapsulating capsules; and a colorant, wherein the releasing agent-encapsulating capsules each comprise: a capsule formed of a resin (I) which is different from the binder resin and of a polyolefin resin (D) comprising a vinyl monomer; and a releasing agent (RA) which is encapsulated in the capsule, wherein an absolute value of a difference between a solubility parameter of the polyolefin resin (D) and a solubility parameter of the release agent (RA) is less than 2, wherein the releasing agent-encapsulating capsules exist in the binder resin, wherein 50% to 100% of the releasing agent-encapsulating capsules exist in a region from a surface of the toner to a depth of 0.10 times a volume-average particle diameter of the toner, wherein the vinyl monomer of the resin (D) comprises an ester group introduced in an oil-soluble component, wherein an average ester-group concentration of the vinyl monomer calculated by Formula (1) is from 13.2% by mass to 30% by mass:

$$\text{Ester-group concentration}=\Sigma(44/Mwi\times Wi) \qquad \text{Formula (1)}$$

wherein Mwi is a molecular weight of the vinyl monomer comprising the ester group, and wherein Wi is a charge ratio (% by mass) of the vinyl monomer comprising the ester group.

2. The toner according to claim 1, wherein the binder resin further comprises a material (A) which is compatible with the non-crystalline resin (R).

3. The toner according to claim 1, wherein the releasing agent-encapsulating capsules have an average circle-equivalent diameter of 50 nm to 200 nm.

4. The toner according to claim 1, wherein a mass ratio of a mass of the resin (D) to a mass of the releasing agent (RA) [(D)/(RA)] is 0.01 to 2.5.

5. The toner according to claim 1, wherein the releasing agent (RA) comprises a hydrocarbon wax.

6. The toner according to claim 1, wherein the releasing agent (RA) has a melting point of less than 80° C.

7. The toner according to claim 2, wherein the material (A) is a crystalline polyester.

8. The toner according to claim 1, wherein the binder resin further comprises a crystalline resin (C) as a main component.

9. The toner according to claim 8, wherein the binder resin comprises, as the crystalline resin (C): a first crystalline resin (C-1); and a second crystalline resin (C-2) having a weight-average molecular weight Mw greater than that of the first crystalline resin, and wherein the first crystalline resin (C-1) is a crystalline polyester.

10. The toner according to claim 9, wherein the second crystalline resin (C-2) is a crystalline resin including a urethane bond or a urea bond, or both thereof, in a backbone thereof.

11. The toner according to claim 10, wherein the second crystalline resin (C-2) is a crystalline resin formed by elongation of a modified crystalline having an isocyanate group at an end thereof.

12. The toner according to claim 8, wherein the binder resin comprises, as the crystalline resin (C): the first crystalline resin (C-1); and the second crystalline resin (C-2) having a weight-average molecular weight Mw greater than that of the first crystalline resin, and wherein the first crystalline resin (C-1) is a crystalline resin including a urethane bond or a urea bond, or both thereof, in a backbone thereof.

13. A developer, comprising:

a toner which comprises:

a binder resin comprising a non-crystalline resin (R), which comprises a polyester skeleton;

releasing agent-encapsulating capsules; and a colorant, wherein the releasing agent-encapsulating capsules each comprise: a capsule formed of a resin (I) which is different from the binder resin and of a polyolefin resin (D) comprising a vinyl monomer; and a releasing agent (RA) which is encapsulated in the capsule, wherein an absolute value of a difference between a solubility parameter of the polyolefin resin (D) and a solubility parameter of the release agent (RA) is less than 2, wherein the releasing agent-encapsulating capsules exist in the binder resin, wherein 50% to 100% of the releasing agent-encapsulating capsules exist in a region from a surface of the toner to a depth of 0.10 times a volume-average particle diameter of the toner, wherein the vinyl monomer of the resin (D) comprises an ester group introduced in an oil-soluble component, wherein an average ester-group concentration of the vinyl monomer calculated by Formula (1) is from 13.2% by mass to 30% by mass:

$$\text{Ester-group concentration}=\Sigma(44/Mwi\times Wi) \qquad \text{Formula (1)}$$

wherein Mwi is a molecular weight of the vinyl monomer comprising the ester group, and wherein Wi is a charge ratio (% by mass) of the vinyl monomer comprising the ester group.

14. A process cartridge, comprising:

a photoconductor; and a developing unit which develops an electrostatic latent image on the photoconductor with a developer including a toner to form a visible image, wherein the photoconductor and the developing unit are integrally supported, and the process cartridge is detachably attached to an image forming apparatus, and wherein the toner comprises:

a binder resin comprising a non-crystalline resin (R), which comprises a polyester skeleton;

releasing agent-encapsulating capsules; and a colorant, wherein the releasing agent-encapsulating capsules each comprise: a capsule formed of a resin (I) which is different from the binder resin and of a polyolefin resin (D) comprising a vinyl monomer; and a releasing agent (RA) which is encapsulated in the capsule, wherein an absolute value of a difference between a solubility parameter of the polyolefin resin (D) and a solubility parameter of the release agent (RA) is less than 2, wherein the releasing agent-encapsulating capsules exist in the binder resin, wherein 50% to 100% of the releasing agent-encapsulating capsules exist in a region from a surface of the toner to a depth of 0.10 times a volume-average particle diameter of the toner, wherein the vinyl monomer of the resin (D) comprises an ester group introduced in an oil-soluble component, wherein an average ester-group concentration of the vinyl monomer calculated by Formula (1) is from 13.2 by mass to 30% by mass:

$$\text{Ester-group concentration}=\Sigma(44/Mwi \times Wi) \qquad \text{Formula (1)}$$

wherein Mwi is a molecular weight of the vinyl monomer comprising the ester group, and wherein Wi is a charge ratio (% by mass) of the vinyl monomer comprising the ester group.

15. The toner according to claim 1, wherein the solubility parameter of the polyolefin resin (D) (SP(D)) satisfies:

$$8 \leq SP(D) \leq 11.$$

16. The toner according to claim 1, wherein the toner is obtained by a process comprising:

preparing an oil phase with the releasing agent-encapsulating capsules dissolved or dispersed therein, dispersing the oil phase in an aqueous phase, thereby preparing an oil droplet dispersion comprising oil droplets that comprise the releasing agent-encapsulating capsules, and removing the solvent in the oil phase.

* * * * *

UNITED STATES PATENT AND TRADEMARK OFFICE

CERTIFICATE OF CORRECTION

PATENT NO. : 9,152,066 B2
APPLICATION NO. : 13/792763
DATED : October 6, 2015
INVENTOR(S) : Ryota Inoue et al.

It is certified that error appears in the above-identified patent and that said Letters Patent is hereby corrected as shown below:

On the title page, Item 71, "Kazuoki Fuwa, Kyogo (JP)" should read --KazuokiFuwa, Hyogo (JP)--

On the title page, Item 72, "Kazuoki Fuwa, Kyogo (JP)" should read --KazuokiFuwa, Hyogo (JP)--

Signed and Sealed this
Twelfth Day of July, 2016

Michelle K. Lee

Michelle K. Lee
*Director of the United States Patent and Trademark Office*